US006629512B2

(12) United States Patent
Iwatani et al.

(10) Patent No.: US 6,629,512 B2
(45) Date of Patent: Oct. 7, 2003

(54) INTERNAL COMBUSTION ENGINE WITH HEAT ACCUMULATING DEVICE

(75) Inventors: Kazuki Iwatani, Susono (JP); Makoto Suzuki, Mishima (JP); Katuhiko Arisawa, Susono (JP); Masakazu Tabata, Susono (JP); Kunihiko Hayashi, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/899,016

(22) Filed: Jul. 6, 2001

(65) Prior Publication Data

US 2002/0005178 A1 Jan. 17, 2002

(30) Foreign Application Priority Data

Jul. 10, 2000 (JP) ..... 2000-209124
Feb. 6, 2001 (JP) ..... 2001-029945

(51) Int. Cl.[7] ..... F01P 11/02
(52) U.S. Cl. ..... 123/41.14; 123/142.5 R
(58) Field of Search ..... 123/41.14, 179.21, 123/142.5 E, 142.5 R

(56) References Cited

U.S. PATENT DOCUMENTS 4,088,109 A * 5/1978 Woodruff et al. ..... 123/179 H

FOREIGN PATENT DOCUMENTS

| | | | | |
|---|---|---|---|---|
| DE | 3212043 A1 * | 10/1983 | ..... | F02N/17/02 |
| EP | 0 816 652 A1 | 1/1998 | | |
| JP | A 6-185359 | 7/1994 | | |
| RU | 2127824 C1 * | 1/1998 | ..... | F02N/17/04 |

* cited by examiner

*Primary Examiner*—Noah P. Kamen
(74) *Attorney, Agent, or Firm*—Oliff & Berridge, PLC

(57) ABSTRACT

An electronic control unit (ECU) of an engine system starts a control (preheat) that supplies heat reserving hot water stored in a heat accumulating device to an engine prior to an engine start. The ECU determines a time that continues the preheat on the basis of a cooling water temperature of the engine so as to execute the engine start after a warming-up of the engine is reliably finished. Further, during the execution of the preheat, a lighting lamp is turned on, and that incidence is recognized to a driver. When the preheat is completed, the ECU automatically starts the engine.

24 Claims, 30 Drawing Sheets

INTERNAL COMBUSTION ENGINE WITH HEAT ACCUMULATING DEVICE

INCORPORATION BY REFERENCE

The disclosure of Japanese Patent Application Nos. 2001-29945 filed on Feb. 6, 2001 and 2001-01731 filed on Jul. 10, 2000, each including the specification, drawings and abstract, are incorporated herein by reference in their entirety.

BACKGROUND OF THE INVENTION

1. Field of Invention

The invention relates to an internal combustion engine provided with a heat accumulating device having a function of temporarily accumulating a heat, whereby the heat stored in the heat accumulating device is supplied via a heat transfer medium such as a cooling water or the like so as to perform a warming up, and more particularly to a realization of a control configuration preferably applied to control an operation of the internal combustion engine.

2. Description of Related Art

In general, for an internal combustion engine mounted on a vehicle such as a motor vehicle, when the engine is driven in a state that a temperature in the periphery of a combustion chamber does not reach a predetermined temperature (a cooling state), there is generated a problem such that the fuel supplied to the combustion chamber is not sufficiently atomized or the like, thereby deteriorating an exhaust characteristics (emission) and a fuel economy performance. Accordingly, such an engine operation is not preferable.

However, in actual, with the exception of a restarting time after the engine temporarily stops, it is unavoidable to drive the engine in a cold state during a period between the engine start time and the warming-up completing time, at almost every time of starting the engine operation.

In response to the problem mentioned above, there has been known a heat accumulating device having a function of storing a heat generated during the operation of the internal combustion engine in a predetermined heat accumulating device and discharging the heat to the engine under the cold state.

For example, a heat accumulating device of an internal combustion engine described in Japanese Patent Application No. HEI6-185359 is structured such as to store a part of a cooling water heated due to a heat radiation of the engine in a heat insulation state even after the engine stops and release the heated cooling water to a cooling system (a cooling passage of the engine) at a next engine start, thereby quickly warming the engine.

In this case, in order to shorten a required time for the warming up which the internal combustion engine performs by its own ability, in view of increasing a chance to utilize the warming-up effect given by the heat accumulating device, it is most preferable to start the warming-up process of the internal combustion engine performed by using the heat accumulating device mentioned above before the engine is started, and complete the warming-up process at a time when the engine is started. If an executing timing of the warming-up process is too early, the once increased temperature of the engine is again cooled before the engine is started, or if the executing timing is too late, the engine is driven in a state that the warming up is not completed and the heat stored in the heat accumulating device is not sufficiently made good use.

However, as a matter of fact, it is hard to accurately forecast the timing for starting the engine which is performed on the basis of intention of a driver, by a control device of the engine or the like. Further, in the case of leaving the executing timing of the warming-up process up to the driver, not only an operation of the driver becomes complex at a time when the engine starts, but also it becomes hard to know a period at which the heat stored in the heat accumulating device is made best use and accurately select such a period so as to perform the warming up.

SUMMARY OF THE INVENTION

The invention relates to a warming up of an internal combustion engine utilizing a heat stored in a heat accumulating device, and one object of the invention is to provide an internal combustion engine with a heat accumulating device which can preferably increase a chance to utilize a warming-up function given by the heat accumulating device, by setting an optimum executing timing and notifying a driver of information concerning an executing process by way of a proper form.

According to an aspect of the invention, there is provided an internal combustion engine comprising:

a heat accumulating device that stores a heat;

a period determining device that determines an executing period of a warming-up process performed before the internal combustion engine is started, by supplying the heat stored in the heat accumulating device to the internal combustion engine through a predetermined heat transfer medium; and a warming-up process communicating device that communicates that the warming-up process is executed during the period that the warming-up process is executed.

According to the aspect mentioned above, since the incidence that the warming-up operation is executed can be known during a period between the start of the warming-up process and the completion thereof, for example, by the driver of the internal combustion engine, no sense of discomfort is generated in the driver, and the chance to utilize the warming-up process prior to the start of the internal combustion engine can be sufficiently

DETAILED DESCRIPTION OF PREFERRED EMBODIMENTS (First Embodiment)

Hereafter, a first embodiment in which an internal combustion engine with a heat accumulating device according to the invention is applied to an engine system to be mounted on a vehicle will be explained, with reference to the accompanying drawings.

Figure 1:
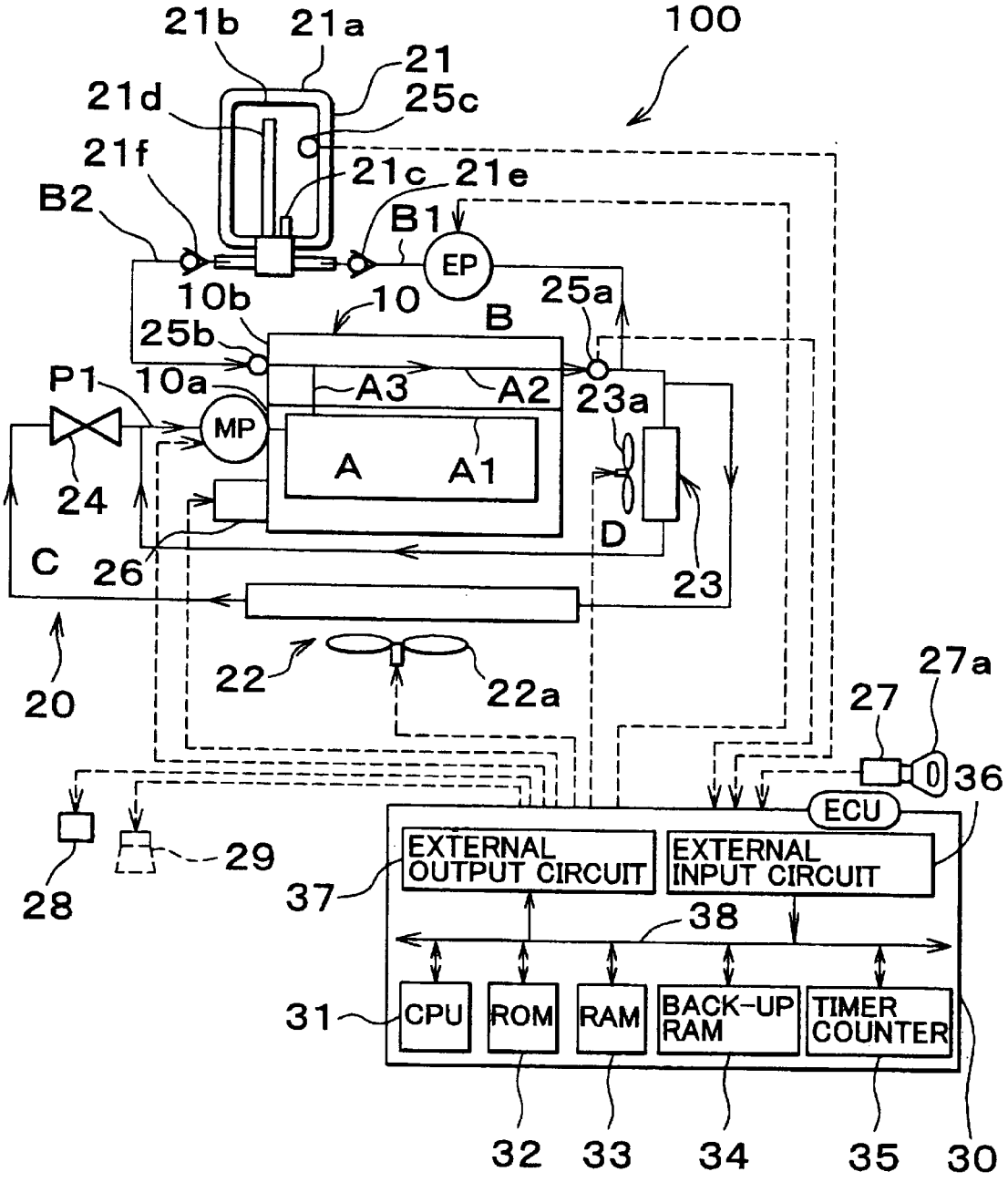
FIG. 1 is a schematic diagram showing an engine system to be mounted on a vehicle to which an internal combustion engine with a heat accumulating device according to a first embodiment of the invention is applied.

FIG. 1 shows a schematic structure of the engine system used for being amounted on the vehicle according to the present embodiment.

As shown in FIG. 1, an engine system to be mounted on the vehicle (hereinafter, simply referred to as an engine system 100) used as a prime mover of the vehicle is mainly constituted by an engine main body (hereinafter, simply referred to as an engine) 10, a cooling system 20 and an electronic control unit (ECU) 30.

The engine 10 is schematically formed in a manner that a cylinder block 10*a* as a lower member and a cylinder head 10*b* as an upper member are closed to and combined with each other. Four combustion chambers (not shown) and intake and exhaust ports (not shown) communicating the respective combustion chambers with the outside are formed in an inner portion of the engine 10. The engine 10 obtains a rotational torque in an output shaft (not shown) by exploding and burning mixed gas (mixed gas of an ambient air and a fuel) supplied through an intake port.

The cooling system 20 is constituted by a circulating passage (a water jacket) A formed in such a manner as to surround an outer periphery of the respective combustion chambers and the intake and exhaust ports within the engine 10, a circulating passage B circulating cooling water between the engine 10 and a heat accumulating device 21, a circulating passage C circulating cooling water (a cooling medium) between the engine 10 and a radiator 22, and a circulating passage D circulating cooling water between the engine 10 and a heater core for heating 23. Further, a part of the circulating passage A is commonly used as a part of each of the circulating passages B, C and D. Further, the circulating passage A can be substantially separated into a circulating passage A1 formed within the cylinder block 10*a*, a passage A2 formed within the cylinder head 10*b*, and a bypass passage A3 connecting the circulating passage A1 to the passage A2.

That is, the cooling system 20 corresponds to a complex system constructed by combining a plurality of cooling water circulating passages, and the cooling water circulating within the cooling system 20 cools or warm up each of the portions in the engine 10 by serving as a heat transfer medium so as to perform a heat exchange with the engine 10.

Various kinds of members for controlling or detecting a flow and a temperature of the cooling water are provided in each of the circulating passages A, B, C and D constituting the cooling system 20.

An electric type water pump (an electric pump) EP is operated on the basis of a command signal output from the ECU 30 so as to flow the cooling water within the circulating passage B in a direction shown by an arrow.

The heat accumulating device 21 is provided in a downstream portion of the electric pump EP. The heat accumulating device 21 has a function of storing a predetermined amount of cooling water 120 in a state of insulating heat from outside. That is, as shown in a schematic internal structure in FIG. 1, the heat accumulating device 21 has a double structure provided with a housing 21*a* and a cooling water receiving portion 21*b* housed within the housing 21*a*. A gap between the housing 21*a* and the cooling water receiving portion 21*b* is kept in a substantially vacuum state, thereby keeping the cooling water receiving portion 21*b*, the internal space and the external portion in a heat insulating state. An introduction pipe 21*c* for introducing the cooling water fed from the circulating passage B (a pump side passage B1) into the cooling water receiving portion 21*b*, and a discharge pipe 21*d* for discharging the cooling water within the container 21*b* to the circulating passage B (an engine side passage B2) are provided within the cooling water receiving portion 21*b*. The cooling water discharged to the engine side passage B2 through the discharge pipe 21*d* is introduced to the cylinder head 10*b* of the engine 10 and flows by preferentially through a passage formed near the intake ports of the respective cylinders within the cylinder head 10*b*.

In this case, check valves 21*e* and 21*f*, respectively provided in the middle of the pump side passage B1 and the engine side passage B2, allow the cooling water to only flow toward the engine side passage B2 from the pump side passage B1 via the heat accumulating device 21 and restrict a reverse flow.

A mechanical type water pump (a mechanical type pump) MP is driven by a driving force transmitted from the output shaft of the engine 10 and draws in the cooling water within the cylinder block 10*a* from an external passage P1. When the mechanical pump MP is operated in accordance with the operation of the engine 10, the cooling water within the circulating passage C and the circulating passage D is respectively prompted to generate the stream toward directions shown by arrows within the circulating passage C and the circulating passage D.

The radiator 22 provided in the circulating passage C radiates the heat of the heated cooling water to the outside. An electric type ventilating fan 22*a* is driven on the basis of a command signal of the ECU 30 so as to increase a heat radiating operation of the cooling water by the radiator 22. Further, a thermostat 24 is provided in the middle of the circulating passage C and in the downstream portion of the radiator 22. The thermostat 24 is a well-known control valve detecting a temperature and closing/opening in accordance with a degree of the detected temperature, and is structured such as to be opened so as to allow the cooling water to flow when the temperature of the cooling water within the circulating passage C near the thermostat 24 exceeds a predetermined temperature (for example, 80° C.), and be closed so as to restrict the stream of the cooling water when it is lower than the temperature predetermined.

That is, at a time when the engine 10 is being driven (at a time when the mechanical type pump MP is operated), in the case that the temperature of the cooling water exceeds 80° C., the cooling water within the circulating passage C is allowed to flow, whereby the cooling water is forcibly cooled according to an operation of the radiator 22. As a result, the engine 10 is cooled. In this case, a state of the engine 10 in which the temperature thereof (substantially equal to the temperature of the cooling water within the cooling system 20) exceeds 80° C. or substantially close to 80° C. is called a warm state, and a state in which the temperature is lower than 80° C. is called a cold state.

The heating heater core 23 provided in the circulating passage D utilizes the heat of the cooling water heated within the engine 10 and heats a passenger compartment of the vehicle (not shown) as occasion demands. An electric type ventilating fan 23*a* driven on the basis of the command signal of the ECU 30 promotes heat radiation by the cooling water passing through the heating heater core 23, and feeds the warm air generated due to the heat radiation of the cooling water within the passenger compartment of the vehicle via an air passage (not shown).

Water temperature sensors 25*a* provided in the middle of the common flow path from the engine 10 toward outside, for the cooling water circulating the respective circulating passages B, C and D output detecting signals in accordance with a temperature of the cooling water within the flow passages (a cooling water temperature; particularly called an engine outflow water temperature THWex) to the ECU 30. Further, a water temperature sensor 25*b* provided in the middle of the engine side passage B2 and near the connecting portion between the passage B2 and the engine 10 outputs a detecting signal in accordance with a temperature of the cooling water flowing into the engine 10 from the heat accumulating device 21 (a cooling water temperature; particularly called an engine inflow water temperature THWin). Further, a water temperature sensor 25*c* provided in the heat accumulating device 21 outputs a detecting signal in accordance with a temperature of the cooling water stored within the heat accumulating device 21 (hereinafter, referred to as a heat accumulating hot water temperature THWre). In this case, in the description mentioned below, a temperature of the cooling water existing within the cooling system 20 including the engine inflow water temperature THWin and the engine outflow water temperature THWex will be totally described as a cooling water temperature THW. In this case, the heat accumulating hot water temperature THWre is not included in the cooling water temperature THW.

An electric type starter (hereinafter, referred to as a starter) 26 attached to the engine 10 applied a rotational force to the output shaft thereof prior to a self-drive of the engine 10 so as to generate a so-called cranking operation.

Further, a key cylinder 27 in accordance with an external input portion turns "on" and "off" a main power source for a peripheral equipment such as a room lamp (not shown), an audio (not shown), a navigator (not shown) or display lamps, and a main relay for operating a function of executing a drive control of the engine 10 for the ECU 30, according to an operation of an ignition key 27*a* inserted to the key cylinder. Further, the ECU 30 executes an operation of the starter 26 and a start ignition of the engine 10 according to the operation of the ignition key 27*a*.

Further, a display device 28 turns on a light or displays letters or the like on the basis of a command signal from the ECU 30, and gives a visual information to the driver of the engine system 100.

The ECU 30 is electrically connected to various kinds of sensors outputting signals for knowing the operation state of the engine 10 and various kinds of drive circuits for controlling the operation state of the engine 10 in addition to members such as the electric type ventilating fans 22*a* and 23*a*, the water temperature sensor 25*a*, the starter 26, the key cylinder 27, the ignition key 27*a* and the display device 28.

Further, the ECU 30 is provided with a central processing unit (CPU) 31, a read only memory (ROM) 32, a random access memory (RAM) 33, a backup RAM 34, a timer counter 35 and the like, in an inner portion thereof. A logical operation circuit is constituted by connecting the respective portions (31, 32, 33, 34, 35) to an external input circuit 36 and an external output circuit 37 by a bus 38. In this case, the ROM 32 previously stores various kinds of programs for controlling an operating state of the engine 10 such as a fuel injection amount, an ignition timing, a flow of the cooling water within the cooling system 20 and the like. The RAM 33 temporarily stores a result of the calculation performed by the CPU 52. The backup RAM 34 is a nonvolatile memory storing data even after the operation of the engine 10 is stopped. The timer counter 35 performs a time counting operation which counts the time until the warming up completed. The external input circuit 36 includes a buffer, a waveform circuit, a hard filter, an analogue/digital converter and the like. The external output circuit includes a drive circuit and the like. The ECU 30 constituted in the manner mentioned above executes various kinds of controls with respect to the fuel injection of the engine 10, the ignition or the flow of the cooling water on the basis of the signals output from the various kinds of sensors, the key cylinder 27 and the like which are taken in via the external input circuit 36.

Next, a description will be given in detail of a structure around each of the combustion chambers formed within the engine 10 mainly with respect to the passage of the cooling water.

Figure 2:
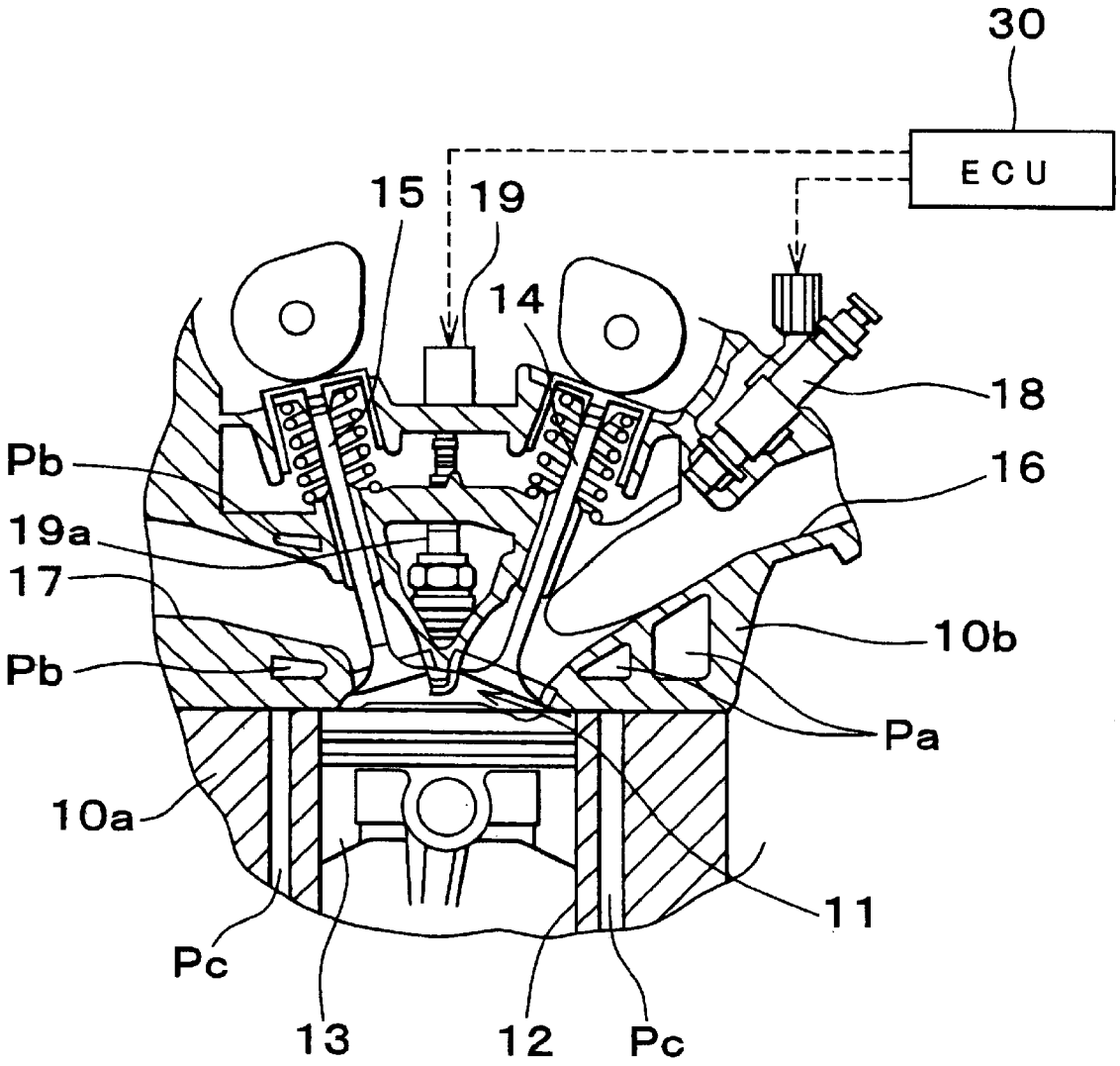
FIG. 2 is a schematic view showing a cross sectional structure in the periphery of a combustion chamber in a partly enlarged manner, with respect to the engine according to the first embodiment.

FIG. 2 is a schematic view (a side elevational view) showing a cross sectional structure around the combustion chamber in accordance with a part of an interior structure of the engine 10 in a partly enlarged manner.

As shown in FIG. 2, the combustion chamber 11 is positioned in a boundary between the cylinder block 10*a* and the cylinder head 10*b* and is formed above a piston 13 vertically moving so as to interlock with a rotation of the output shaft of the engine 10 within the cylinder 12. A space within the combustion chamber 11 is communicated with an intake port 16 and an exhaust port 17 via an intake valve 14 and an exhaust valve 15, respectively. At a time of driving the engine, it is performed to introduce mixed gas to the combustion chamber 11 via the intake port 16 and to exhaust an exhaust gas from the combustion chamber 11 via the exhaust port 17. A fuel injection valve 18 mounted to the intake port 16 injects and supplies the fuel on the basis of the command signal from the ECU 30. The fuel injected and supplied by the fuel injection valve 18 is atomized within the intake port 16, and taken within the combustion chamber 11 while forming the mixed gas together with a fresh air. Further, an igniter 19 driven on the basis of the command signal of the ECU 30 turns on electricity to an ignition plug 19*a* at a proper timing, whereby the mixed gas taken within the combustion chamber 11 is applied to combustion.

A cooling water passage (in accordance with a part of the circulating passage A1 shown in FIG. 1) Pc is formed within the cylinder block 10*a* so as to surround an outer periphery of the cylinder 12. Further, an intake port side cooling water passage Pa (in accordance with a part of the circulating passage A2 shown in FIG. 1) and an exhaust port side cooling water passage Pb (in accordance with a part of the circulating passage A2 shown in FIG. 1) are respectively formed near the intake port 16 and the exhaust port 17 within the cylinder head 10*b*. Then, the flow of the cooling water circulating within the cooling system 20 including the respective cooling water passages Pa, Pb and Pc (the circulating passages A1 and A2) is basically controlled on the basis of the operation of the mechanical pump MP, the electric motor EP and the thermostat 24, as mentioned above.

Next, a description will be given of a summary of a cooling system control with respect to a flow of the cooling water which the engine system 100 according to the present embodiment executes through the command signal of the ECU 30 and the like. In this case, a control mode of the cooling system by the engine system 100 is mainly separated into "a control at a cold time after the engine is started", "a control at a hot time after the engine is started" and "a control before the engine is started (a preheat control)" on the basis of difference in an executing stage and an executing condition.

FIG. 3 is a schematic view schematically showing the engine system 100 in order to describe a state that the stream of the cooling water circulating through the cooling system 20 of the engine system 100 (see FIG. 1) changes in accordance with the operating state of the engine 10 and a temperature distribution. In this case, in the drawing, the passage in which the stream of the cooling water is generated (including various kinds of members provided in the middle of the passage) is shown by a solid line, and the passage in which the stream of the cooling water is hardly generated or not generated (including various kinds of members provided in the middle of the passage) is shown by a single-dot chain line.

Figure 3A:
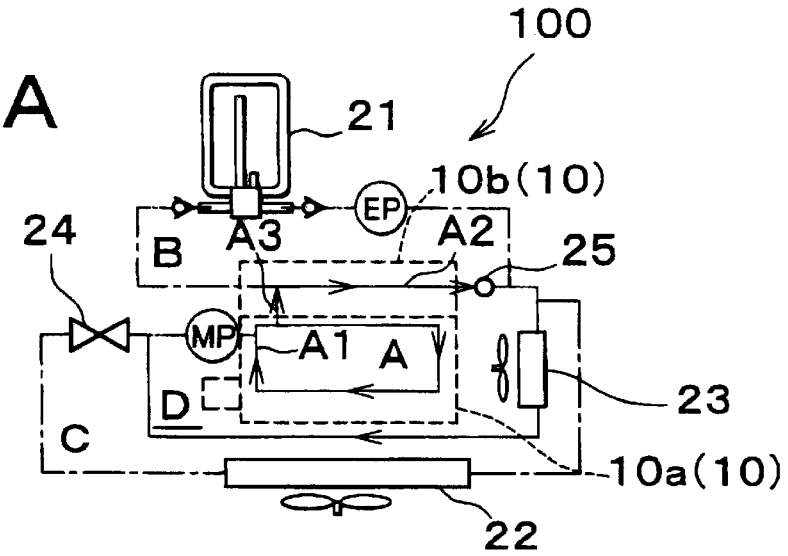
FIGS. 3A to 3C are schematic diagrams schematically showing the engine system according to the first embodiment.
Figure 3B:
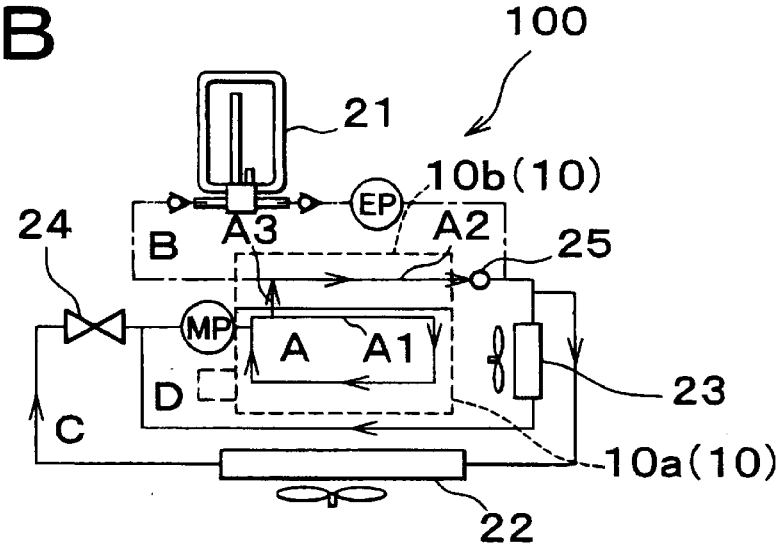

At first, both of FIGS. 3A and 3B show the engine system 100 in which the engine 10 is under the operating state, and the electric pump EP is under the stopping state. In this case, FIG. 3A shows the engine system in which the temperature of the cooling water near the thermostat 24 is equal to or lower than 80° C. within the cooling system 20, and FIG. 3B shows the engine system in which the temperature of the cooling water near the thermostat 24 is higher than 80° C. within the cooling system 20.

As shown in FIGS. 3A and 3B, when the electric pump EP is under the stopping state, the stream of the cooling water along the circulating passage B substantially stops except the circulating passage A, the circulating passage C or the circulating passage A2 constituting a part of the circulating passage D within the cylinder head 10*b*.

Further, at this time, if the temperature of the cooling water near the thermostat 24 within the cooling system 20 is equal to or lower than 80° C., the thermostat (the control valve) 24 is closed so as to restrict the stream of the cooling water from the control valve 24 toward the radiator 22. Accordingly, within the engine system 100, only the cooling water within the circulating passage A and the circulating passage D flows due to the operation of the mechanical type pump MP (FIG. 3A).

On the contrary, in the case that the temperature of the cooling water near the thermostat 24 within the cooling system 20 is higher than 80° C., the thermostat (the control valve) 24 is opened so as to allow the stream of the cooling water from the control valve 24 toward the radiator 22. Accordingly, within the engine system 100, the cooling water within the circulating passages A, C and D flows due to the operation of the mechanical type pump MP (FIG. 3B).

In this case, during the operation of the engine 10 in the present embodiment, the cooling system 20 basically keeps the state shown in FIG. 3A or 3B. Further, the states of the cooling system 20 shown in the respective drawings can be realized by executing the "control at the cold time after the engine is started" (FIG. 3A) or the "control at the hot time after the engine is started" (FIG. 3B).

Figure 3C:
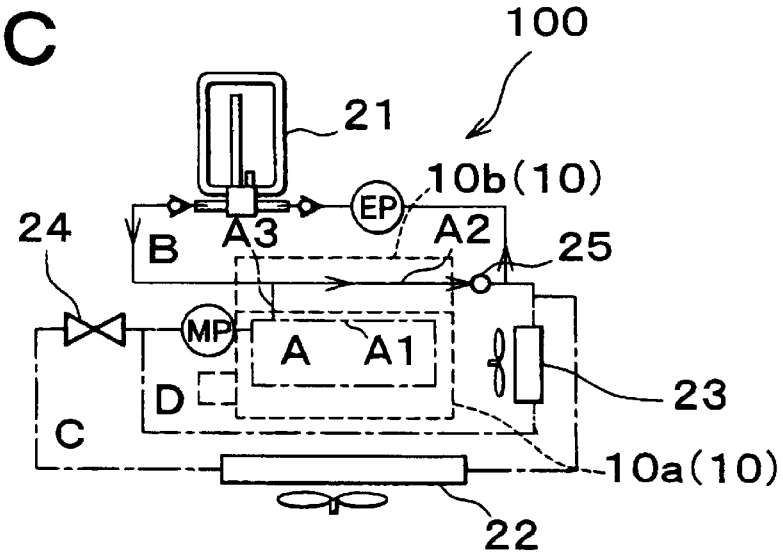

Further, FIG. 3C shows the engine system in which the engine is under the stopping state and the electric pump EP is under the operating state.

As shown in FIG. 3C, when the electric pump EP is operated, the cooling water flows along the circulating passage B. At this time, since the engine 10 is under the stopping state, the mechanical type pump MP operating together with the output shaft of the engine 10 stops, so that the stream of the cooling water is hardly generated within the circulating passage A1, the bypass passage A3, the circulating passage C and the circulating passage D. In this case, the state of the cooling system 20 shown in FIG. 3C corresponds to a state immediately before the engine 10 is started, and can be realized by executing the "preheat control" mentioned above.

In this case, a description will be in more detail given of the contents and an executing procedure of the "preheat control" mentioned above.

Figure 4:
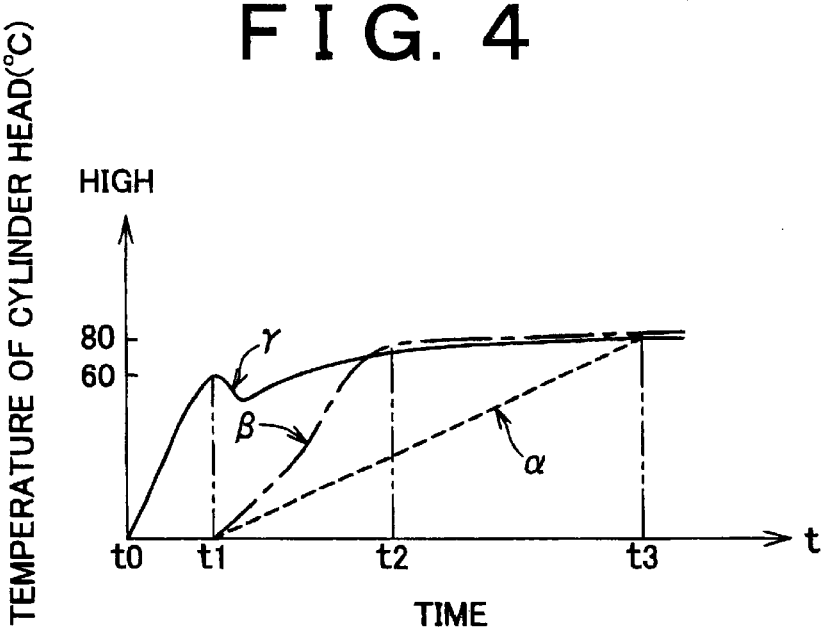
FIG. 4 is a time chart showing a temperature transition of a cylinder head as a result of experimentally modifying an operating mode of an electric pump in a heat accumulating device.

FIG. 4 is a time chart showing a state that a temperature transition of the cylinder head 10*b* becomes different as a result of experimentally changing the operation state of the electric pump EP at a time when the engine 10 is started, in connection with the engine system 100 shown in FIGS. 1 to 3. In this case, a time t1 corresponds to an engine start time of the engine 10. A pattern of the temperature transition (hereinafter, referred to as a transition pattern) a shown by a broken line shows a temperature transition in the case that the electric pump EP is not operated at a time of starting the engine, and a transition pattern β shown by a single-dot chain line shows a temperature transition in the case that the operation of the electric pump EP is started at the same time of starting the engine. Further, a transition pattern γ shown by a solid line shows a temperature transition in the case that the operation of the electric pump EP is started a predetermined time (5 seconds in the present embodiment) before starting the engine. In this case, in each of the transition patterns α, β and γ, it is assumed that the engine 10 is under the hot state immediately before the preceding engine operation is finished (the engine stops).

As shown in FIG. 4, in the transition pattern α, the temperature of the cylinder head 10*b* is gradually increased due to the heat generating effect of the engine 10 itself together with the engine operation, after the engine is started (after the time t1). Depending on some environmental conditions such as the ambient air temperature, when the temperature of the cylinder head 10*b* (substantially equal to the temperature of the cooling water) reaches 80° C. at a time t3 after about ten and several seconds to tens of seconds have passed after the time t1, the thermostat 24 repeatedly operates the opening and closing valve, whereby the temperature of the cooling water (the temperature of the cylinder head 10*b*) is kept in a substantially constant temperature (80° C.).

In the transition pattern β, at the same time when the engine 10 is started, the cooling water (the heat reserving hot water) stored within the heat accumulating device 21 under the temperature state equal to or higher than about 80° C. is supplied within the cylinder head 10*b*. In this case, at a time t2 at which about 10 seconds have passed after the engine 10 is started (on and after the time t1), the temperature of the cylinder head 10*b* (substantially equal to the temperature of the cooling water) reaches 80° C. Thereafter, the temperature of the cooling water (the temperature of the cylinder head 10*b*) is kept at substantially constant temperature (80° C.).

In the transition pattern γ, prior to the start of the engine 10, the heat reserving hot water within the heat accumulating device 21 is supplied within the cylinder head 10*b*. In this case, the inventors of present invention have confirmed that the temperature of the cylinder head 10*b* reaches the equivalent temperature (60 to 80° C.) of the temperature of the cooling water (the heat accumulating hot water temperature) within the heat accumulating device 21 about 5 to 10 seconds after the electric pump EP starts operating. In the transition pattern γ in FIG. 4, the engine 10 is started at the time (the time t1) at which ten seconds have passed after the operation of the electric pump EP is started at a time t0.

Accordingly, the engine 10 is started after the temperature of the cylinder head 10*b* reliably reaches 80° C. Incidentally, together with the operation of the engine 10, the cooling water having a lower temperature (than the temperature of the cooling water within the circulating passage B) flows into the cylinder head 10*b* from the passage space other than the circulating passage B within the cooling system 20. Accordingly, from and after the time t1, the temperature of the cylinder head 10*b* temporarily descends a little. However, it is again increased due to a continuous supply of the heat reserving hot water from the heat accumulating device 21 and the heat generating effect of the engine 10 itself caused by the engine operation so as to keep a temperature close to 80° C.

In the engine system 100 according to the present embodiment, the fuel injected and supplied to the engine 10 by the fuel injection valve 18 is atomized within the intake port 16 and is taken within the combustion chamber 11 while forming the mixed gas together with the fresh air. The mixed gas is supplied for the purpose of combustion as described in FIG. 2.

Accordingly, it is preferable that the temperature of the engine 10, particularly of the inner wall of the intake port 16 formed within the cylinder head 10*b* is higher than a predetermined temperature (60° C., preferably about 80° C.). The injected and supplied fuel should be quickly atomized within the intake port 16 and the atomized state should be preferably kept. Because the fuel is easily attached to the inner wall, when the temperature of the inner wall of the intake port 16 is reduced, it is hard to efficiently atomize (gasify) the fuel and keep the atomized (gasified) fuel in the atomized and gasified state. This disadvantage with respect to the gasification of the fuel reduces a combustion efficiency and makes an optimization of an air-fuel ratio difficult. Therefore exhaust characteristics and fuel economy deteriorate.

In the case that the engine 10 is under the cold state, when the engine operation is continued under a condition that no heat is supplied from outside, a comparatively long time (a time between t1 and t3) is required until the temperature of the cylinder head 10*b* (the suction port 16) becomes sufficiently high as shown by the transition pattern a in FIG. 4. Further, as shown by the pattern β in FIG. 4, even if the heat reserving hot water is supplied from the heat accumulating device 21 at the same time when the engine is started or immediately after the engine is started, making the warming-up completing timing after the engine is started as quick as possible, it is unavoidable that the exhaust characteristics and the fuel economy are deteriorated during the warming-up (the time between t1 and t2).

Then, as shown by the pattern γ FIG. 4, it is ideal to warm up (preheat) the engine system 100 so that the warming-up is completed (the engine 10 is transited to the hot state from the cold state) before the engine 10 has been started, by supplying the cooling water from the heat accumulating device 21 to the cylinder head 10*b* prior to the start of the engine 10.

However, some seconds are required for the engine 10 to complete the transition from the cold state to the hot state due to the supply of the heat reserving hot water from the heat accumulating device 21. If the engine start timing of the engine 10 intended by the driver is too early in comparison with the timing of the transition completion, the engine 10 is started before the state is transited to the hot state, so that it is impossible to sufficiently atomize the fuel.

That is, if the control is executed so that the engine 10 is started after the engine 10 reliably transits to the hot state due to the supply of the heat reserving hot water from the heat accumulating device 21, it is possible to solve the disadvantage with respect to the fuel atomization mentioned above, optimize the fuel efficiency and the air-fuel ratio, and improve the exhaust characteristics and the fuel economy.

Figure 5:
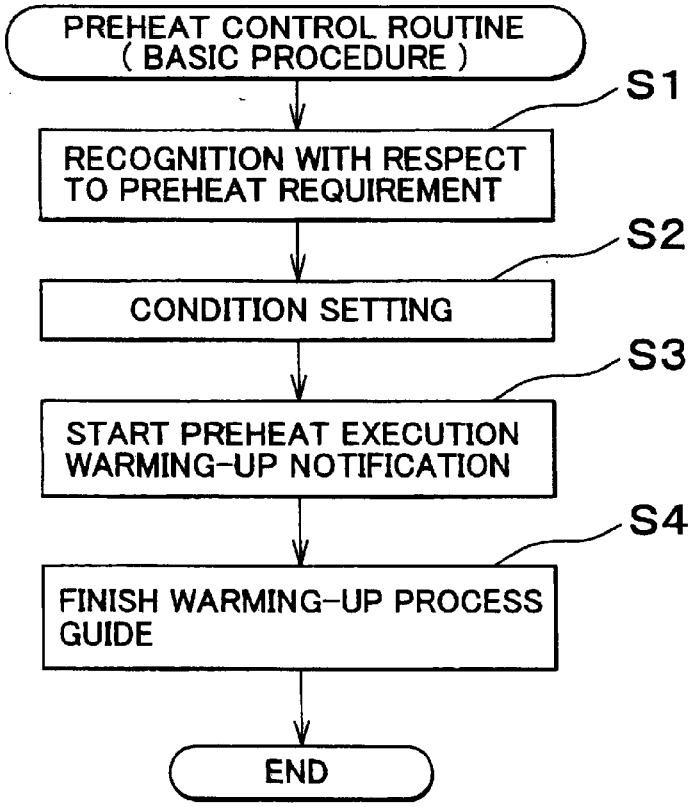
FIG. 5 is a flow chart showing a basic procedure of a preheat control according to the first embodiment.

FIG. 5 shows a basic procedure of the "preheat control" according to the present embodiment. In this case, the basic procedure is substantially common to the other embodiments mentioned below.

That is, the heat supply (the preheat) from the heat accumulating device to the engine prior to the engine start includes the following basic procedures in the control configuration thereof.

(1) At first, in step S1, it is recognized that the cooling water (the heat reserving hot water) should be supplied from the heat accumulating device to the engine (a preheat requirement).

The preheat requirement mentioned above may be performed according to the artificial operation or the like on the basis of the intention of the driver, or may be automatically executed on the basis of the judgement of the ECU 30 or the like.

(2) Next, in step S2, a condition with respect to the execution of the preheat is set (or conformed).

The condition with respect to the execution of the preheat may be, for example, a time from starting the execution of the preheat to completing the preheat, or may be a judgement standard for judging the preheat completion, for example, an amount of temperature increase of the engine or a supply amount of the heat reserving hot water supplied to the engine from the heat accumulating device. Further, the condition mentioned above may be calculated on the basis of the current environment (for example, the temperature of the engine and the ambient air temperature) or the like, or may be determined by referring to a map or the like. Further, it may be a condition during a preheat executing period (for example, a flow amount of the heat reserving hot water supplied from the heat accumulating device to the engine) or the like.

Further, in the same step, in the case that the current environment corresponds to a condition requiring no preheat, for example, in the case that the current environment is already higher than the temperature of the cooling water, it is possible to judge not to perform the preheat.

(3) Next, in step S3, the preheat is executed, for example, on the basis of the condition set in the step S2 mentioned above. Further, during the preheat executing period, information concerning the executing condition of the preheat is provided (a warming-up process guide) to the driver. The executing condition information may be that the preheat is being executed, a remaining time before the preheat is completed, or the like.

At this time, the ECU 30 may alarm or advise the driver not to start the engine during an ongoing of the preheat. The ECU may also automatically control the supply of the heat reserving hot water from the heat accumulating device prior to the engine start to continue supplying the heat reserving hot water but cancelling the operation with respect to the engine start. Further, the structure may be made such that the engine system 100 is provided with a mechanical structure so as not to start the engine until the preheat is completed.

(4) Next, in step S4, the warming-up process guide is finished at a time when the preheat is completed or the completion thereof is recognized.

In this case, the structure may be made so to forcibly cancel an inhibition of the engine start under a particular condition, even in the case that the preheat is not completed at a time of emergency or on the basis of the intention of the driver. Further, after canceling the inhibition, it is possible to simply allow the engine start or inform the driver of the incidence that the inhibition is cancelled. Further, it is possible to automatically start the engine after canceling the inhibition. In this case, it is preferable that an device for canceling the inhibition of the engine start is arranged so as to cancel the inhibition of the engine start from a passenger compartment.

Next, a description will be in detail given of the "preheat control" which is executed by the engine system 100 according to the present embodiment prior to starting of the engine 10 in accordance with the basic procedure mentioned above.

Figure 6:
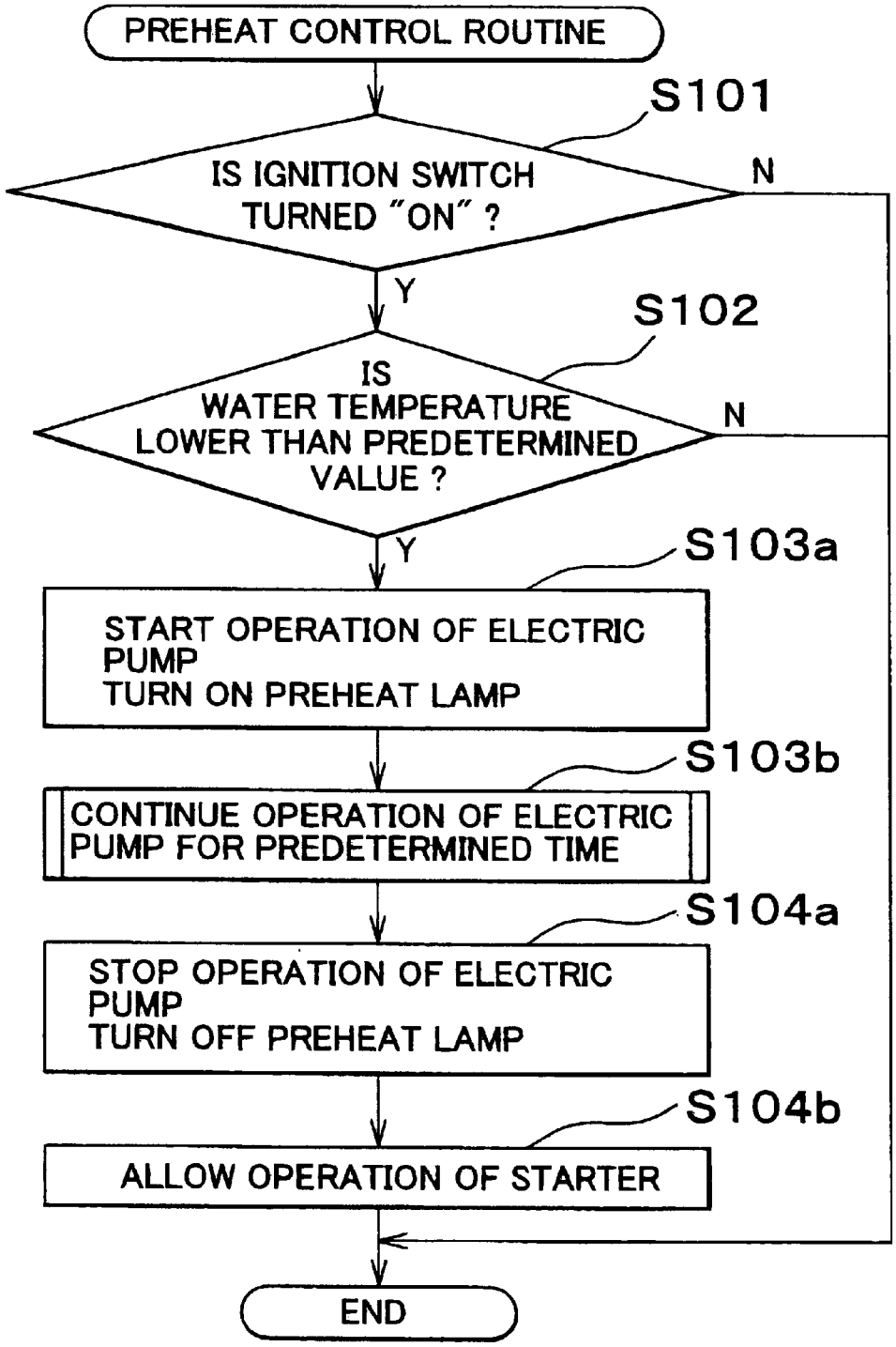
FIG. 6 is a flow chart showing a procedure of a preheat control according to the first embodiment.

FIG. 6 is a flow chart showing the contents of process in a "preheat control routine" which is executed by the engine system 100 at every predetermined time while the engine 10 is stopping. The ROM 32 of the ECU 30 previously stores a program concerning the following routine.

When the routine is started, the ECU 30 at first judges in step S101 whether or not a position (an ignition switch) of the ignition key 27*a* (see FIG. 1) inserted to the key cylinder 27 (see FIG. 1) is turned "on".

Figure 7:
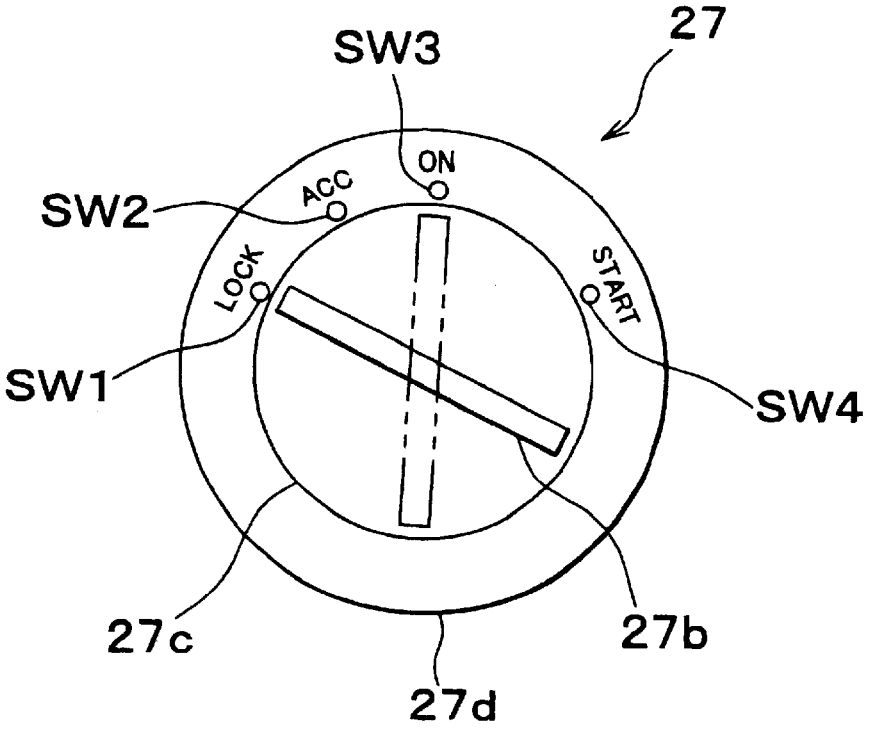
FIG. 7 is a plan view of a key cylinder according to the first embodiment as seen toward an inserting direction of an ignition key.

In this case, as shown in FIG. 7, the key cylinder 27 is formed with a circular rotor 27*c* provided with a slit 27*b* for inserting the ignition key 27*a*, and an annular case 27*d* surrounding an outer periphery of the circular rotor 27*c* by its own inner periphery, in the case of being seen toward an inserting direction of the ignition key 27*a*. The case 27*d* forms an outer hull of the key cylinder 27 main body, and is fixed, for example to an operation panel (not shown) of the side of driver's seat (the passenger compartment). The rotor 27*c* is structured such as to be rotatable within a limited range against the case 27*d* by turning the ignition key 27*a* inserted to the slit 27*b*. The ignition key 27*a* can be inserted to the slit 27*b* in a state that an end portion in a direction of a long width of the slit 27*b* coincides with a position SW1 indicated by "LOCK" in the case 27*d*, as shown by a solid line in FIG. 7.

At a time of starting the engine 10, at first, when the driver (the operator) inserts the ignition key 27*a* to the slit 27*b* and turns the ignition key from the position SW1 indicated by "LOCK" to a position SW2 indicated by "ACC", a main power source of peripheral equipment such as a room lamp (not shown), audio equipment (not shown) or a navigator (not shown) is in the "ON" state. Further, when turning the ignition key 27*a* to a position SW3 indicated by "ON" (shown by a double-dot chain line in FIG. 7), a main relay for operating a function of executing the operation control of the engine 10 for the ECU 30 becomes in an "ON" state. Further, when turning the ignition key 27*a* to a position SW4 indicated by "START", a starter 26 is driven so as to crank the engine 10, and the injection and supply of the fuel by the fuel injection valve 18 and the ignition of the gasified fuel by the igniter 19 are started in synchronized with the cranking operation.

That is, it is said that the rotation of the ignition key 27*a* to the position SW3 indicated by "ON" (the turning operation of the ignition key switch to "ON") is a necessary operation to be performed prior to the start of the engine 10.

Step S102 is executed if the judgement in the step S101 is positive, and ends the present routine if the judgement is negative.

In the step S102, it is judged whether or not a cooling water temperature (an engine outflow water temperature) THWex detected by the water temperature sensor 25*a* is lower than a predetermined temperature (which is preferably set to about 60° C.). Then, if the judgement is positive, it is recognized for the ECU 30 that the engine 10 is under the cold state, and step S103*a* is executed, thereby executing the preheat. On the contrary, if the judgement in the step S102 is negative, the ECU 30 temporarily ends the present routine.

Figure 8:
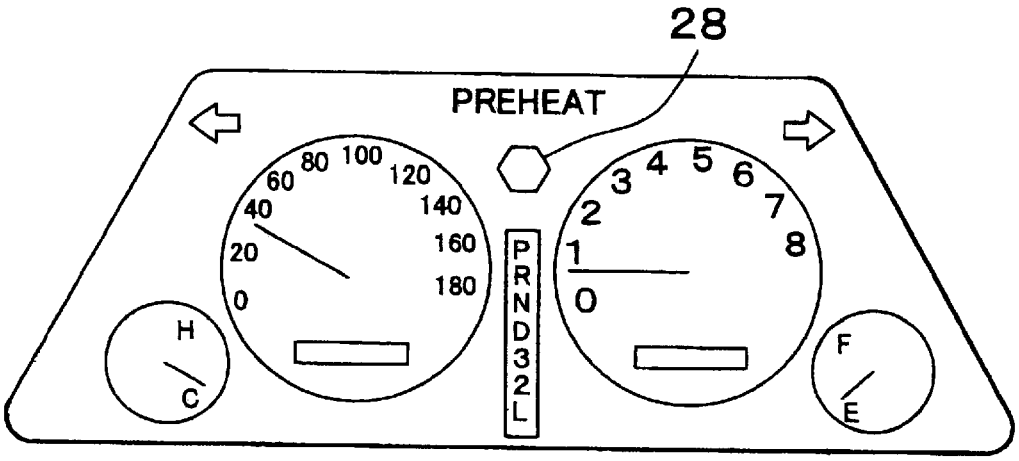
FIG. 8 is a plan view schematically showing an indicator panel comprised on the side of a driver's seat of a vehicle on which the engine system according to the first embodiment is mounted.

In the step S103*a*, the operation of the electric pump EP is started so as to start supplying the heat reserving hot water to the engine 10 from the heat accumulating device 21, and display device (the preheat lamp) 28 is turned on. FIG. 8 shows an indicator panel provided on the side of driver's seat of the vehicle on which the engine system 100 is mounted. The preheat lamp 28 is mounted, for example, on the indicator panel, and performs a lighting operation. In this case, the operation of the electric pump EP is continued for a predetermined time (for example, 5 seconds) (step S103*b*), and the preheat lamp 28 is also kept lighting. Further, even if the driver turns the ignition key 27*a* inserted to the key cylinder 27 to the "START" position SW4 during the operation of the electric pump EP, that is, during the execution of the preheat, the ECU 30 does not operate the starter 26.

After the predetermined time mentioned above has passed, the ECU 30 stops the operation of the electric pump and turns off the preheat lamp 28 (step S104*a*).

Finally, in step S104*b*, the ECU 30 allows the starter 26 to operate. That is, if the driver turns the ignition key 27*a* inserted to the key cylinder 27 to the "START" position SW4, the starter 26 is operated.

After passing through the step S104*b* mentioned above, the ECU 30 temporarily finishes a series of processes in the present routine.

Incidentally, the process in the respective steps of the "preheat control routine" mentioned above (FIG. 6) corresponds to the process in any steps of the previous basic procedure (FIG. 5). That is, the step S101 (FIG. 6) corresponds to the step S1 (FIG. 5), the step S102 (FIG. 6) corresponds to the step S2 (FIG. 5), the steps S103*a* and S103*b* (FIG. 6) correspond to the step S3 (FIG. 5), and the steps S104*a* and S104*b* (FIG. 6) correspond to the step S4 (FIG. 5), respectively.

Figure 9:
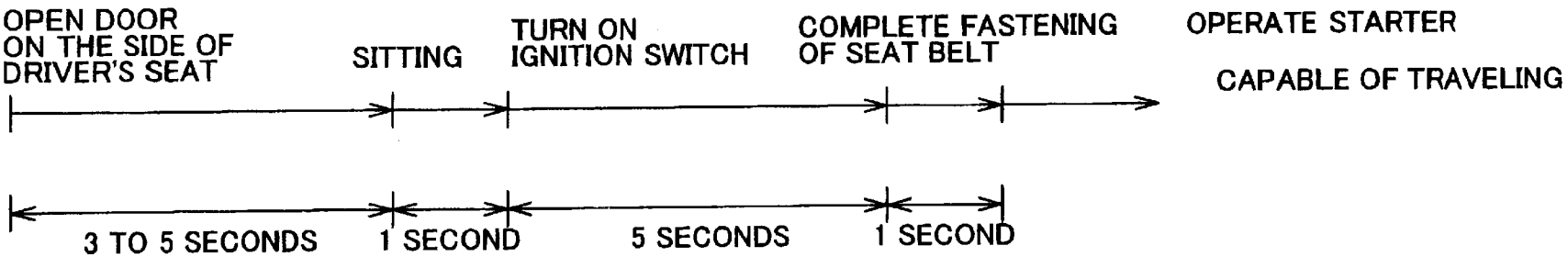
FIG. 9 is a time chart showing a timing of a series of operation from an operation of opening a door on the side of driver's seat to an operation of a starter.

In this case, as shown in a time chart in FIG. 9, a series of operations (a vehicle operation), that is, opening a door (not shown) on the side of the driver's seat→sitting on a seat (not shown)→turning the ignition key 27*a* to the "ON" position (switching the ignition switch to the "ON") →fastening a seat belt (not shown)→operating the starter, is a substantially necessary operation prior to the start of the engine 10 for the driver of the vehicle on which the engine system 100 is mounted. Among the operating procedures, it is conformed by the inventors that an elapsing time from the switching of the ignition switch to "ON" to the operation of the starter can be particularly defined to substantially 4 to 6 seconds. It is confirmed that this numeral (between 4 seconds and 6 seconds) is a value having a comparatively high reproducibility without largely depending, for example, on a sex, a body type and the like of the driver.

Then, it is as shown in the transition pattern γ in FIG. 4 that the engine 10 can be started under the state that the engine 10 has substantially got out of the cold state, by starting the preheat about 5 seconds earlier than the start of the engine 10 (the operation of the starter 26).

As mentioned above, in the "preheat control routine" mentioned above, there is employed a control configuration in which the start of the engine 10 is inhibited until the preheat is completed after starting the preheat prior to the start of the engine 10 and accurately knowing the duration or the completing time, in other words, an inhibiting period is provided.

That is, it is possible to start the engine operation at a time when the temperature of the engine 10 is sufficiently over a temperature area in which a trouble is generated at least with respect to the gasification of the supplied fuel after the engine reliably gets out of the cold state, by accurately knowing the preheat executing time and inhibiting the engine start under a certain condition in which the preheat is not completed.

Therefore, according to the engine system 100 of the present embodiment, it is possible to solve the advantage with respect to the fuel gasification (atomization) at a time of starting the engine, optimize the combustion efficiency and the air-fuel ratio, and improve the exhaust characteristics and the fuel economy.

In this case, with respect to setting the inhibiting period mentioned above, it is most preferable that the finishing time of the inhibiting period is the same as the start timing of the engine 10 intended by the driver, or it is desirable to be at least faster. This is because the longer the start of the engine 10 is inhibited against the driver's intention, the more comfortable feeling on operation for the driver is deteriorated with respect to the ignition key operation at a time of starting the engine.

On the contrary, when the engine 10 is started under the state that the preheat is not completed, the object of the preheat control to start the engine 10 under the hot state and promote the atomization of the fuel to be burned is not accomplished.

Further, with respect to the start time of the preheat (the start time of the inhibiting period), if the start time of the preheat is too early in comparison with the start timing of the engine 10 intended by the driver, the function of supplying the heat reserving hot water by the heat accumulating device 21 is unnecessarily spent, so that an advantage in view of a mounting characteristic and a cost is lost, such that a size of the heat accumulating device 21 is increased or the like.

Further, in the case that the start time of the preheat (the start time of the inhibiting period) is too late in comparison with the start timing of the engine 10 intended by the driver, the start of the engine 10 is delayed for the driver if the completion of preheat is made to come first.

In this point, in the engine system 100 according to the present embodiment, an operation necessarily prior to the operation of the starter 26 and sufficiently securing a reproducibility during a period (about 5 seconds) from the timing of the operation to the start timing of the engine 10 (the switching operation from the "LOCK" position of the ignition switch to the "ON" position) is used as a trigger for starting execute preheat.

Accordingly, a reliability for knowing the preheat executing period is high, and it is possible to finish the inhibiting period mentioned above (cancel the inhibition of starting the engine 10) at the same time as or immediately before the timing at which the driver intends to start the engine 10, or it is at least possible to sufficiently reduce the delay time from that timing.

Further, since the driver can recognize the execution of the preheat during the execution of the preheat, on the basis of the lighting operation of the preheat lamp 28, the driver can easily know the reason for which the engine start is inhibited, even if the timing of canceling the inhibition of the start of the engine 10 is delayed from the engine start timing intended by the driver. Accordingly, it is possible to preferably keep the comfortable feeling for the driving operation (the ignition key operation) with respect to the start of the engine 10.

In this case, in the step S104*b* mentioned above, the "preheat control routine" mentioned above may be structured such to automatically control the starter 26 to start the engine 10 after allowing the starter 26 to operate. By employing the automatic control mentioned above, it is possible to improve the comfortable feeling on the driving operation (the ignition key operation) for the driver, with respect to the start of the engine 10.

Further, the embodiment of inhibiting the operation of the starter 26 is not limited to the structure that the starter 26 is not operated even when rotating the ignition key 27*a* to the "START" position SW4. For example, the structure may be made such as to mechanically or electromagnetically restrict or lock the operation of the ignition key 27*a* inserted to the key cylinder 27 to the "START" position SW4. Further, the control may be made so that the fuel injection valve 18 is not operated (does not inject and supply the fuel) even when the starter 26 is operated, so that the engine 10 is not started.

Further, as shown by the broken line in FIG. 1, the structure may be made such that a speaker 29 generating a sound or a sound voice in accordance with the command signal output from the ECU 30 is added to the engine system 100 in place of the preheat lamp 28, and a notification is given by generating a notifying sound (stopping the sound generation) or a voice in place of lighting up the preheat lamp 28 in the steps S103*a* and S103*c* of the "preheat control routine" mentioned above. In addition, it is possible to employ a structure in which both of the speaker 29 and the preheat lamp 28 are used.

According to the first embodiment mentioned above, as described above, since for example, the driver of the internal combustion engine can know that the warming-up process is executed after the warming-up process is started before the warming-up process is completed, the driver does not feel sense of discomfort and it is possible to sufficiently obtain a chance of making good use of the warming-up process prior to the start of the internal combustion engine. Further, since the heat supply by the heat transfer medium is stopped in synchronized with the start of the internal combustion engine, the heat stored in the heat accumulating device is made maximum use of for warming up the internal combustion engine.

(Second Embodiment)

Next, a description will be given of a second embodiment obtained by applying the internal combustion engine with the heat accumulating device to the engine system to be mounted on the vehicle, by mainly referring to different points from the first embodiment.

In this case, in the second embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

In the "preheat control routine" in the preceding first embodiment, the structure is made such that the electric pump EP is operated so as to continue the preheat process for a predetermined time (for example, 5 seconds) (the step S103*b* in FIG. 6). On the contrary, in the engine system 100 according to the present embodiment, the completing timing of the preheat is judged with reference to an exchange rate (a replacement rate) of the heat reserving hot water existing within the heat accumulating device 21 with the cooling water existing within the cylinder head 10*b*.

That is, the parameter to be set as the reference for determining the executing period of the preheat or the period of inhibiting the engine start of the engine 10 is different from the first embodiment.

Figure 10:
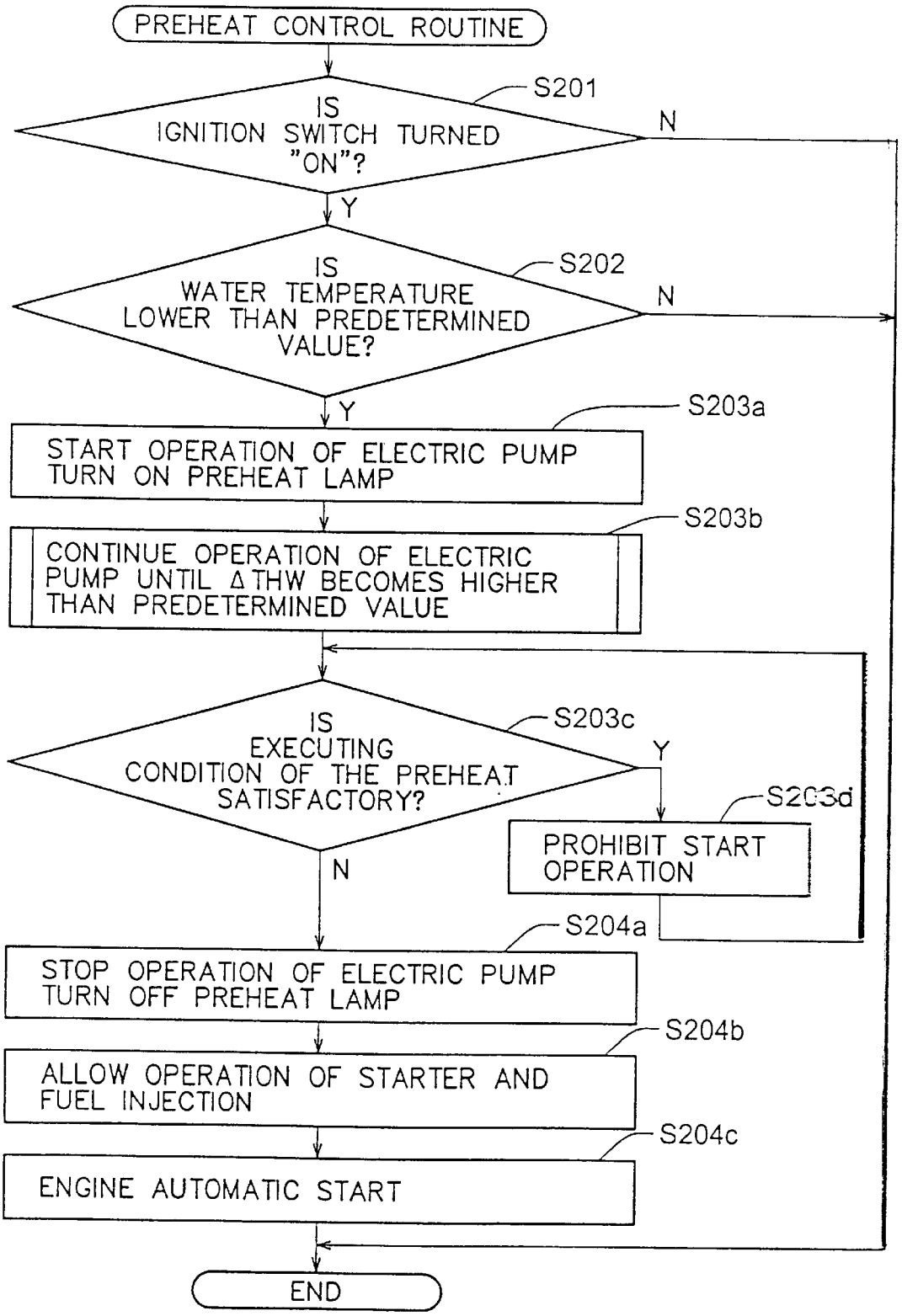
FIG. 10 is a flow chart showing a procedure of a preheat control according to a second embodiment of the invention.

FIG. 10 is a flow chart showing the process contents of a "preheat control routine" which the engine system 100 according to the present embodiment executes at every predetermined time while the engine 10 is stopping.

In the routine, the ECU 30 recognizes the preheat requirement, sets the condition with respect to the execution of the preheat, in a series of steps S201, S202 in accordance with the same process procedure as that of a series of steps S101, S102 and S103*a* in the "preheat control routine" (FIG. 6) according to the first embodiment.

In step S203*b* following the step S203*a* mentioned above, an operation of the electric pump EP is continued, that is, the preheat is continued until a temperature difference ΔTHW between a current engine outflow water temperature (a cooling water temperature) THWex and a cooling water temperature THWex0 at a time of starting the preheat becomes higher than a predetermined value THW0. In step 203*c*, the executing condition of the preheat is determined. If the executing condition is satisfactory, the routine moves to step 203*d* which prohibits a start operation of the engine. If the executing condition is unsatisfactory, the routine moves to step 204*a*, described below.

It is experimentally confirmed by the inventors that in the case of operating the electric pump EP by a constant drive force so as to perform the preheat, the exchange rate of the cooling water within the cylinder head 10*b* by the heat reserving hot water within the heat accumulating device 21 after the preheat is started (capacity of the heat reserving hot water flowing into the cylinder head 10*b* from the heat accumulating device/total capacity of the cooling water charged within the cylinder heat 10*b*) shows a high correlation with respect to the temperature difference ΔTHW.

Accordingly, the temperature difference ΔTHW in accordance with the exchange rate (for example, 95%) to be assumed as the completion of the preheat is experimentally calculated, and previously set as a predetermined value Q, and it is assumed that the preheat is completed when the temperature difference ΔTHW becomes higher than the predetermined value Q.

In the following steps S204*a* and S204*b*, there is executed a control with respect to stopping the electric pump EP (the step S204*a*) and canceling the inhibition of the engine start (the step S204*b*) together with the completion of the preheat in accordance with the same process procedure as that of the steps S104*a* and S104*b* in the "preheat control routine" (FIG. 6) according to the first embodiment.

In this case, in the "preheat control routine" according to the present embodiment, as the control for inhibiting the engine start, the fuel supply by the fuel injection valve 18 is inhibited in addition that the operation of the starter is inhibited.

Further, in step S204*c* following the step S204*b* mentioned above, the engine 10 is started by automatically controlling the starter 26. It is possible as described in the first embodiment to improve a comfortable feeling on the driving operation (the ignition key operation) by the driver with respect to the start of the engine 10, by employing the automatic control mentioned above.

As mentioned above, in the engine system 100 according to the present embodiment, it is also possible to start the engine operation at the point being sufficiently higher than the temperature range in which the trouble is generated with respect to at least the gasification of the supplied fuel after the engine 10 reliably gets out of the cold state, by accurately knowing the preheat executing period and inhibiting the engine start under the condition that the preheat is not completed.

Accordingly, it is possible to solve the disadvantage with respect to the fuel gasification (atomization) at a time of starting the engine, optimize the combustion efficiency and the air-fuel ratio, and improve the exhaust characteristics and the fuel economy.

(Third Embodiment)

Next, a description will be given of a third embodiment obtained by applying the internal combustion engine with the heat accumulating device to the engine system to be mounted on the vehicle, by mainly referring to different points from the first embodiment.

In this case, in the third embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

In the engine system 100 according to the third embodiment, as the display device, a display monitor for displaying information of letters or symbols is employed in place of the preheat lamp 28 performing the lighting operation. Then, in place of the lighting operation of the preheat lamp showing the continuation of the preheat executed between the steps S103*a* and S103*b* of the "preheat control routine", according to the first embodiment, a control is executed so that a remaining time until the preheat completion is sequentially displayed on the display monitor, after the preheat is started and before the preheat is completed.

Figure 11:
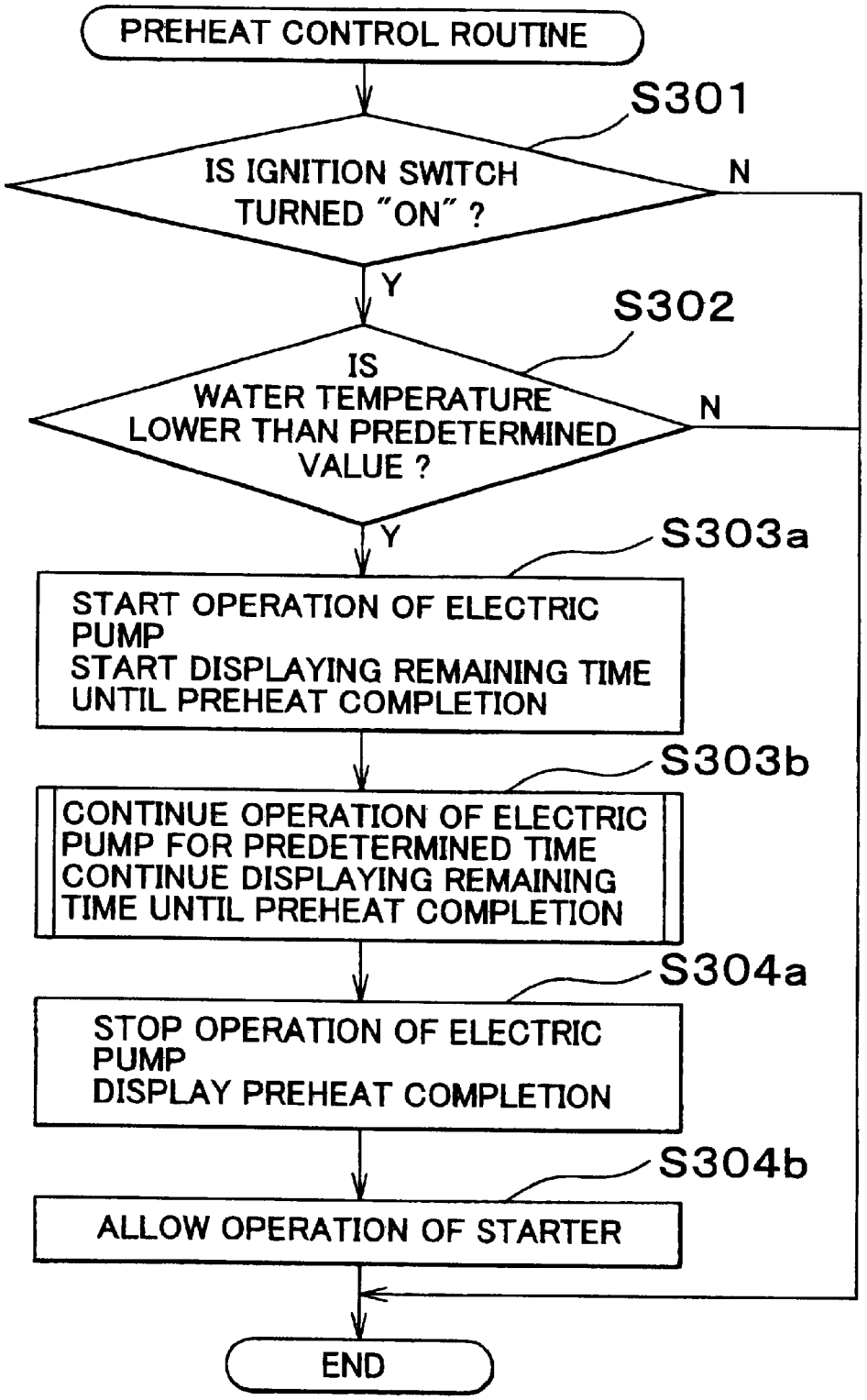
FIG. 11 is a flow chart showing a procedure of a preheat control according to a third embodiment of the invention.

FIG. 11 is a flow chart showing the process contents of a "preheat control routine" which the engine system 100 according to the present embodiment executes at every predetermined time while the engine 10 is stopping.

In the routine, the ECU 30 recognizes the preheat requirement, sets the condition, in a series of steps S301 and S302 in accordance with the same process procedure as that of a series of steps S101 and S102 in the "preheat control routine" (FIG. 6) according to the first embodiment.

Figure 12:
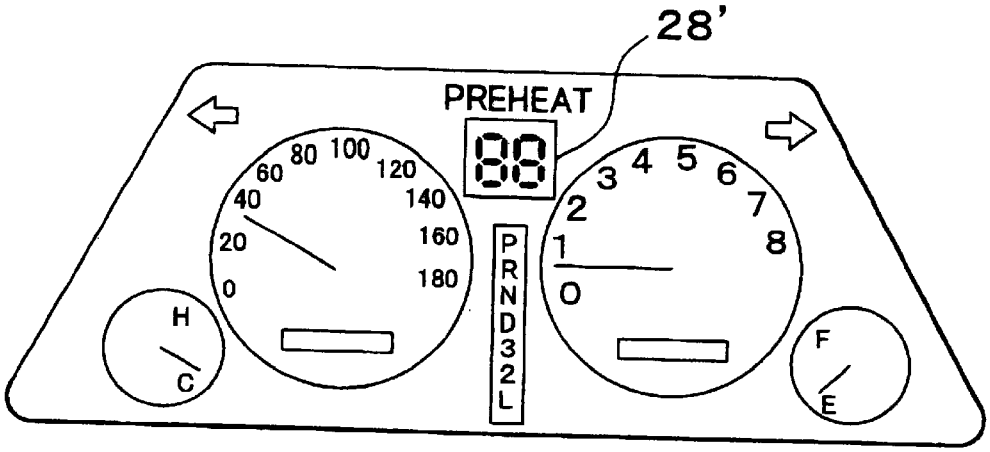
FIG. 12 is a plan view schematically showing an indicator panel comprised on the side of a driver's seat of a vehicle on which the engine system according to the third embodiment is mounted.

In step S303*a* following the step S302 mentioned above, an execution of the preheat and inhibition of the engine start are performed. Further, the display of the remaining time until the preheat completion is started in accordance with the execution of the preheat. FIG. 12 shows an indicator panel provided in the driver's seat of the vehicle on which the engine system 100 is mounted. A display monitor 28' is mounted, for example, on the indicator panel and displays numbers in accordance with the remaining time (second) until the preheat completion in response to the command signal from the ECU 30.

That is, the ECU 30 continues the preheat (the operation of the electric pump EP) for a predetermined time (for example, 5 seconds) and also subsequently displays the remaining time until the preheat completion on the display monitor 28', in the following step S303*b*.

When the preheat is completed, the operation of the electric pump EP is stopped in step S304*a*. And it is notified to the driver that the preheat is completed, by for example a particular number (for example, "00") is displayed on the display monitor 28' and blinks the displayed number.

Then, the ECU 30 cancels the inhibition of the operation of the starter 26 in step S304*b*, and executes a control with respect to canceling the inhibition of the engine start together with the completion of the preheat in accordance with the same operation procedure as that of the step S104*b* in the "preheat control routine" (FIG. 6) according to the first embodiment.

According to the engine system 100 of the present embodiment, the same effect as that of the first embodiment can be obtained, that is, it is possible to finish the inhibiting period (cancel the inhibition of the start of the engine 10) at the same time as or immediately before the driver intends to start the engine 10, or it is at least possible to sufficiently reduce the delay time from the timing.

Further, the driver can not only know the execution of the preheat during the execution of the preheat on the basis of the subsequent display operation (count down) of the display monitor 28' but also recognize the remaining time until the preheat completion.

For example, even in the case the timing of canceling the inhibition of the start of the engine 10 is delayed from the timing of the engine start intended by the driver, the comfortable feeling for the driving operation (the ignition key operation) with respect to the start of the engine 10 is further preferably kept.

(Fourth Embodiment)

Next, a description will be given of a fourth embodiment obtained by applying the internal combustion engine with the heat accumulating device to the engine system to be mounted on the vehicle, by mainly referring to different points from the first embodiment.

In this case, in the fourth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the fourth embodiment is different from the first embodiment in view of the structure of the key cylinder 27 and the function of the ECU 30 related to the structure of the key cylinder 27.

Figure 13:
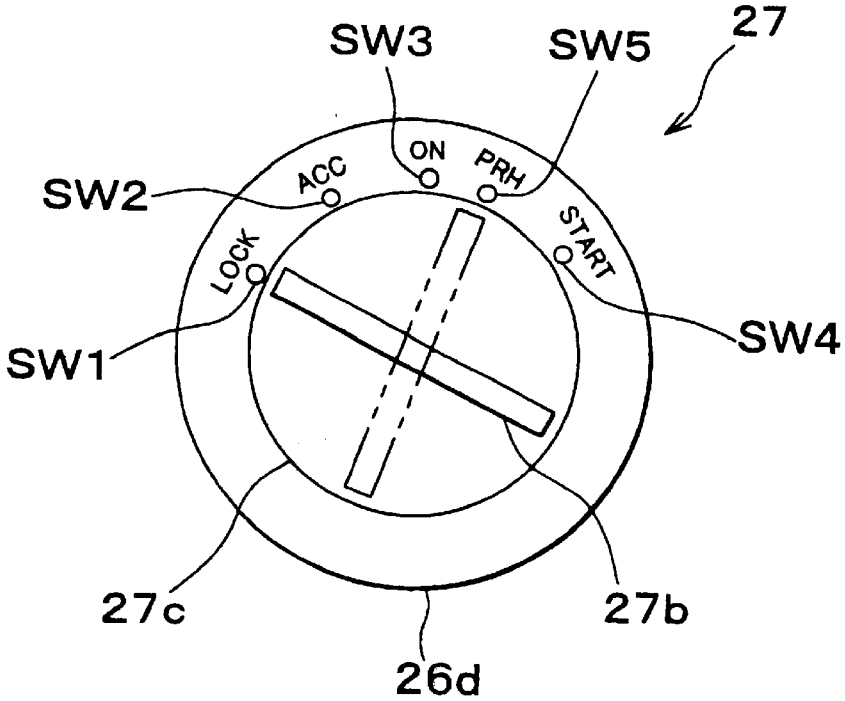
FIG. 13 is a plan view of a key cylinder according to a fourth embodiment of the invention as viewed toward an inserting direction of an ignition key.

At first, as shown in FIG. 13, the key cylinder 27 according to the fourth embodiment is structured such that in the same manner as the key cylinder 27 (see FIG. 7) according to the first embodiment, the displays of "LOCK", "ACC", "ON" and "START" are arranged on the case 27*d* as seen toward the inserting direction of the ignition key 27, and in addition, a display "PRH" is arranged between the position SW3 indicated by "ON" and the position SW4 indicated by "START". At a time of starting the engine 10, the driver intentionally turns the ignition key 27*a* inserted to the key cylinder 27 to a position SW5 indicated by "PRH" via the position SW3 indicated by "ON", whereby the ECU 30 starts preheating. According to the structure of the key cylinder 27 and the function of the ECU 30 in connection to the structure, since the preheat is necessarily started on the basis of the intention of the driver and prior to the start of the engine 10, a series of procedures after the driver intends to start engine 10 and before the engine 10 is started through the execution of the preheat and the completion thereof can be quickly executed by one motion of turning the ignition key 27*a* to one direction. Accordingly, even when the start of the engine 10 is inhibited until the preheat completion, the sense of discomfort felt by the driver can be restricted to the minimum limit.

Figure 14:
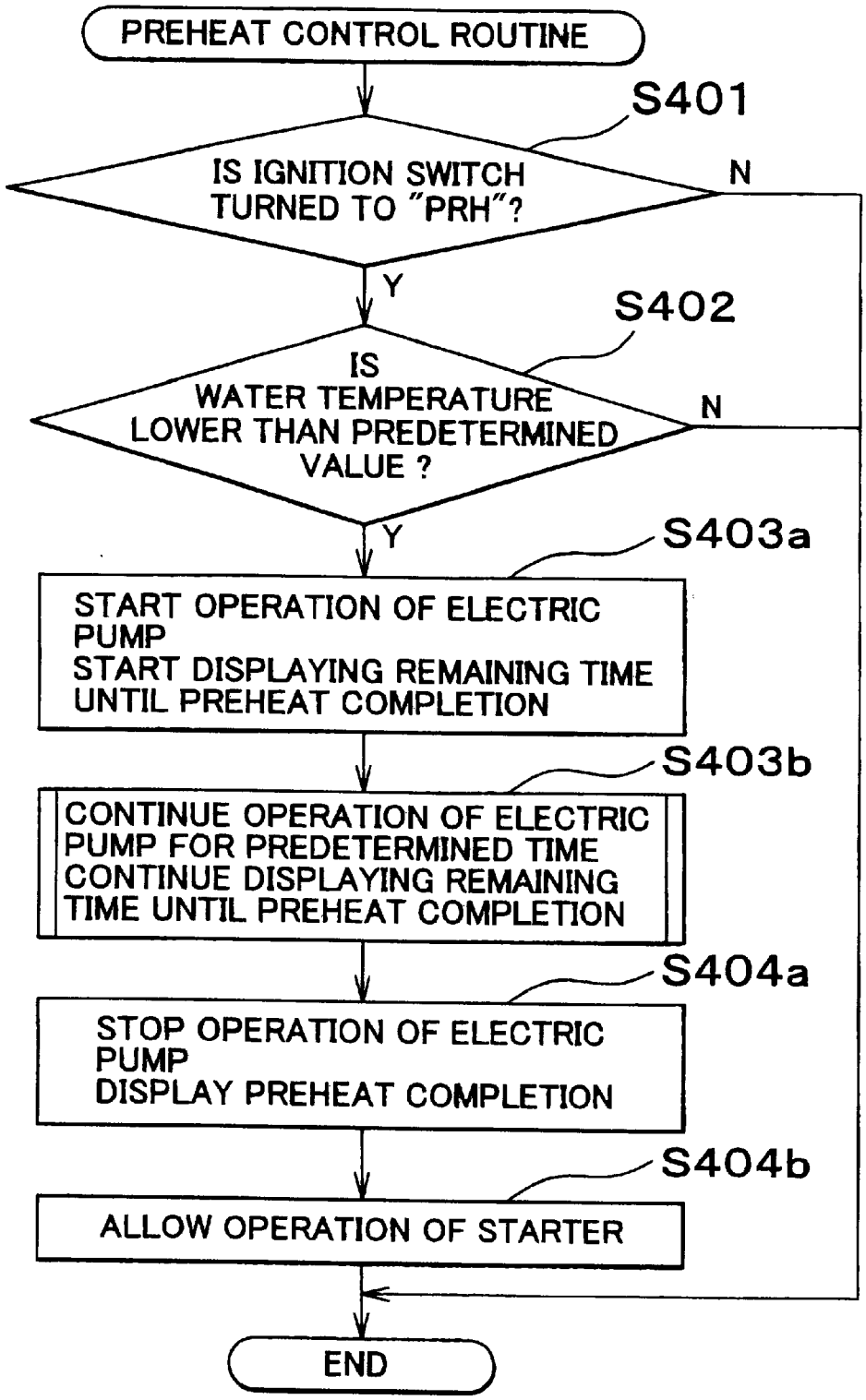
FIG. 14 is a flow chart showing a preheat control procedure according to the embodiment mentioned above.

FIG. 14 is a flow chart showing the process contents of a "preheat control routine" which the engine system 100 according to the present embodiment executes at every predetermined time while the engine 10 is stopping.

When this routine is started, the ECU 30 at first judges in step S401 whether or not the position of the ignition key 27*a* (the ignition switch) inserted to the key cylinder 27 is switched to the position SW5 indicated by "PRH".

Step S402 is executed if the judgement in the step S401 is positive, and temporarily ends the present routine if the judgement is negative.

In the step S402, it is judged whether or not a cooling water temperature (an engine outflow water temperature) THWex detected by the water temperature sensor 25*a* is lower than a predetermined temperature (which is preferably set to about 60° C.). Then, if the judgement is positive, it is recognized for the ECU 30 that the engine 10 is under the cold state, and step S403*a* is executed, and if the judgement is negative, the ECU 30 temporarily ends the present routine.

In the step S403*a*, the inhibition of the engine start is executed as well as the preheat is started. Further, the display of the remaining time until the preheat completion is started via the same display device as the display monitor 28' (see FIG. 12) which is applied in the third embodiment.

In the following step S403*b*, the preheat (the operation of the electric pump EP) is continued for a predetermined time (for example, 5 seconds), and the remaining time until the preheat completion is subsequently displayed on the display monitor.

Even if the driver turns the ignition key 27*a* inserted to the key cylinder 27 to the "START", position SW4 during the execution of the preheat, the ECU 30 does not operate the starter 26, in the same manner as that of the first embodiment.

When the preheat is completed, the ECU 30 stops the operation of the electric pump EP in step S404*a* and displays on the display monitor that the preheat is completed.

Finally, in step S404*b*, the ECU 30 allows the starter 26 to operate. That is, if the driver turns the ignition key 27*a* inserted to the key cylinder 27 to the "START" position SW4, the starter 26 is operated.

After passing through the step S404*b* mentioned above, the ECU 30 temporarily finishes a series of processes in the present routine.

As mentioned above, in the engine system 100 according to the present embodiment, it is possible to start the engine operation at the point being sufficiently higher than the temperature range in which the trouble is generated with respect to at least the gasification of the supplied fuel after the engine 10 reliably gets out of the cold state, by accurately knowing the preheat executing period and inhibiting the engine start under the condition that the preheat is not completed. Further, even if the start of the engine 10 is inhibited until the preheat completion as mentioned above, the sense of discomfort felt by the driver can be restricted to the minimum level.

(Fifth Embodiment)

Next, a description will be given of a fifth embodiment obtained by applying the internal combustion engine with the heat accumulating device to the engine system to be mounted on the vehicle, by mainly referring to different points from the first to fourth embodiments mentioned above.

In this case, in the fifth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the fifth embodiment is different from the first to fourth embodiments mentioned above in view of having a function of canceling the start inhibition of the engine 10 in accordance with the execution of the preheat under a predetermined condition.

Figure 15:
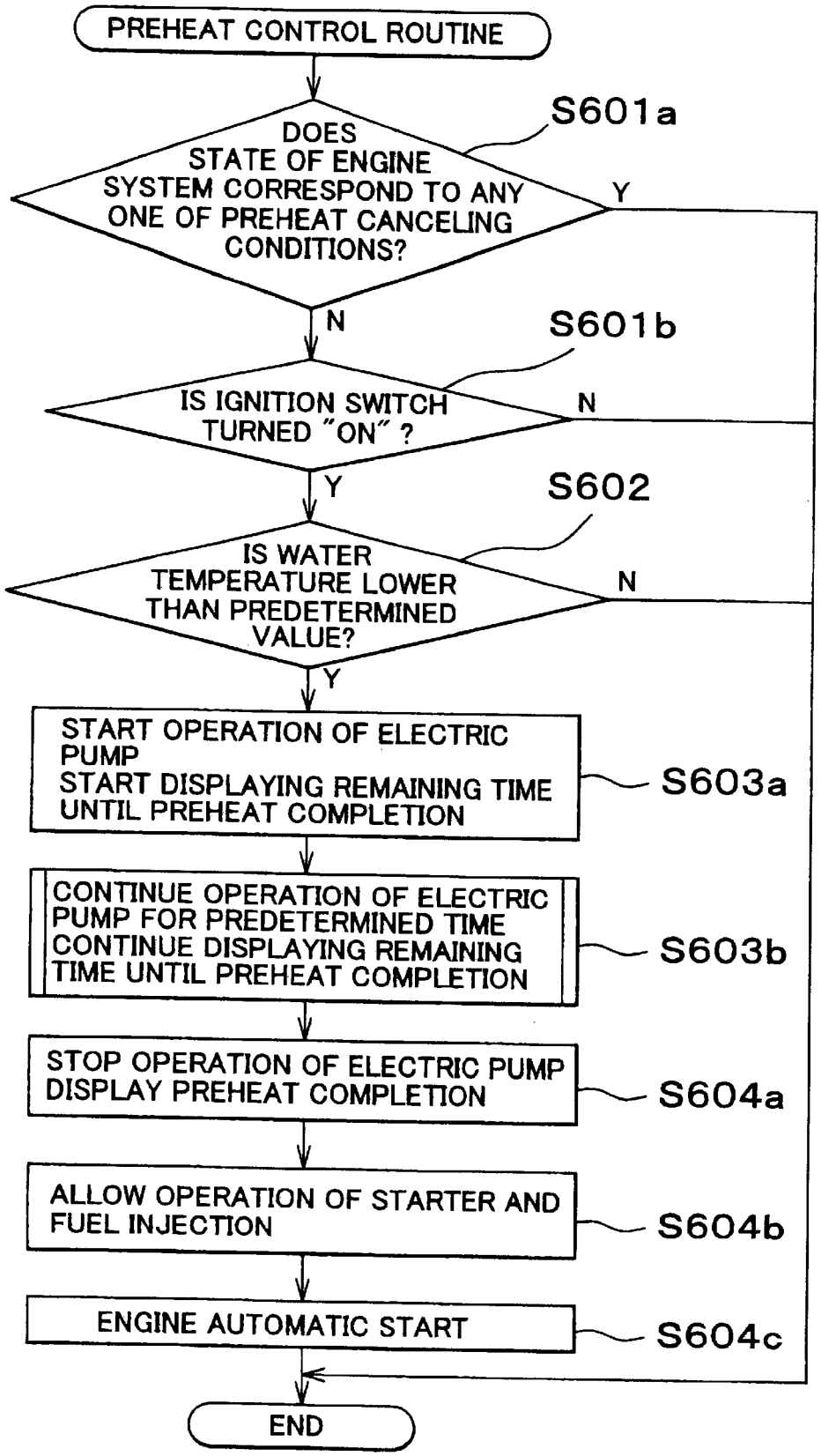
FIG. 15 is a flow chart showing a preheat control procedure according to a fifth embodiment of the invention.

FIG. 15 is a flow chart showing the process contents of a "preheat control routine" which the engine system 100 according to the present embodiment executes at every predetermined time while the engine 10 is stopping.

When this routine is started, the ECU 30 at first judges in step S601*a* whether or not the state of the engine system 100 corresponds to any one of the following preheat canceling conditions (a1) to (a5).

(a1) An abnormality is generated in any one of the cooling water circulating passages A to D.

(a2) An abnormality is generated in the electric pump EP.

(a3) An abnormality is generated in the heat accumulating device 21.

(a4) An abnormality is generated in the thermostat 24.

(a5) The executing mode of the preheat is manually cancelled.

In this case, the ECU 30 according to the present embodiment is provided with a function of diagnosing a generation of the abnormality described in the items (a1) to (a4) or a possibility thereof on the basis of the detected signal from the water temperature sensor 25*b* or the like. Further, an operating device (for example, an operating button) capable of manually determining whether or not the preheat control is executed by the ECU 30 is provided on the driver's seat of the vehicle on which the engine system 100 is mounted.

When the judgement in the step S601*a* is positive, that is, when the state of the engine system 100 corresponds to at least one of the conditions (a1) to (a5) mentioned above, the ECU 30 temporarily ends the present routine. On the contrary, when the state of the engine system 100 does not correspond to any one of the conditions (a1) to (a5) mentioned above, step S601*b* is executed.

In the routine, in a series of steps S601*b* and S602, the ECU 30 recognizes the preheat requirement and sets the condition in accordance with the same process procedure as that of a series of steps S101 and S102 in the "preheat control routine" (FIG. 6) according to the first embodiment.

In step S603*a* following the step S602, the preheat is executed and the inhibition of the engine start is executed. Further, the display of the remaining time until the preheat completion is started via the same display device as the display monitor 28' (see FIG. 12) which is applied in the third embodiment.

In the following step S603*b*, the preheat (the operation of the electric pump EP) is continued for a predetermined time (for example, 5 seconds), and the remaining time until the preheat completion is subsequently displayed on the display monitor.

When the preheat is completed, the ECU 30 stops the operation of the electric pump EP in step S604*a* and displays on the display monitor that the preheat is completed.

In the following step S604*b*, a control in connection with canceling the inhibition of the engine start is executed.

In this case, in the "preheat control routine" according to the present embodiment, as the control in connection with the inhibition of the engine start, the fuel supply by the fuel injection valve 18 is inhibited as well as the operation of the starter is inhibited.

Further, in step S604*c* following the step S604*b* mentioned above, the starter 26 is automatically controlled so as to start the engine 10.

As mentioned above, according to the engine system 100 of the present embodiment, there can be obtained the common effect to each of the embodiments mentioned above, that is, it is possible to start the engine operation at the point being sufficiently higher than the temperature range in which the trouble is generated with respect to at least the gasification of the supplied fuel after the engine 10 reliably gets out of the cold state, by basically inhibiting the engine start under the condition that the preheat is not completed. On the contrary, in the case that any abnormality is generated in the engine system 100 (particularly, in the cooling system 20) or the preheat execution is cancelled on the basis of the intentional operation of the driver, the start inhibition of the engine during the preheat is canceled, whereby it is possible to obtain an additional effect that a convenience is increased with respect to the operation of the engine system 100.

In this case, in the present embodiment, the structure is made such that in the step S601*a,* the preheat itself is not executed when the state of the engine system 100 corresponds to any one of the preheat canceling conditions, however, the structure may be made such that the condition is set (controlled) so as to loosen the inhibiting condition, for example, the preheat is executed but the engine start is not inhibited (restricted) in some conditions, or the inhibiting period is shortened.

(Sixth Embodiment)

Next, a description will be given of a sixth embodiment obtained by applying the internal combustion engine with the heat accumulating device to the engine system to be mounted on the vehicle, by mainly referring to different points from the first to fifth embodiments mentioned above.

In this case, in the sixth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the sixth embodiment determines an executing time of the preheat on the basis of the cooling water temperature THW prior to the execution of the preheat.

Figure 16:
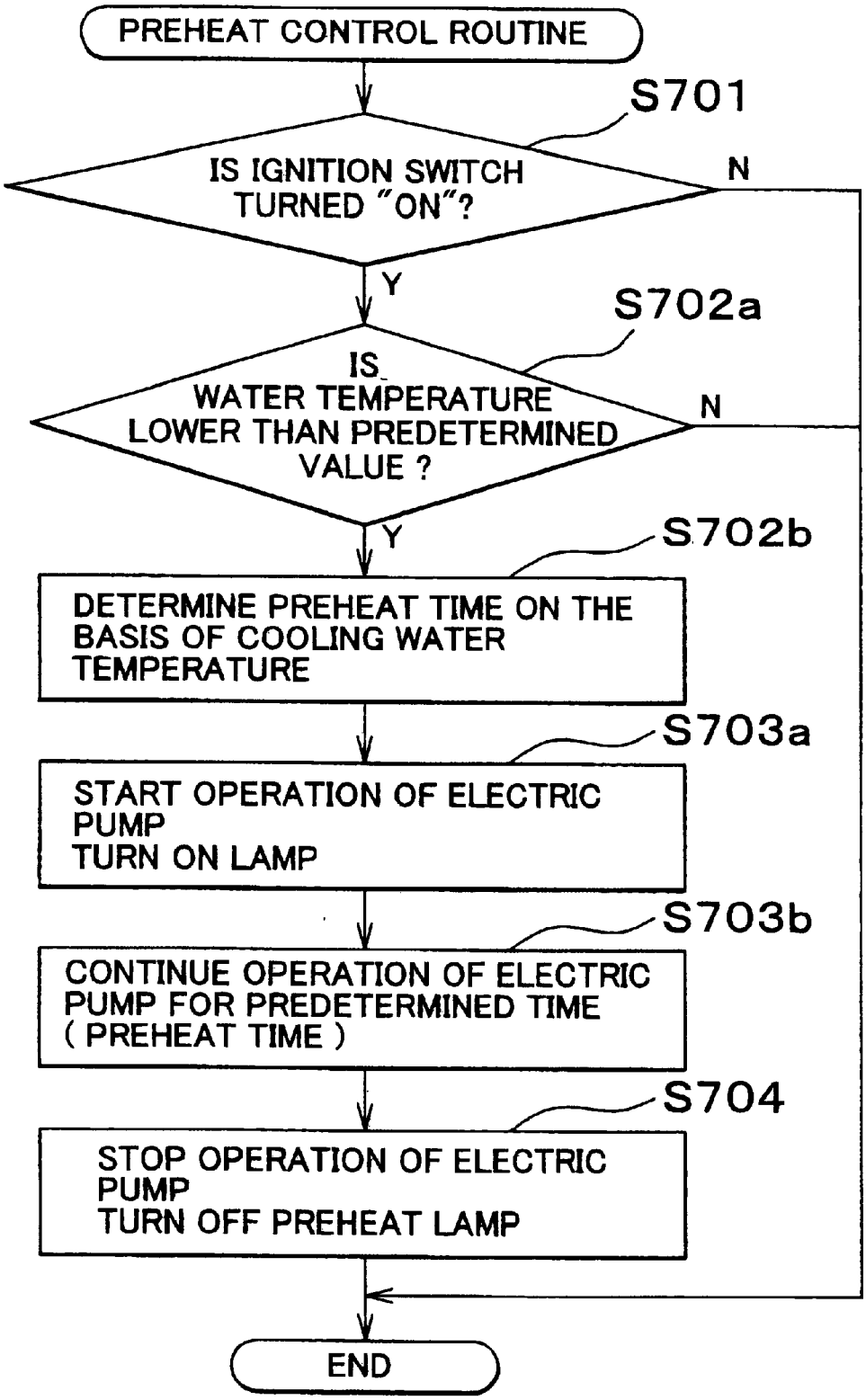
FIG. 16 is a flow chart showing a preheat control procedure according to a sixth embodiment of the invention.

FIG. 16 is a flow chart showing the process contents of a "preheat control routine" which the engine system 100 according to the present embodiment executes at every predetermined time while the engine 10 is stopping.

In the routine, in a series of steps S701 and S702*a*, the ECU 30 recognizes the preheat requirement and sets the condition in accordance with the same process procedure as that of a series of steps S101 and S102 in the "preheat control routine" (FIG. 6) according to the first embodiment.

After passing through the step S702*a*, in step 702*b*, the ECU 30 determines an executing time of the preheat (hereinafter, referred to as a preheat time) with reference to a map previously set on the basis of the current cooling water temperature THW. The preheat time corresponds to the operating time of the electric pump EP. That is, the longer the preheat time is set, the more the heat reserving hot water is circulated and supplied to the cylinder head 10*b* of the engine 10, whereby the temperature of the cylinder head 10*b* at a time when the preheat is completed is increased. In this case, a relation between the preheat time and the cooling water temperature THW on the map mentioned above is set on the basis of the data or the like previously determined by the experiment so that the warming-up of the engine 10 is substantially (or entirely) completed due to the completion of the preheat.

Figure 17:
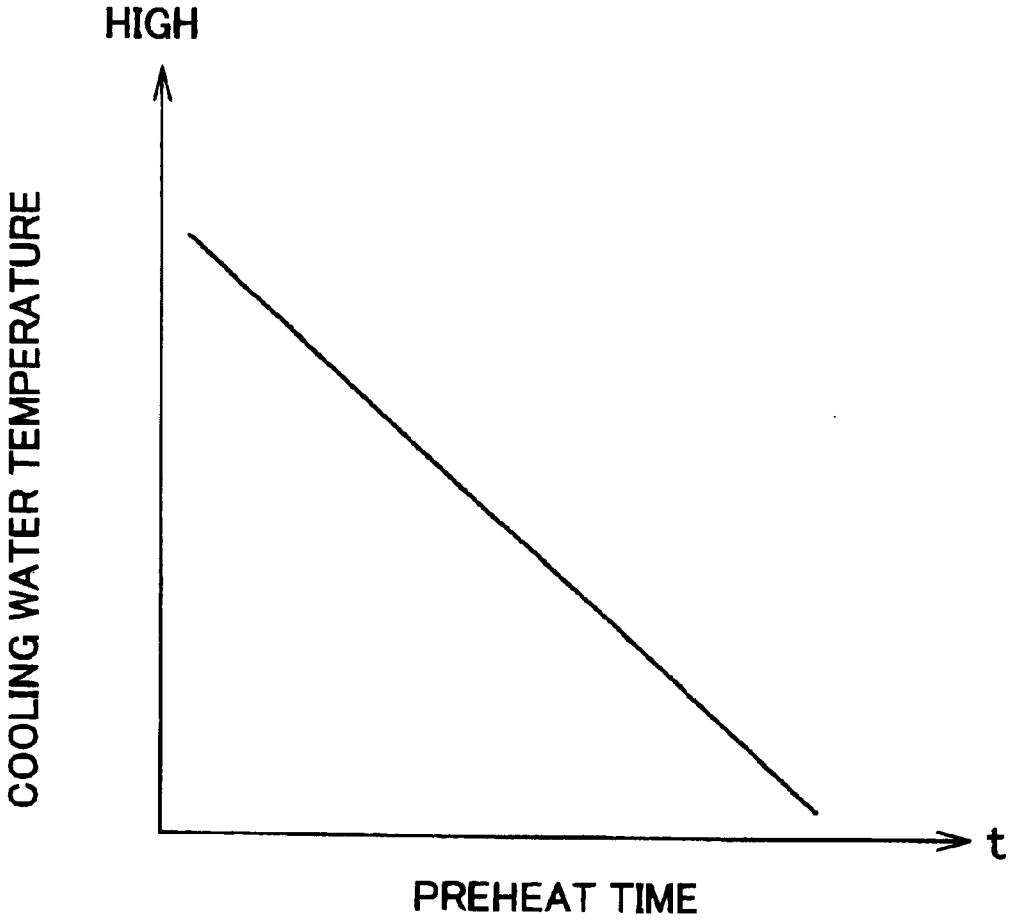
FIG. 17 is a graph showing a relation between a preheat time and a temperature of cooling water on a map applied in the sixth embodiment of the invention.

FIG. 17 is a graph schematically showing a relation between the preheat time and the cooling water temperature THW on a map applied in the step S702*b* mentioned above. As shown in FIG. 17, it is set so that the lower the cooling water temperature THW a becomes, the longer the preheat time becomes. In this case, any one of the engine inflow water temperature THWin and the engine outflow water temperature THWex may be applied as a representative value to the cooling water temperature THW, or an average value between both of THWin and THWex may be applied thereto.

In the following step S703*a*, the ECU 30 starts and continues the operation of the electric pump EP and the lighting operation of the preheat lamp 28.

When the preheat time has passed, the ECU 30 stops the electric pump EP and turns off the preheat lamp 28 (step S704), thereby temporarily finish the process in the present routine.

As mentioned above, according to the engine system 100 of the present embodiment, it becomes possible to always apply the necessary and sufficient preheat time for the engine 10 to get out of the cold state, by variably setting the preheat period on the basis of the cooling water temperature THW significantly correlating with a degree of a temperature increasing effect of the cylinder head obtained by the execution of the preheat.

Accordingly, at a time of starting the engine system 100, even in the case that the environment surrounding the engine system 100 and the temperature condition within the cooling system 20 are changed, it is possible to start the engine operation according to the timing being sufficiently higher than the temperature area that a trouble is generated with respect to the gasification of the supplied fuel. That is, it is possible to use the warming-up effect due to the preheat to the full.

(Seventh Embodiment)

Next, a description will be given of a seventh embodiment obtained by applying the internal combustion engine with the heat accumulating device to the engine system to be mounted on the vehicle, by mainly referring to different points from the first to sixth embodiments mentioned above.

In this case, in the seventh embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the seventh embodiment determines the preheat time on the basis of the heat accumulating hot water temperature.

Figure 18:
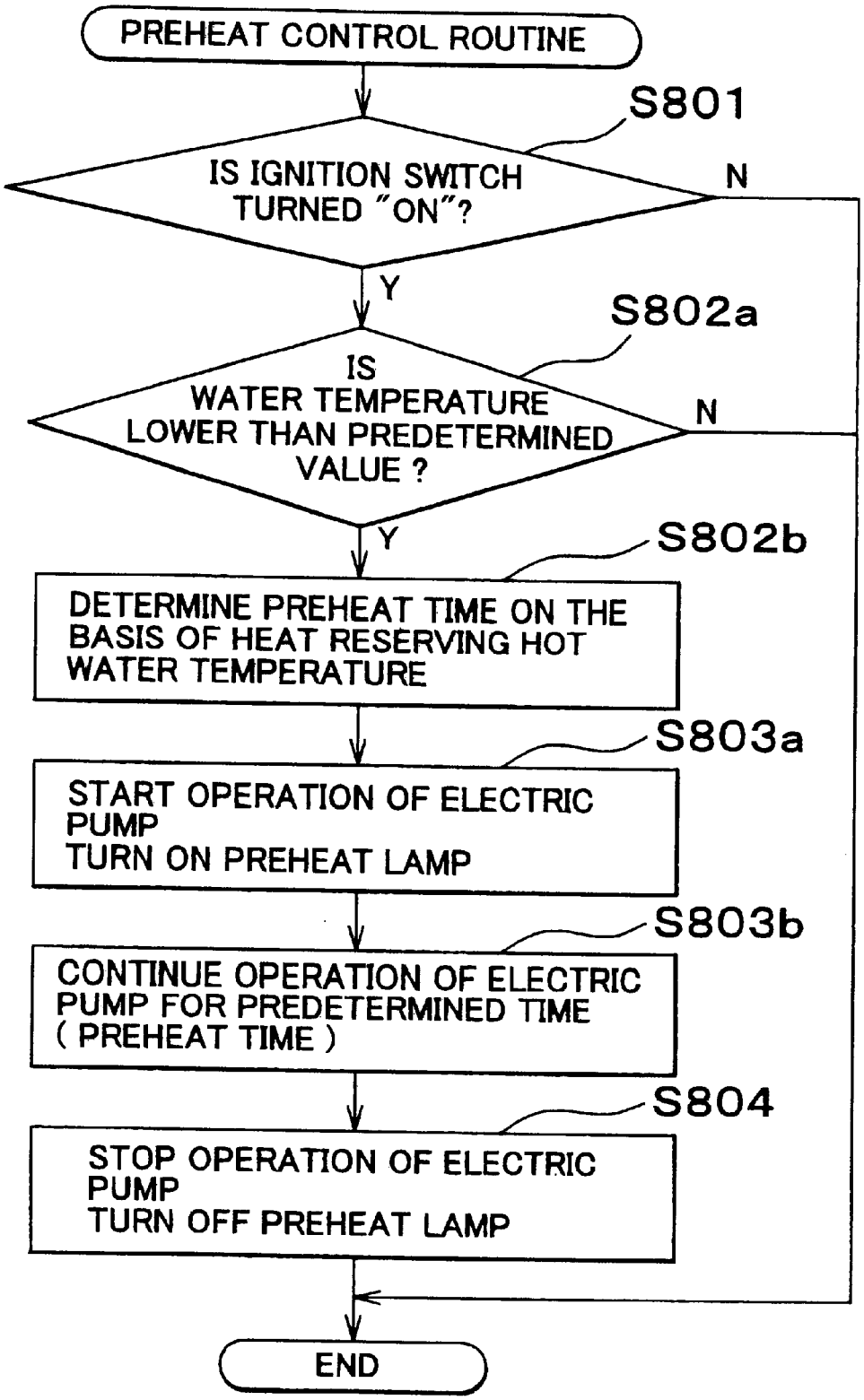
FIG. 18 is a flow chart showing a preheat control procedure according to a seventh embodiment of the invention.

FIG. 18 is a flow chart showing the process contents of a "preheat control routine" which the engine system 100 according to the present embodiment executes at every predetermined time while the engine 10 is stopping.

In the routine, in a series of steps S801 and S802*a*, the ECU 30 recognizes the preheat requirement and sets the condition in accordance with the same process procedure as that of a series of steps S101 and S102 in the "preheat control routine" (FIG. 6) according to the first embodiment.

After passing through the step S802*a*, in step 802*b*, the ECU 30 determines the preheat time with reference to a map previously set on the basis of the current heat reserving hot water temperature THWre. The preheat time corresponds to the operating time of the electric pump EP. That is, the longer the preheat time is set, the more the heat reserving hot water is circulated and supplied to the cylinder head 10*b* of the engine 10, whereby the temperature of the cylinder head 10*b* at a time when the preheat is completed is increased. In this case, a relation between the preheat time and the heat reserving hot water temperature THWre on the map mentioned above is set on the basis of the data or the like previously determined by the experiment so that the warming-up of the engine 10 is substantially (or entirely) completed due to the completion of the preheat.

Figure 19:
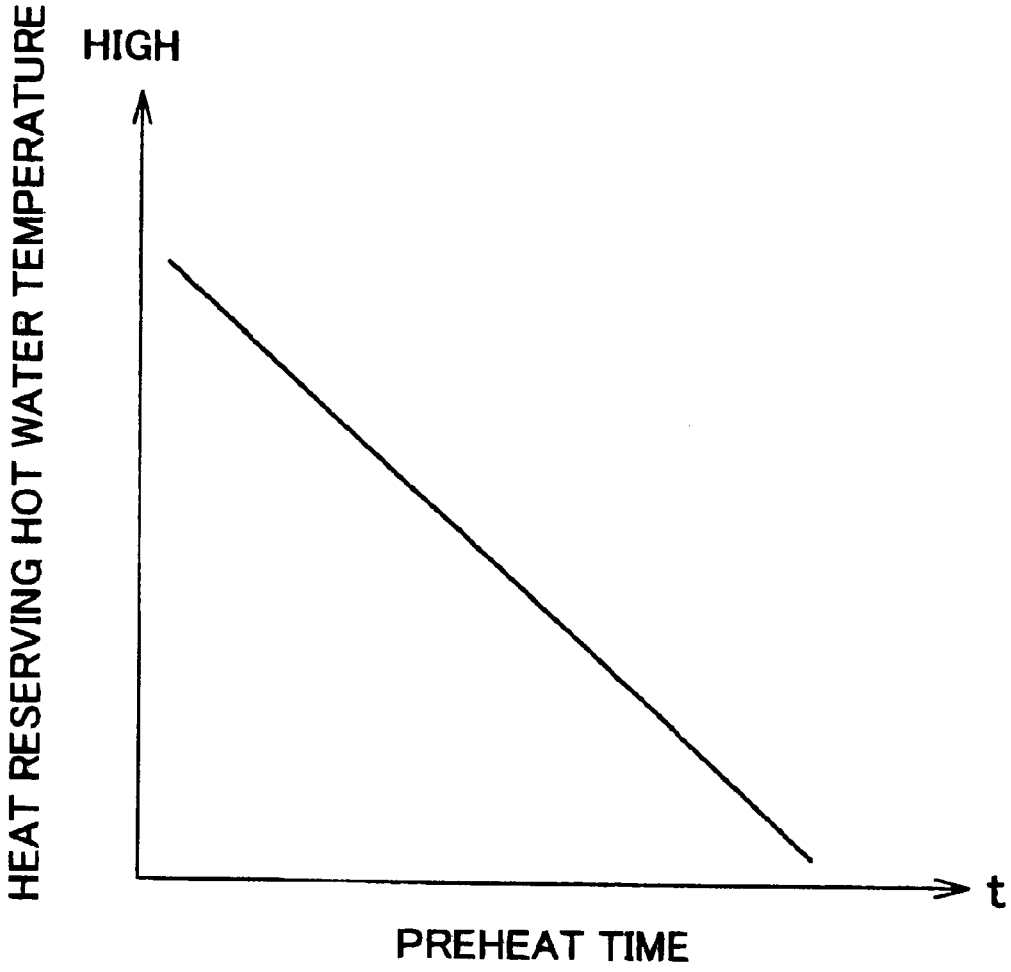
FIG. 19 is a graph showing a relation between a preheat time and a temperature of heat regenerated hot water on a map applied in the seventh embodiment.

FIG. 19 is a graph schematically showing a relation between the preheat time and the cooling water temperature THW on a map applied in the step S802*b* mentioned above. As shown in FIG. 19, it is set so that the lower the heat reserving hot water temperature THWew becomes, the longer the preheat time becomes.

In the following step S803*a*, the ECU 30 starts the operation of the electric pump EP and the lighting operation of the preheat lamp 28. In the following step S803*b* the ECU 30 continues the preheat time determined in the step S802*b*.

When the preheat time has passed, the ECU 30 stops the electric pump EP and turns off the preheat lamp 28 (step S804), thereby temporarily finish the process in the present routine.

As mentioned above, according to the engine system 100 of the present embodiment, it becomes possible to always apply the necessary and sufficient preheat time for the engine 10 to get out of the cold state, by variably setting the preheat period on the basis of the heat reserving hot water temperature THWre significantly correlating with a degree of a temperature increasing effect of the cylinder head obtained by the execution of the preheat.

Accordingly, at a time of starting the engine system 100, even in the case that the temperature condition within the heat accumulating device 21 are changed, it is possible to start the engine operation in conjunction with the timing being sufficiently higher than the temperature area that a trouble is generated with respect to the gasification of the supplied fuel. That is, it is possible to use the warming-up effect due to the preheat to the full.

(Eighth Embodiment)

Next, a description will be given of an eighth embodiment obtained by applying the internal combustion engine with the heat accumulating device to the engine system to be mounted on the vehicle, by mainly referring to different points from the first to seventh embodiments mentioned above.

In this case, in the eighth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the eighth embodiment determines the preheat time on the basis of a drive voltage for driving the electric pump EP, that is, a voltage of a battery (not shown) in accordance with a power supply source of the engine system 100 (a battery voltage).

Figure 20:
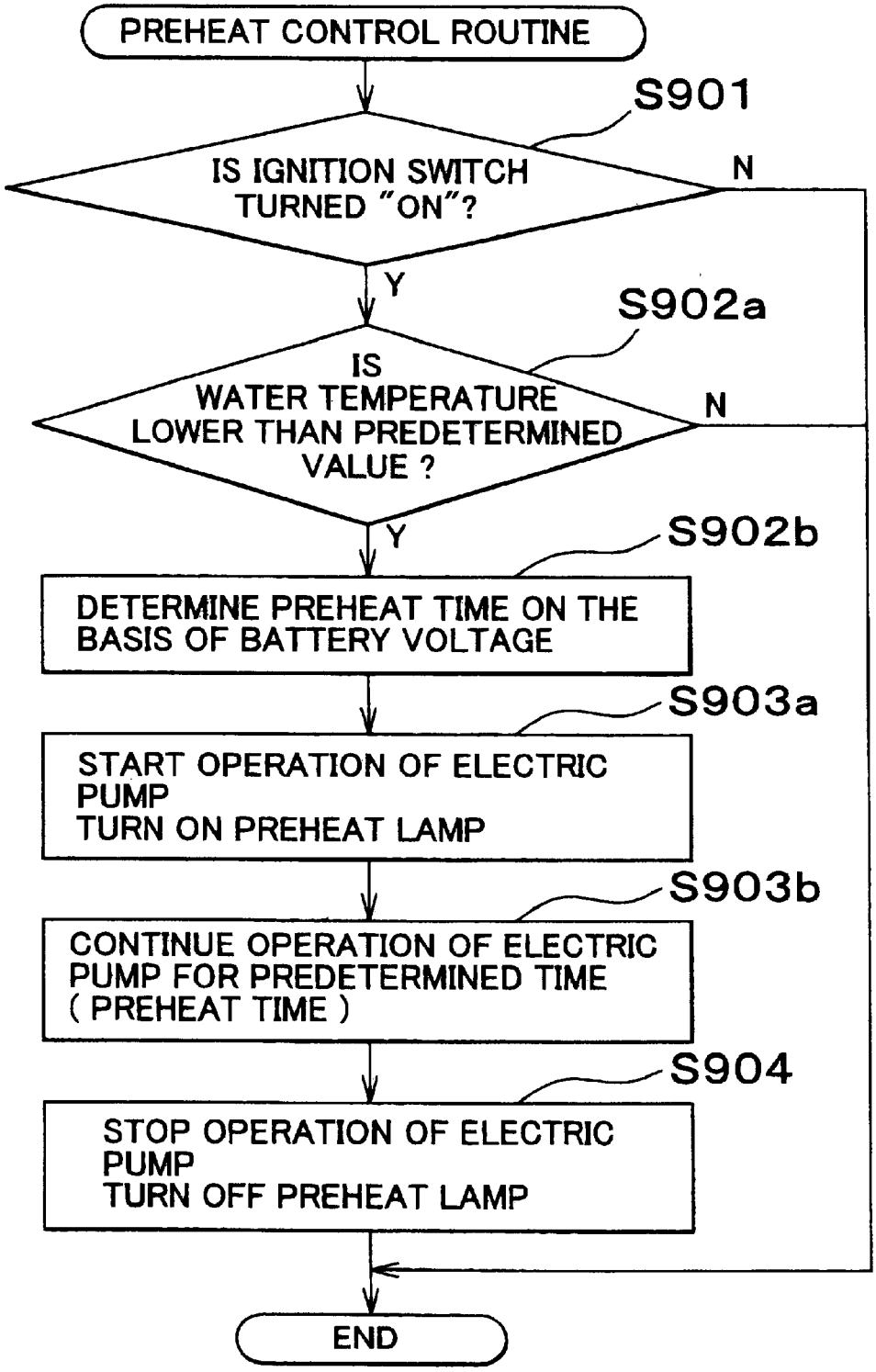
FIG. 20 is a flow chart showing a preheat control procedure according to an eighth embodiment of the invention.

FIG. 20 is a flow chart showing the process contents of a "preheat control routine" which the engine system 100 according to the present embodiment executes at every predetermined time while the engine 10 is stopping.

In the routine, in a series of steps S901 and S902*a*, the ECU 30 recognizes the preheat requirement and sets the condition in accordance with the same process procedure as that of a series of steps S101 and S102 in the "preheat control routine" (FIG. 6) according to the first embodiment.

After passing through the step S902*a*, in step 902*b*, the ECU 30 determines the preheat time with reference to a map (not shown) previously set on the basis of the current battery voltage. The preheat time corresponds to the operating time of the electric pump EP. That is, the longer the preheat time is set, the more the heat reserving hot water is circulated and supplied to the cylinder head 10*b* of the engine 10, whereby the temperature of the cylinder head 10*b* at a time when the preheat is completed is increased. Further, the lower the battery voltage at a time of starting the preheat becomes, the slower the flow velocity of the heat reserving hot water supplied (flown) to the engine 10 from the heat accumulating device due to the execution of the preheat becomes. Accordingly, the lower the battery voltage becomes, the longer the preheat time is set to be. In this case, a relation between the preheat time and the battery voltage on the map mentioned above is set on the basis of the data or the like previously determined by the experiment so that the warming-up of the engine 10 is substantially (or entirely) completed due to the completion of the preheat.

In the following step S903*a*, the ECU 30 starts the operation of the electric pump EP and the lighting operation of the preheat lamp 28, and in the step S902*b*, it continues the determined preheat time (step S903*b*).

When the preheat time has passed, the ECU 30 stops the electric pump EP and turns off the preheat lamp 28 (step S904), thereby temporarily finishing the process in the present routine.

As mentioned above, according to the engine system 100 of the present embodiment, it becomes possible to always apply the necessary and sufficient preheat time for the engine 10 to get out of the cold state, by variably setting the preheat period on the basis of the battery voltage significantly correlating with a flow amount (a flow velocity) of the heat reserving hot water flowing toward the cylinder head 10*b* from the heat accumulating device 21 at a time of executing the preheat.

Accordingly, at a time of starting the engine system 100, even in the case that the environment surrounding the engine system 100 and the temperature condition within the cooling system 20 are changed, it is possible to start the engine operation in conjunction with the timing being sufficiently higher than the temperature area that a trouble is generated with respect to the gasification of the supplied fuel. That is, it is possible to use the warming-up effect due to the preheat to the full.

(Ninth Embodiment)

Next, a description will be given of a ninth embodiment obtained by applying the internal combustion engine with the heat accumulating device to the engine system to be mounted on the vehicle, by mainly referring to different points from the first to eighth embodiments mentioned above.

In this case, in the ninth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the ninth embodiment provides the driver with information concerning the judgement with respect to "whether or not the preheat can be executed" or "whether or not the execution of the preheat is necessary", with reference to the state of the engine system 100 and the environment surrounding the system 100, prior to the start of the engine 10. Accordingly, the engine system 100 comprises a display device which is different from the preheat lamp 28 (see FIG. 8) employed in the first embodiment. The display device is provided in the indicator panel.

Figure 21:
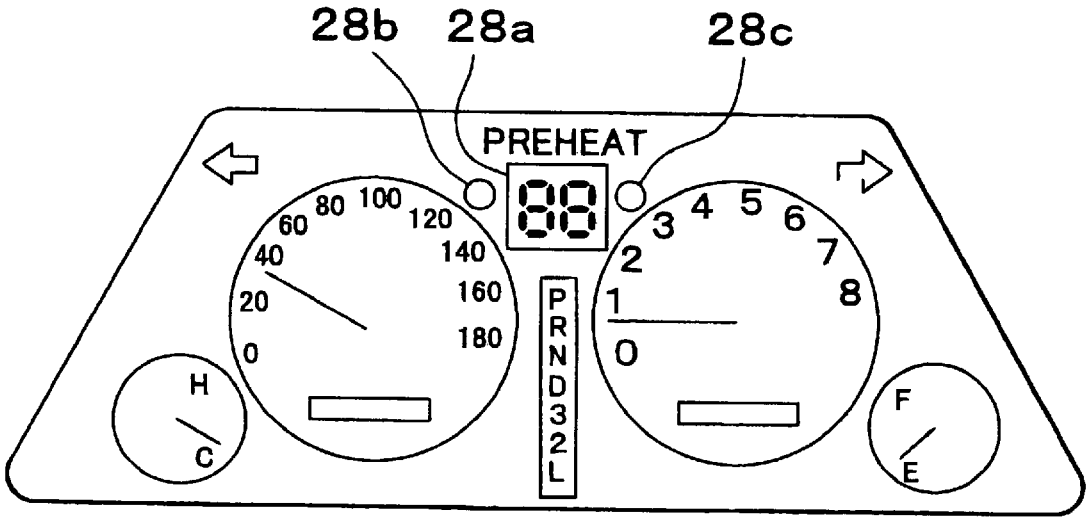
FIG. 21 is a plan view schematically showing an indicator panel comprised on the side of a driver's seat of a vehicle on which the engine system according to the eighth embodiment is mounted.
Figure 22:
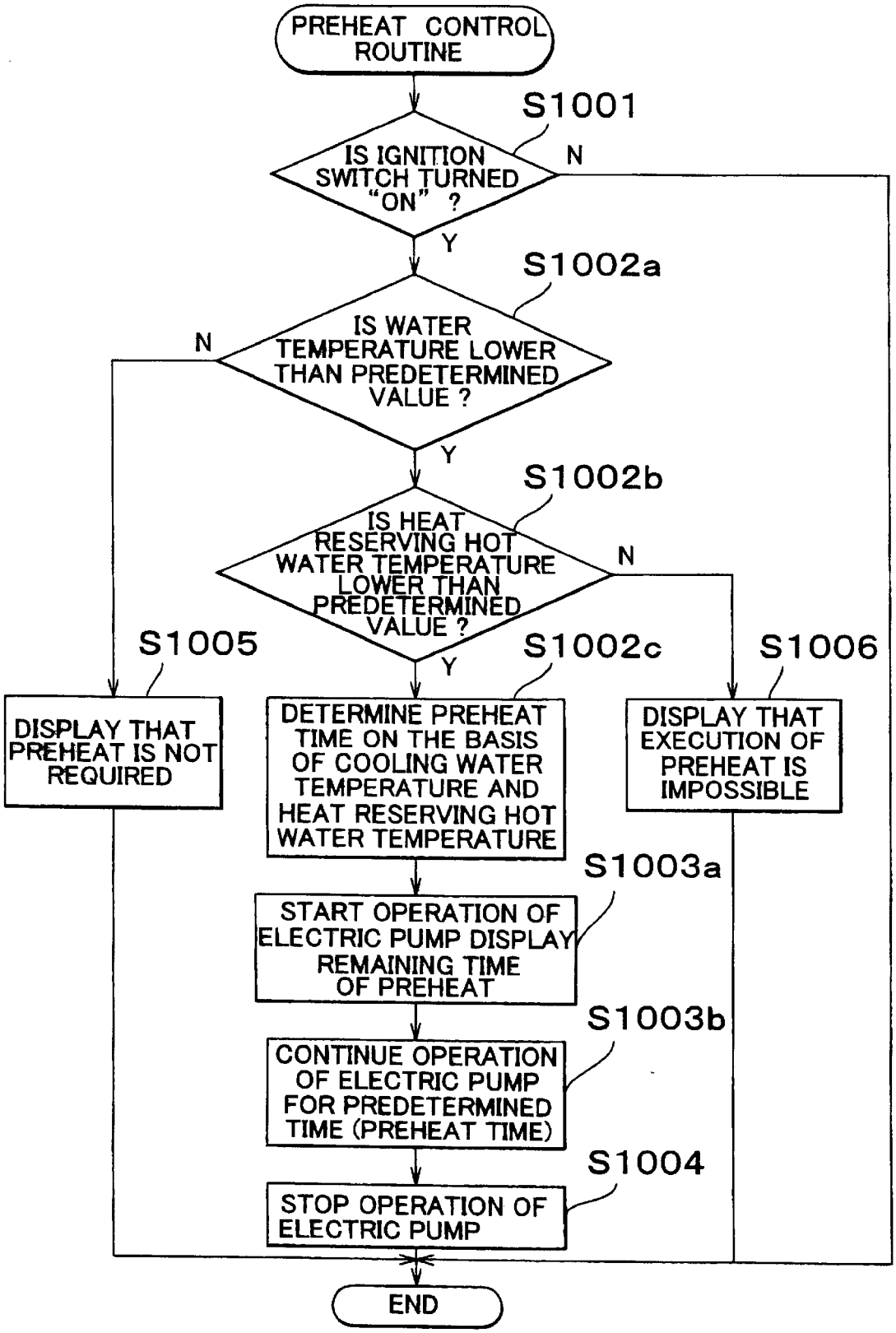
FIG. 22 is a flow chart showing a preheat control procedure according to a ninth embodiment of the invention.

FIG. 21 schematically shows the indicator panel provided in the driver's seat of the vehicle on which the engine system 100 according to the present embodiment is mounted. As shown in FIG. 22, the engine system 100 according to the present embodiment is provided with a display monitor 28*a* for displaying a number in accordance with the remaining time (second) until the preheat completion in response to the command signal output from the ECU 30, a preheat unnecessary display lamp 28*b* turning on in the case that the execution of the preheat is not required so as to display that, and a preheat impossible display lamp 28*c* turning on in the case that the execution of the preheat is impossible so as to display that, on the indicator panel.

FIG. 22 is a flow chart showing the process contents of a "preheat control routine" which the engine system 100 according to the present embodiment executes at every predetermined time while the engine 10 is stopping.

In the routine, in a series of steps S1001 and S1002*a*, the ECU 30 recognizes the preheat requirement and sets the condition in accordance with the same process procedure as that of a series of steps S101 and S102 in the "preheat control routine" (FIG. 6) according to the first embodiment.

In the case that the judgement in the step S1002*a* is negative, the ECU 30 judges that the engine 10 is not under the cold state, turns on the preheat unnecessary display lamp 28*b* (see FIG. 21) so as to inform the driver of the engine 10 of that the preheat is not necessary (step S1005), and finishes the process in the present routine.

In the case that the judgement in the step 1002*a* mentioned above is positive, in step S1002*b*, the ECU 30 judges whether or not the heat accumulating hot water temperature is lower than a predetermined value. In order to effectively increase the temperature of the cylinder head 10*b* by supplying the cooling water (the heat reserving hot water) stored in the heat accumulating device 21, it is preferable that the heat reserving hot water temperature THWre is equal to or higher than the predetermined value. Accordingly, in the case that the heat reserving hot water temperature THWre is lower than the predetermined value, the ECU 30 judges that the execution of the preheat is impossible and informs the driver of that.

That is, in the case that the judgement in the step S1002*b* is negative, the ECU 30 turns on the preheat impossible display lamp 28*c* (step S1006), and finishes the process in the present routine.

On the contrary, in the case that the judgement in the step S1002 is positive, the ECU 30 determines the preheat time in step S1002*c*.

The preheat time is determined by referring to a map (not shown) previously set on the basis of the current cooling water temperature THW and the heat reserving hot water temperature THWre. The preheat time corresponds to the operating time of the electric pump EP. The lower the cooling water temperature THW at a time of starting the preheat is, the longer the preheat time is set. Further, the lower the heat reserving hot water temperature THWre at a time of starting the preheat is, the longer the preheat time is set. In this case, as the cooling water temperature THW, any one of the engine inflow water temperature THWin and the engine outflow water temperature THWex may be employed as a representative value. Further, a relation among the preheat time, the cooling water temperature THW and the heat reserving hot water temperature THWre on the map mentioned above is set on the basis of the data or the like previously determined by the experiment so that the warming-up of the engine 10 is substantially (or entirely) completed due to the completion of the preheat.

In the following step S1003*a*, the ECU 30 continues the preheat (the operation of the electric pump EP) for a predetermined time (for example, 5 seconds) and also subsequently displays the remaining time until the preheat completion on the display monitor 28*a*.

When the preheat is completed, the operation of the electric pump EP is stopped in step S1004, a particular number (for example, "00") is displayed on the display monitor 28*a*, and the incidence that the preheat is completed is notified to the driver by flashing on and off the displayed number or the like.

After passing through the step S1004, the ECU 30 finishes the process in the present routine.

As mentioned above, according to the engine system 100 of the present embodiment, prior to the start of the engine 10, it is possible to inform the driver of the engine 10 of the information concerning the judgement with respect to whether or not the preheat is necessary. Accordingly, in the case that the ECU 30 judges that the execution of the preheat is not required, for example, so as to allow the engine 10 to start immediately after the door of the driver's seat is opened, the driver can know that the execution of the preheat is not required. That is, with respect to the incidence that the preheat is not executed before the engine 10 is started, for example, the driver does not have any doubt that any trouble is generated in the engine system 100. Accordingly, a comfortable start operability of the engine 10 for the driver can be obtained.

Further, according to the engine system 100 of the present embodiment, it is possible to inform the driver of the engine 10 of the information concerning the judgement with respect to whether or not the preheat can be executed with reference to the state of the engine system 100 and the environment surrounding the engine system 100. Accordingly, in the case that the preheat can not be executed due to some reasons, the driver can quickly start the engine in a state of knowing the information. Therefore, even when the engine 10 is started according to the different procedure from the normal procedure (the procedure of starting the engine after the preheat is completed), it is possible for the driver to execute the start operation without feeling a sense of discomfort.

Further, for example, in the case that any abnormality is generated in the cooling system 20 of the engine system 100 and the cooling water having a sufficiently high temperature can not be stored in the heat accumulating device 21, the driver of the engine system 100 can early recognize that and easily give a suitable response.

Further, in the engine system 100 according to the present embodiment, both of the cooling water temperature THW and the heat reserving hot water temperature THWre are referred to at a time of determining the preheat time. Both of the cooling water temperature THW at a time of starting the preheat and the heat reserving hot water temperature THWre at a time of starting the preheat correspond to parameters which significantly correlate with the degree of the temperature increasing effect of the cylinder head obtained by the execution of the preheat, and independently change with giving no influence to each other. That is, according to the present embodiment, it is possible to calculate the preheat time necessary and sufficient for the engine 10 to get out of the cold state, at a further high accuracy. That is, it is possible to more effectively make good use of the warming-up effect due to the preheat.

(Tenth Embodiment)

Next, a description will be given of a tenth embodiment obtained by applying the internal combustion engine with the heat accumulating device to the engine system to be mounted on the vehicle, by mainly referring to different points from the first to ninth embodiments mentioned above.

In this case, in the tenth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

Figure 23:
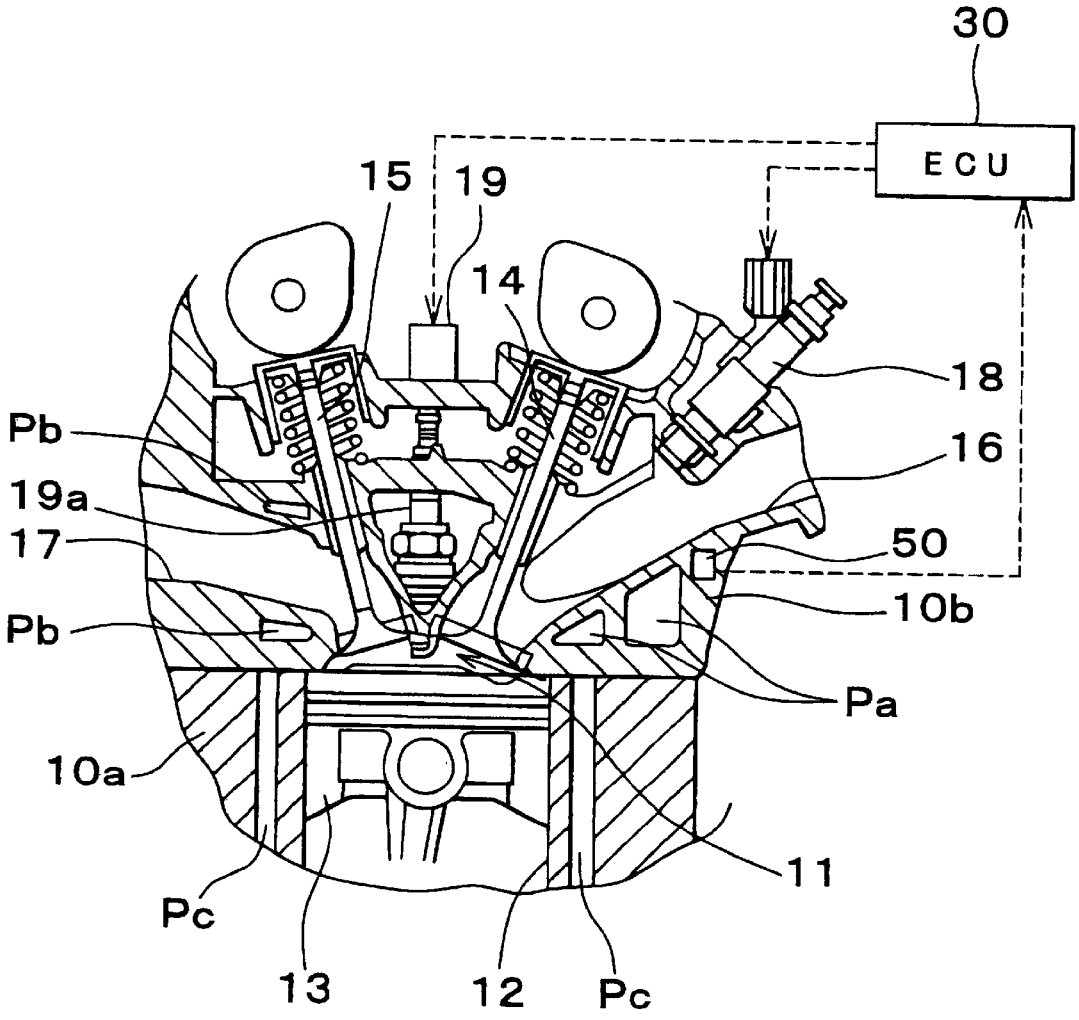
FIG. 23 is a schematic view showing a cross sectional structure in the periphery of a combustion chamber in a partly enlarged manner, with respect to an engine according to a tenth embodiment of the invention.

The engine system 100 according to the tenth embodiment determines the preheat time on the basis of a temperature of an inner wall of the intake port 16 provided within the cylinder head 10*b*. Accordingly, the engine system 100 includes an intake port wall temperature sensor 50 which is embedded in the inner wall of any one of the intake ports 16 of the engine 10 or protruded therefrom. The intake port wall temperature sensor 50 outputs to the ECU 30 the detected signal in response to the temperature near the wall surface of the inner wall of the intake port 16 (hereinafter, referred to as an intake port wall temperature) (see FIG. 23). In the present embodiment, the intake port wall temperature sensor 50 is arranged near an intake port side cooling water passage Pa, however, may be arranged in the fuel injection valve 18.

Figure 24:
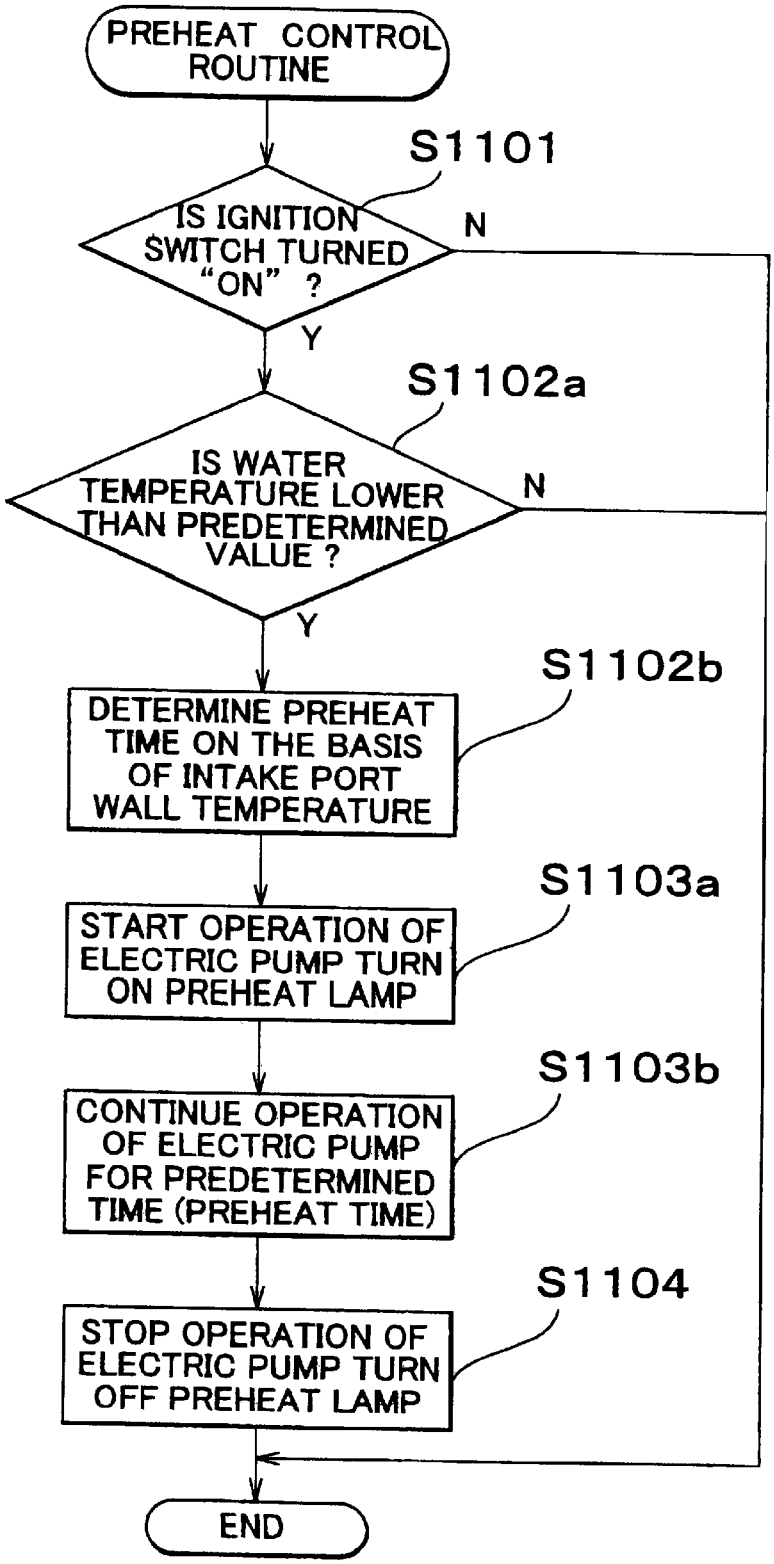
FIG. 24 is a flow chart showing a preheat control procedure according to the tenth embodiment.

FIG. 24 is a flow chart showing the process contents of a "preheat control routine" which the engine system 100 according to the present embodiment executes at every predetermined time while the engine 10 is stopping.

In the routine, in a series of steps S1101 and S1102*a*, the ECU 30 recognizes the preheat requirement and sets the condition in accordance with the same process procedure as that of a series of steps S101 and S102 in the "preheat control routine" (FIG. 6) according to the first embodiment.

In step S1102*b* following the step S1102*a* mentioned above, the preheat time is determined on the basis of the intake port wall temperature of the engine 10. The preheat time corresponds to the operating time of the electric pump EP. That is, the longer the preheat time is set, the more the heat reserving hot water is circulated and supplied to the cylinder head 10*b* of the engine 10, whereby the temperature of the cylinder head 10*b* at a time when the preheat is completed is increased. Then, the lower the intake port wall temperature at a time of starting the preheat is, the longer the preheat time is set. In this case, a relation between the preheat time and the intake port wall temperature is set with reference to the data or the like previously determined by the experiment so that the warming-up of the engine 10 is substantially (or entirely) completed due to the completion of the preheat.

In the following step S1103*a*, the ECU 30 starts the operation of the electric pump EP and the lighting operation of the preheat lamp 28, and continues for the time determined in the step S1102*b* mentioned above (the preheat time) (step S1103*b*).

When the preheat time has passed, the ECU 30 stops the electric pump EP and turns off the preheat lamp 28 (step S1104), thereby temporarily finishing the process in the present routine.

As mentioned above, according to the engine system 100 of the present embodiment, it becomes possible to always apply the necessary and sufficient preheat time for the engine 10 to get out of the cold state, by variably setting the preheat period on the basis of the intake port wall temperature significantly correlating with a degree of the temperature increasing effect of the cylinder head obtained by executing the preheat.

Accordingly, at a time of starting the engine system 100, even in the case that the environment surrounding the engine system 100 and the temperature condition within the cooling system 20 are changed, it is possible to start the engine operation in conjunction with the timing being sufficiently higher than the temperature area that a trouble is generated with respect to the gasification of the supplied fuel. That is, it is possible to use the warming-up effect due to the preheat to the full.

In this case, at a time of starting the engine 10, the injection amount of the fuel (the fuel injection amount) or the like supplied to the engine 10 through the fuel injection valve 18 may be corrected on the basis of the intake port wall temperature mentioned above.

Figure 25:
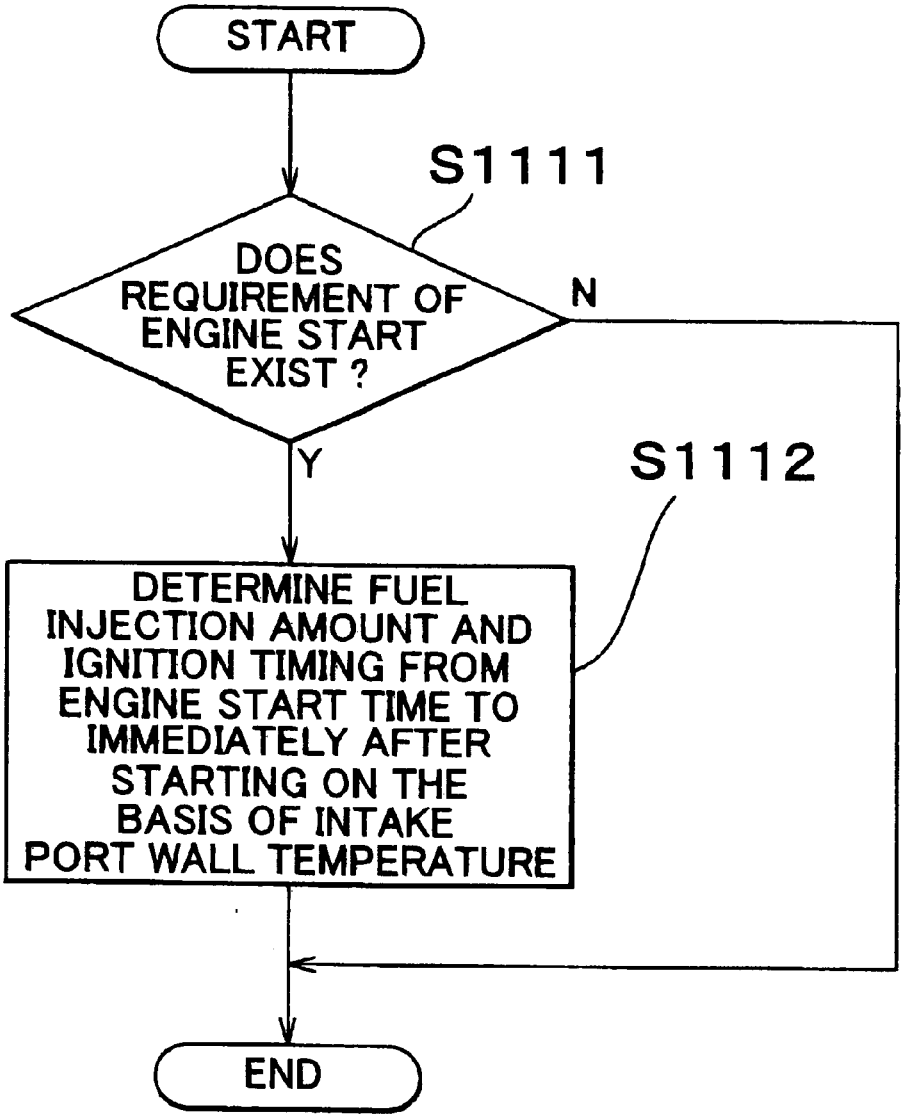
FIG. 25 is a flow chart showing a start procedure of the engine according to the tenth embodiment.

FIG. 25 is a process routine which the ECU 30 executes for starting the engine 10. The routine is executed at every predetermined time while the engine 10 is stopping. That is, in the routine, the ECU 30 periodically judges whether or not there exists the requirement for starting the engine 10 (of the engine start), for example, on the basis of the intention of the driver (step S1111). If the judgement is positive, the ECU 30 drives the starter 26 so as to start the engine 10, and corrects the fuel injection amount and the ignition timing on the basis of the timely intake port wall temperature, for a predetermined period (about some seconds) after the start of the engine.

After the preheat is completed, an average temperature of the cylinder head 10*b* exceeds a predetermined value, however, it is not possible to secure that a local temperature of the inner wall of the intake port 16 also reaches a temperature adequate for atomizing the fuel used for combustion.

As mentioned above, if the correction of the fuel injection amount and the ignition timing on the basis of the intake port wall temperature is executed from the starting time of the engine 10 to the time immediately after starting, together with the "preheat control routine" according to the present embodiment, the exhaust characteristics can be improved even at an extremely short time from the starting time of the engine 10 to the time immediately after starting, in other words, even in a period until the combustion state of the engine 10 becomes stable, so that an effect in connection with the improvement of the exhaust characteristics due to the execution of the preheat can be further increased.

(Eleventh Embodiment)

Next, a description will be given of an eleventh embodiment obtained by applying the internal combustion engine with the heat accumulating device to the engine system to be mounted on the vehicle, by mainly referring to different points from the first to tenth embodiments mentioned above.

In this case, in the eleventh embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the eleventh embodiment determines the finish timing of the preheat time on the basis of an amount of increase of the engine outflow water temperature THWex due to the execution of the preheat.

Figure 26:
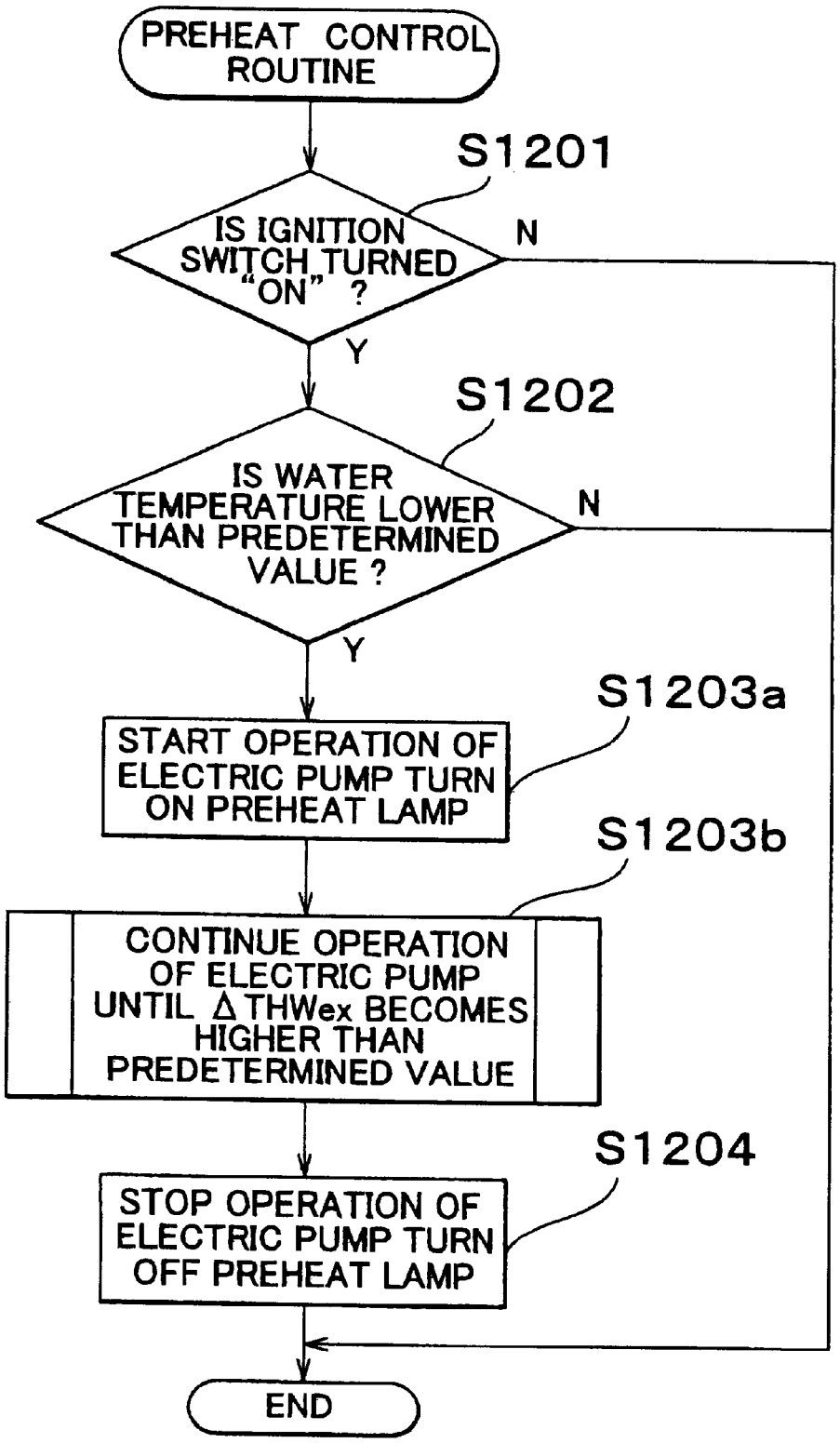
FIG. 26 is a flow chart showing a preheat control procedure according to an eleventh embodiment of the invention.

FIG. 26 is a flow chart showing the process contents of a "preheat control routine" which the engine system 100 according to the present embodiment executes at every predetermined time while the engine 10 is stopping.

In the routine, in a series of steps S1201 and S1202, the ECU 30 recognizes the preheat requirement and sets the condition in accordance with the same process procedure as that of a series of steps S101 and S102 in the "preheat control routine" (FIG. 6) according to the first embodiment.

After passing through the step S1202, the ECU 30 starts the operation of the electric pump EP and the lighting operation of the preheat lamp 28 (step S1203*a*).

During the operation of the electric pump EP (during the executing period of the preheat), the ECU 30 observes the engine outflow water temperature THWex (step S1203*b*), stops the electric pump EP at a time when a value (hereinafter, referred to as an outflow water temperature increasing amount) ΔTHWex obtained by reducing an initial value THWex0 of the engine outflow water temperature THWex (hereinafter, referred to as an initial water temperature) observed at a time of starting the operation of the electric pump EP (starting the preheat) from the observed engine outflow water temperature THWex becomes higher than a predetermined value, and then turns off the preheat lamp 28 (step S1204), thereby temporarily finishing the process in the present routine.

Figure 27:
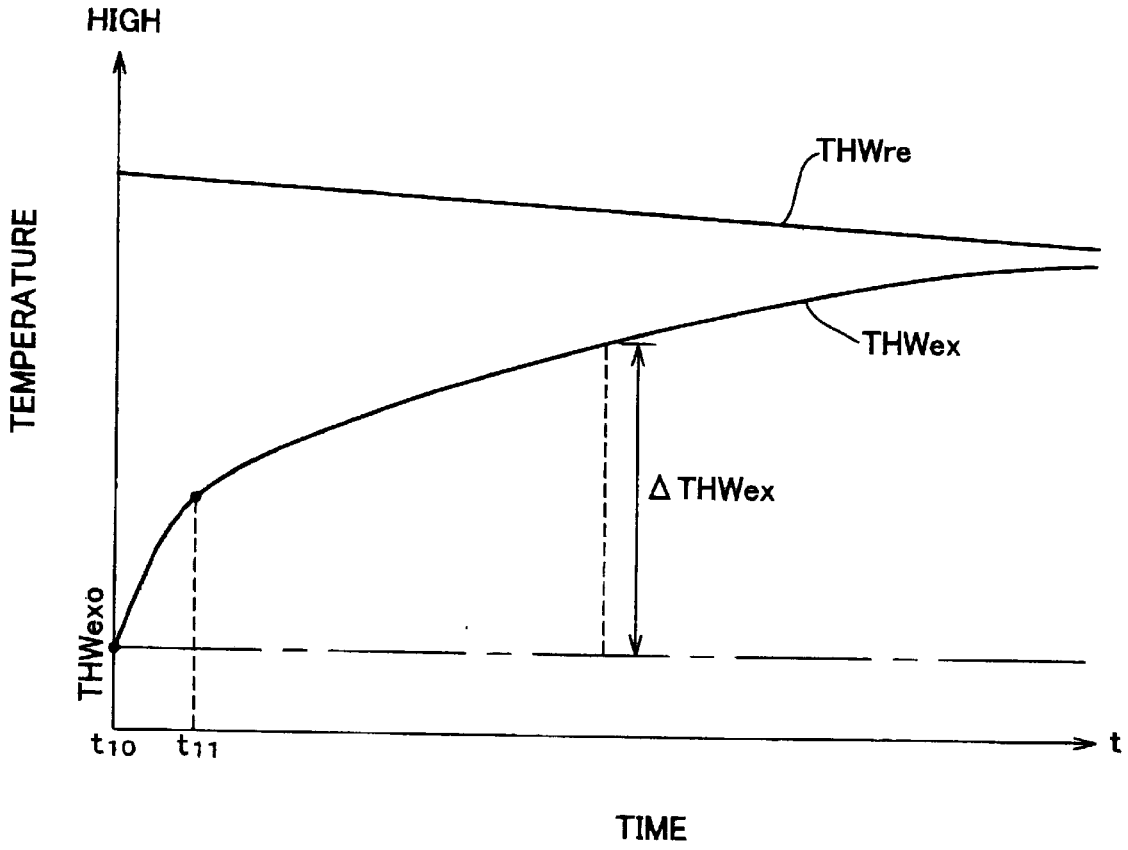
FIG. 27 is a time chart showing one example of a transition pattern of heat regenerated hot water and engine outflow water observed after starting the preheat.

FIG. 27 is a time chart showing one example of a transition pattern of the heat reserving hot water temperature THWre and the engine outflow water temperature THWex observed after starting the preheat. Further, a time t10 indicated on a time axis (a horizontal axis) corresponds to a preheat starting time (a time for starting the operation of the electric pump EP).

As shown in FIG. 27, when the preheat is started, the heat reserving hot water stored in the heat accumulating device 21 flows into the cylinder head 10*b* through the engine side passage B2 and thereafter reaches the water temperature sensor 25*a* through the cylinder head 10*b* (also see FIG. 1). Accordingly, after starting the preheat, an output signal of the water temperature sensor 25*a* in accordance with the engine outflow water temperature THWex is quickly increased (a time t11). On the contrary, when the heat reserving hot water passes through the cylinder head 10*b*, a heat exchange is performed between the heat reserving hot water and the cylinder head 10*b*, and a part of the heat reserving hot water is mixed with the cooling water stored within the cylinder head 10*b*. As a result, even if the heat reserving hot water passing through the cylinder head 10*b* reaches the water temperature sensor 25*a*, the engine outflow water temperature THWex becomes lower than the heat reserving hot water temperature THWre. However, since a heat radiation amount of the heat reserving hot water is reduced as the temperature of the cylinder head 10*b* is increased thereafter, the engine outflow water temperature THWex is gradually increased.

In this case, the transition pattern of the engine outflow water temperature THWex is quantitatively reflected by the heat radiation amount of the heat reserving hot water within the cylinder head 10*b* during the execution of the preheat, in other words, a heat absorbing amount of the cylinder head 10*b*. Actually, it is confirmed by the inventors that the engine outflow water temperature THWex observed during the execution of the preheat has a high correlation with the temperature of the cylinder head 10*b*.

Accordingly, in the engine system 100 according to the present embodiment, there is employed a control configuration of estimating that, when the outflow water temperature increasing amount ΔTHWex in accordance with the difference between the engine outflow water temperature THWex observed during the execution of the preheat and the initial value THWex0 becomes higher than the predetermined value, the temperature of the cylinder head 10*b* reaches a sufficiently high temperature so as to finish the preheat and allow the engine 10 to start.

As mentioned above, according to the engine system 100 of the present embodiment, it becomes possible to always apply the necessary and sufficient preheat time for the engine 10 to get out of the cold state, by determining the preheat period on the basis of the outflow water temperature increasing amount ΔTHWex significantly correlating with the temperature of the cylinder head 10*b* increasing due to the execution of the preheat.

Accordingly, at a time of starting the engine system 100, even in the case that the environment surrounding the engine system 100 and the temperature condition within the cooling system 20 are changed, it is possible to start the engine operation in conjunction with the timing being sufficiently higher than the temperature area that a trouble is generated with respect to the gasification of the supplied fuel. That is, it is possible to use the warming-up effect due to the preheat to the full.

(Twelfth Embodiment)

Next, a description will be given of a twelfth embodiment obtained by applying the internal combustion engine with the heat accumulating device to the engine system to be mounted on the vehicle, by mainly referring to different points from the first to eleventh embodiments mentioned above.

In this case, in the twelfth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

Figure 28:
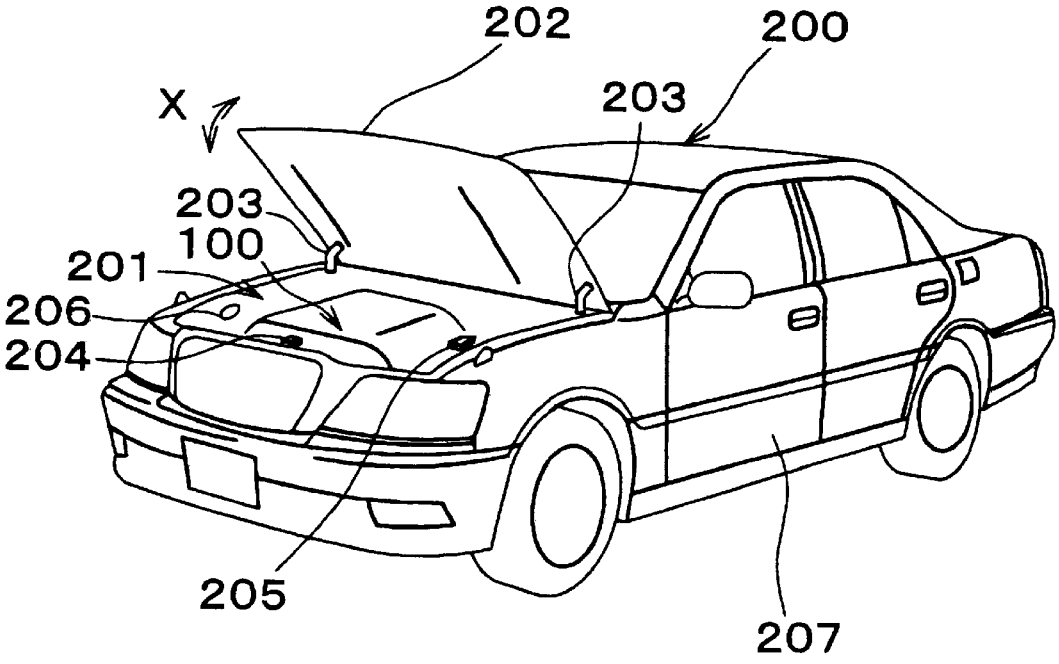
FIG. 28 is a perspective view schematically showing an outer appearance of a vehicle on which an engine system according to a twelfth embodiment of the invention is mounted.

FIG. 28 is a perspective view schematically showing an outer appearance of a vehicle on which the engine system 100 according to the invention is mounted. A vehicle 200 corresponds to a passenger vehicle of a front wheel drive type, and is provided with an engine room 201 for receiving the engine 10 in a front portion of the vehicle. A hood 202 constituting a part of an armor of the vehicle 100 is a sheet-like member, is supported by a pair of hood hinges 203, and can be freely opened and closed along an X direction. The hood 202 is opened, whereby the engine room 201 and the engine 10 received therewithin are exposed to the outside. The vehicle 200 in FIG. 28 is under a state that the hood 202 is opened. A hood opening and closing detecting sensor (constituting open state recognizing means) 204 is electrically connected to the ECU 30 (see FIG. 1) and outputs a predetermined detecting signal in the case that the hood 202 is opened, thereby making the ECU 30 recognize whether the hood 202 is under the open state or the closed state. An emergency start switch (constituting the inhibiting operation portion) 205 provided within the engine room 201 automatically starts the engine 10 on the basis of a manual operation. Further, a buzzer 206 provided within the engine room 201 generates an alarm sound in accordance with the command signal of the ECU 30.

Further, a sensor (not shown) detecting the opening and closing of the door is attached to a door 207 or a peripheral portion thereof.

Figure 29:
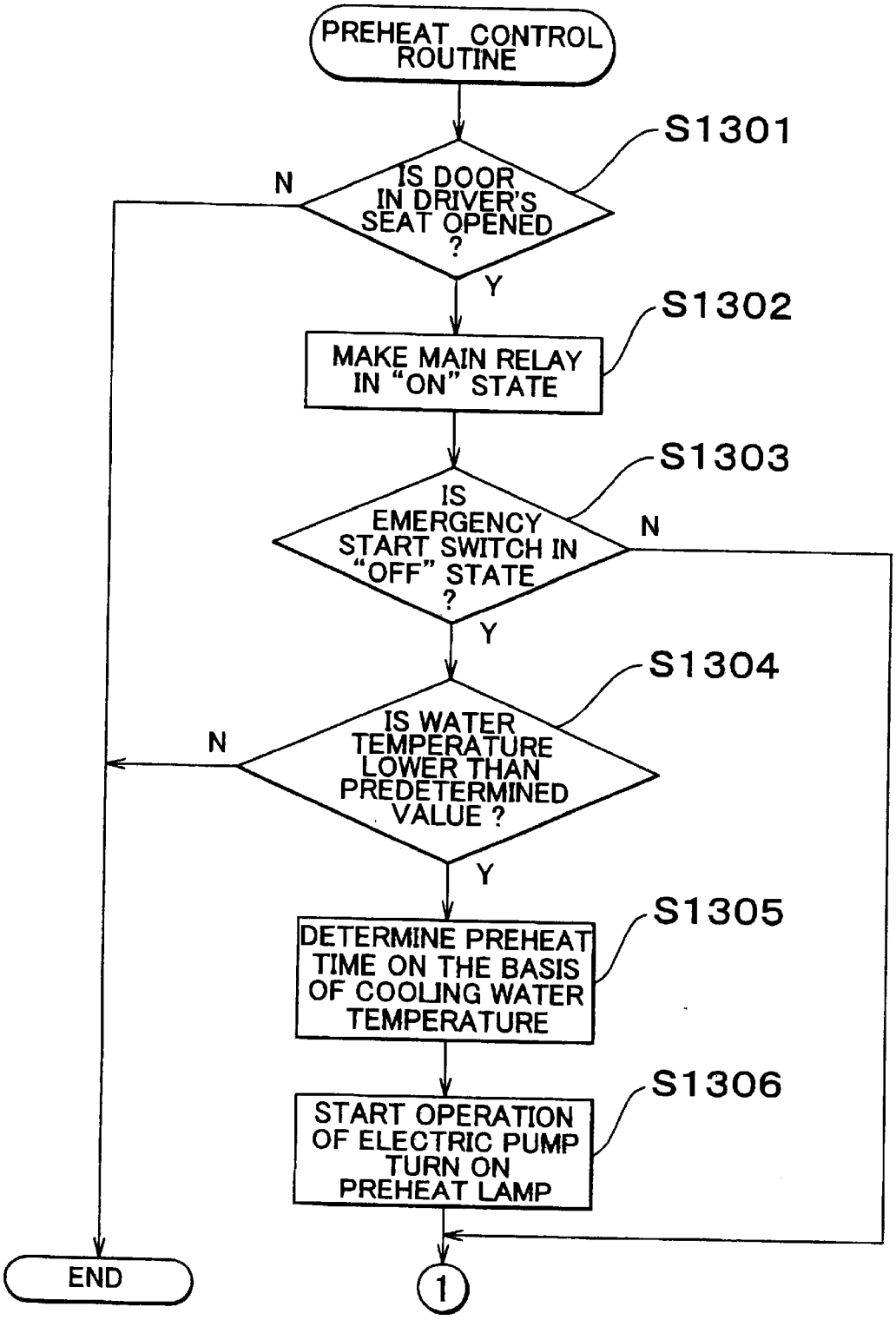
FIG. 29 is a flow chart showing a preheat control procedure according to the twelfth embodiment.
Figure 30:
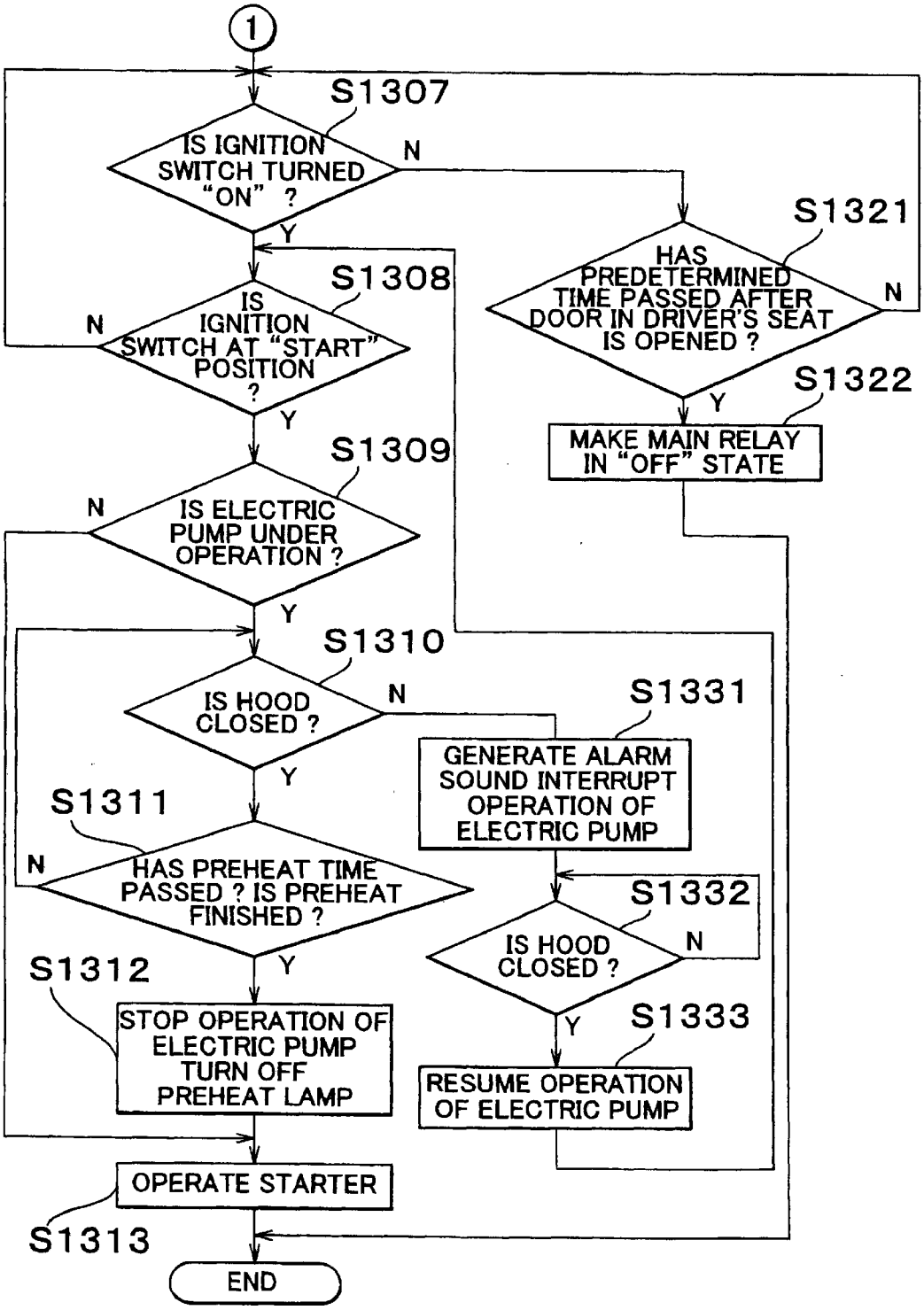
FIG. 30 is a flow chart showing the preheat control procedure according to the twelfth embodiment.

FIGS. 29 and 30 are flow charts showing the process contents of a "preheat control routine" which the engine system 100 according to the present embodiment executes at every predetermined time while the engine 10 is stopping.

In the present routine, in a series of steps S1301 to S1306, the ECU 30 recognizes the trigger for starting the preheat and judges whether or not the preheat is executed.

That is, when this routine is executed, the ECU 30 at first expects in step S1301 (FIG. 29) that the driver will intend to start the engine 10 in the case that the opening of the door 207 on the side of driver's seat in the vehicle 200 is recognized. That is, step S1302 is executed so as to switch a main relay supplying a power to a circuit for driving various kinds of actuators necessary for executing the preheat and starting the engine 10, from an "OFF" state to an "ON" state. The actuators includes such as the electric pump EP, the starter 26, the fuel injection valve 18, the igniter 19 and the like. On the contrary, in the case that the door on the side of driver's seat of the vehicle is not recognized to be opened in the step S1301, the present routine ends.

After finishing the process in the step S1302, the ECU 30 confirms that the emergency start switch 205 is under the "OFF" state (step S1303) and the cooling water temperature THW is lower than the predetermined value (step S1304), and thereafter, executes the preheat according to the procedure following step S1305.

On the contrary, in the case that the ECU 30 judges in the step S1303 that the emergency start switch 205 is under the "ON" state, the ECU 30 jumps the process to steps S1307 and allows the engine 10 to start without executing the preheat. The procedure for allowing the engine 10 to start without executing the preheat will be described later. Further, in the case that it is confirmed in the step S1304 that the cooling water temperature is equal to or higher than a predetermined value, the ECU 30 judges that the preheat is not required to be executed since the temperature of the engine 10 is sufficiently high, and temporarily ends the present routine.

In the step S1305, the preheat time is determined on the basis of the cooling water temperature THW.

In step S1306, the operation of the electric pump EP is started and the preheat lamp 28 (refer to both of FIGS. 1 and 8) is turned on.

Following a series of processes in the steps S1301 to S1306 mentioned above, in a series of processes in step S1307 to S1313 (FIG. 30), the execution of the preheat is continued and the engine 10 is started after the execution is completed. On the contrary, in the case that a predetermined condition is established at a time of starting the preheat or during the executing period, the preheat is abandoned (steps S1321 and S1322) or interrupted and subsequently resumed (steps S1331 to S1333).

At first, it is judged in the step S1307 (FIG. 30) whether or not the position of the ignition key 27*a* (the ignition switch) inserted to the key cylinder 27 (see both FIGS. 1 and 7) is switched to the "ON". Further, when the judgement is positive, and step S1308 is executed, and when the judgement is negative, and step S1321 is executed.

In the step S1308, it is judged whether or not the ignition switch is switched to the "START" (see FIG. 7). Further, when the judgement is positive, step S1309 is executed, and when the judgement is negative, the process is returned to the step S1307.

On the contrary, in the case that the judgement in the step S1307 is negative, it is judged whether or not the door on the side of the driver's seat is in the opened state and the predetermined time has passed (step S1321), so that in the case that the judgement is negative, the process is returned to the step S1307, and in the case that the judgement is positive, the main relay is set to be under the "OFF" state, and the ECU 30 ends the present routine (step S1322).

In the case that the judgement in the step S1308 mentioned above is positive, it is judged whether or not the electric pump EP is currently under operation (step S1309). The negative judgement means the emergency start switch 205 is under the "ON" state, or the electric pump EP is not operated due to some reasons in spite that the engine 10 is under a state the preheat should be executed, in the case of judging with reference to the cooling water temperature THW (S1304). Further, as is apparent from the judgement in the step S1308, the ignition switch at this time is at the "START" position. Accordingly, in the case that the judgement in the step S1309 is negative, the ECU 30 operates the starter 26 so as to start the engine 10, and finishes the process in the present routine.

On the contrary, in the case that the judgement in the step S1309 is positive, the execution of the preheat is continued while monitoring the opening and closing state of the hood 202 according to the process procedure following step S1310.

That is, in the step 1310, while repeating the judgement whether or not the hood 202 is closed, the operation of the electric pump EP is continued as far as the judgement is positive, until it is confirmed that the predetermined time (the preheat time) has passed after starting the operation of the electric pump EP (step S1312).

When it is confirmed in the step S1312 that the preheat time has passed, the ECU 30 operates the starter 26 so as to automatically start the engine 10 (step S1313), and finishes the process in the present routine.

On the contrary, in the case that the hood 202 is opened at a time of starting the preheat, or in the case that the hood 202 is opened after starting the preheat, the judgement in the step S1310 becomes negative, and step S1331 is executed.

In the step S1331, an alarm sound is generated via the buzzer 206, and the operation of the electric pump EP is interrupted. Thereafter, the ECU 30 repeatedly judges in the following step S1332 at every predetermined time whether or not the hood 202 is closed, resumes the operation of the electric pump EP at a time when it is confirmed that the hood 202 is closed, and returns the process to the step S1308.

As mentioned above, according to the engine system 100 of the present embodiment, in the case that the engine room in the vehicle on which the engine system 100 is mounted is under the open state, the execution of the preheat is restricted. As a result, an automatic start of the engine 10 interlocked with the execution of the preheat is not performed. Accordingly, the driver and the maintenance worker are not surprised by an unexpected start of the engine 10 in the case of opening the hood so as to maintain the engine system 100 or the like, or feel burdensome, so that a convenience can be improved.

Further, since the emergency start switch is provided, it is possible to forcibly start the engine 10 according to an intention of the driver and the maintenance worker. Accordingly, the driver and the maintenance worker can feel a comfortable operation feeling with respect to the driving operation of the engine system 100 since the intention of themselves is basically taken priority, so that it is possible to further improve the convenience.

Further, in the present embodiment, the structure is made such that the main relay is turned ON by recognizing the opening of the door 207, however, in place of this, the structure may be made such that the main relay is turned ON by expecting that the door 207 is opened. For example, it is possible to expect that the door 207 is opened, by detecting that the door lock is turned OFF from ON.

(Thirteenth Embodiment)

Next, a description will be given of an thirteenth embodiment obtained by applying the internal combustion engine with the heat accumulating device to the engine system to be mounted on the vehicle, by mainly referring to different points from the first to twelfth embodiments mentioned above.

In this case, in the thirteenth embodiment, a structure of the engine system to be applied, an electrical structure of the ECU and around the ECU (FIGS. 1 and 2) and the like are the same as those of the first embodiment. Accordingly, the same reference numerals are attached to the members, the hardware and the like having the same function and structure, and an overlapping description is omitted here.

The engine system 100 according to the thirteenth embodiment continuously supplies the heat reserving hot water left within the heat accumulating device 21 to the cylinder head 10*b* even after the preheat is finished.

Figure 31:
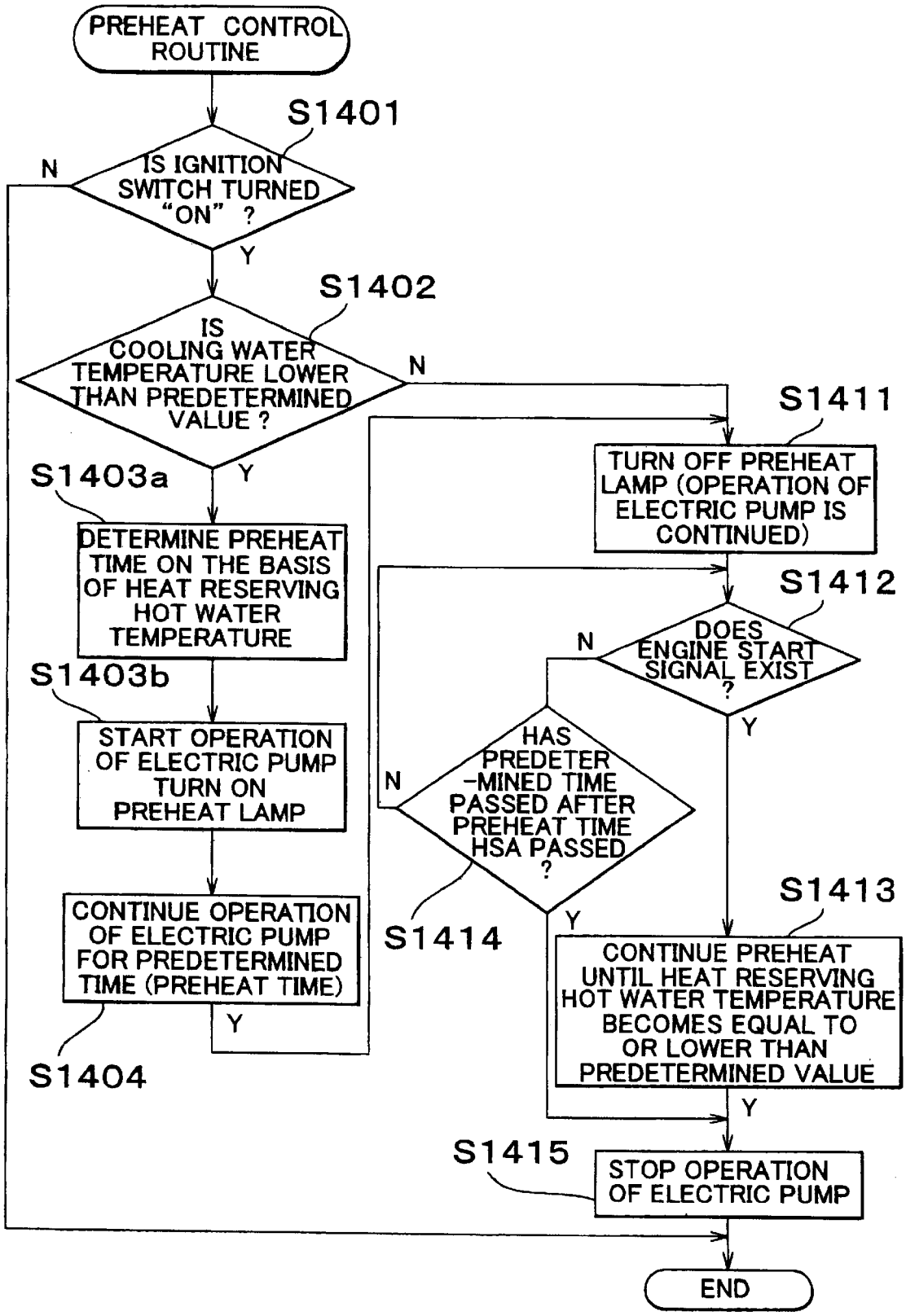
FIG. 31 is a flow chart showing a preheat control procedure according to a thirteenth embodiment of the invention.

FIG. 31 is a flow chart showing the process contents of a "preheat control routine" which the engine system 100 according to the present embodiment executes at every predetermined time while the engine 10 is stopping.

In the routine, in a series of steps S1401 to S1404, the ECU 30 recognizes the preheat requirement, sets the condition and executes the preheat in accordance with the same process procedure as that of a series of steps S801 to S804 in the "preheat control routine" (FIG. 18) according to the seventh embodiment.

Further, when a predetermined time (the preheat time) has passed after starting the execution of the preheat (steps S1403*a* and S1404), the ECU 30 turns off the preheat lamp 28 in a state of sill keeping the operation of the electric pump EP (step S1411).

In the following step S1412, it is judged whether or not the start signal of the engine 10 is generated after the present routine is started. As the start signal of the engine 10 as mentioned above, it is possible to employ the command signal output from the ECU 30 in order to drive, for example, the starter 26, the fuel injection valve 18 or the igniter 19. If the judgement in the step S1412 is positive, and step S1413 is executed, continues the execution of the preheat (the operation of the electric pump EP) until the temperature of the cooling water within the heat accumulating device 21, that is, the heat reserving hot water temperature THWre becomes equal to or lower than a predetermined value, and thereafter, stops the operation of the electric pump EP (step S1415).

On the contrary, in the case that the judgement in the step S1412 is negative, the ECU 30 judges whether or not the predetermined time has passed after the preheat time passed (after the step S1411 is executed) (step S1414), returns the process to the step S1412 when the judgement is negative, and step S1415 is executed so as to stop the operation of the electric pump EP when the judgement is positive.

That is, even in the case that the warming-up caused by the preheat is in any case completed and the engine 10 becomes under the state of being preferably started, the operation of the electric pump EP is continued as far as the heat reserving hot water capable of effectively increasing the of temperature of the cylinder head 10*b* stays within the heat accumulating device 21. That is, even after starting the engine 10, the heat reserving hot water is supplied within the cylinder head 10*b* for a moment.

In this case, if the engine is not started until the predetermined period has passed after the preheat time has passed, the operation of the electric pump EP is temporarily stopped on the basis of the judgement in the step S1414 and the process in the step S1415.

After passing through the step S1415, the ECU 30 finishes the process in the present routine.

In most cases, the temperature of the internal combustion engine does not reach the temperature of the supplied heat transfer medium even after finishing the warming-up, so that there is frequently left room that the heat of the heat transfer medium is transmitted to more fine portions. However, according to the engine system 100 of the present embodiment, it is possible to improve a stability of the engine combustion immediately after starting the engine 10 and further improve the exhaust characteristics by performing control so as to make good use of the heat reserving hot water left in the heat accumulating device 21 even after the warming-up of the engine 10 caused by the preheat is completed.

Further, since there is employed the control configuration for stopping the supply of the heat reserving hot water in the case that the heat reserving hot water temperature THWre becomes equal to or lower than a predetermined value at a time of executing the control, or in the case that the engine is not started even after the predetermined time has passed after completing the preheat, the drive electric power of the electric pump EP and an amount of consumption of the heat reserving hot water (heat) stored in the heat accumulating device 21 is kept minimum.

In this case, in the step S1403*a* in the "preheat control routine" according to the present embodiment, a time shorter than the time for entirely completing the warming-up of the engine 10 may be set as the preheat time. As mentioned above, if the preheat time is intentionally shorted, a sense of discomfort can be further reduced for the driver since a waiting time before starting is shortened, and with respect to the exhaust characteristics of the engine 10 and the like, the warming-up is completed immediately after the engine 10 is started, because the heat reserving hot water is continuously supplied after the engine 10 is started even when the warming-up before the engine is started is not entirely finished. Accordingly, it is possible to preferably achieve both of improvement of the operating feeling at a time of starting the engine 10 and improvement of the exhaust characteristics and the fuel economy.

(Other Embodiments)

In this case, it is possible to construct the other control configuration obtained by mutually combining the processed in the respective steps of the "preheat control routine" according to the first to thirteenth embodiments. For example, in the "preheat control routine" in any one of the embodiments, it is possible to control so as to automatically start the engine 10 after canceling the inhibition of the start of the engine 10, or it is possible to allow a manual start.

Further, the motion applied as the trigger for starting the preheat in the "preheat control routine" according to each of the embodiments mentioned above is not limited to the operation of the ignition key 27*a* and the opening of the door on the side of driver's seat, and may be replaced, for example, by various kinds of motions such as a sitting on the driver's seat of the driver, a fastening of the seat belt, a depressing of the brake pedal, a depressing of the clutch pedal in the MT vehicle, and the like. Of course, in this case, devices for detecting the sitting, the fastening of the seat belt, the depressing of the brake pedal, and the depressing of the clutch pedal are respectively required. A fail-safe structure such that the engine is not started until the clutch pedal is depressed is frequently employed in the MT vehicle. Further, the control configuration may be made such that various kinds of motions are combined and the preheat is started if a plurality of motions are detected. Further, for example, if the structure is made such that a transmitting device sending a specific signal on the basis of the operation of the driver is installed in the ignition key 27*a*, and the preheat is started according to the trigger generated by a remote operation via a communicating signal by the transmitting device, it is possible to obtain the same effect as or similar effect to that of each of the embodiments.

Further, in each of the embodiments mentioned above, the temperature (for example, 60 to 80° C. or the like in accordance with the standard for judging the warming-up completion) set as the standard for judging the execution of each of the preheat controls, is different in accordance with the applied engine and system and the executing environment, and a design may be suitably changed in accordance with the used condition.

Further, in each of the embodiments mentioned above, the cooling water temperature (the engine outflow water temperature) THWex determined on the basis of the detected signal of the water temperature sensor 25*a* is exemplified as the parameter being representative of the temperature (the temperature state) of the engine 10. However, this is not limited, and it is possible to employ the cooling water temperature (the engine inflow water temperature) THWin determined on the basis of the detected signal of the water temperature sensor 25*b* or an average value between the engine inflow water temperature THWin and the engine outflow water temperature THWex, as the parameter being representative of the temperature of the engine 10. Further, the structure may be made such that a detecting device for taking the other information reflecting the temperature of the engine 10 or the temperature of the intake port 16 is provided in the engine system 100, and the temperature of the engine 10 is known on the basis of the information. For example, the structure may be made such that a sensor directly detecting the temperature of the engine 10 main body or the temperature within the intake port 16 is provided, or an oil temperature sensor detecting an oil temperature of a lubricating oil is provided.

Further, the structure may be made such that the temperature state of the engine 10 is estimated on the basis of one or a plurality of parameters concerning various kinds of operation states of the engine system 100 (for example, an elapsed time after starting the preheat, an intake air temperature, an engine output, an accumulated amount of load and the like).

Further, the cooling system 20 of the engine system 100 applied in each of the embodiments mentioned above is structured such that the circulating passages for the cooling water are substantially independently formed within the cylinder block 10*a* and within the cylinder head 10*b*. Further, since the cooling water flows only through the circulating passage B between the heat accumulating device 21 and the cylinder head 10*b* during the preheat, in particular, near the intake port within the cylinder head by priority, the structure is made such that the temperature of the intake port is controlled in preference to the other portions.

Figure 32:
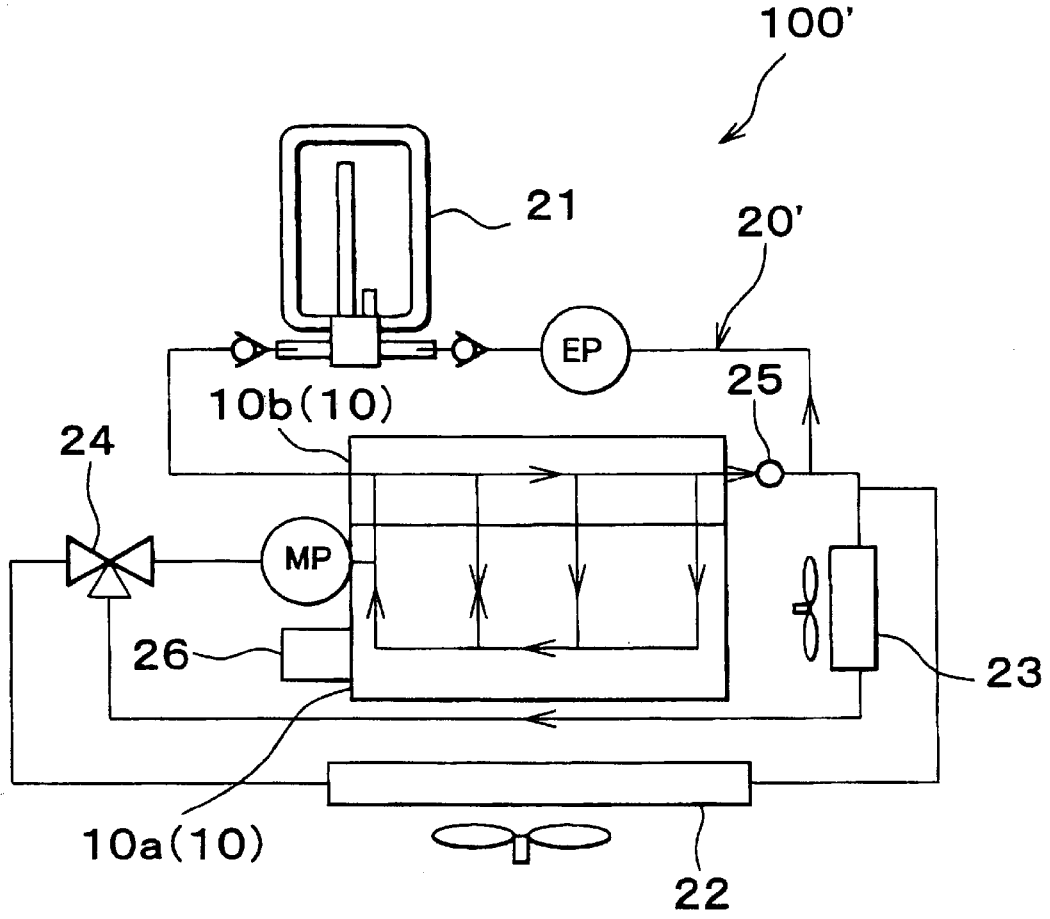
FIG. 32 is a schematic view schematically showing an engine system according to another embodiment.

On the contrary, for example, as an engine system 100' shown in FIG. 32, even in the case that the structure is made such that a cooling system 20' is provided with a common cooling water circulating passage within the cylinder block 10*a* and the cylinder head 10*b* and the cooling water is circulated all around the engine 10 during the preheat, it is possible to apply the invention so as to obtain the effect similar to that of each of the embodiments.

Figure 33:
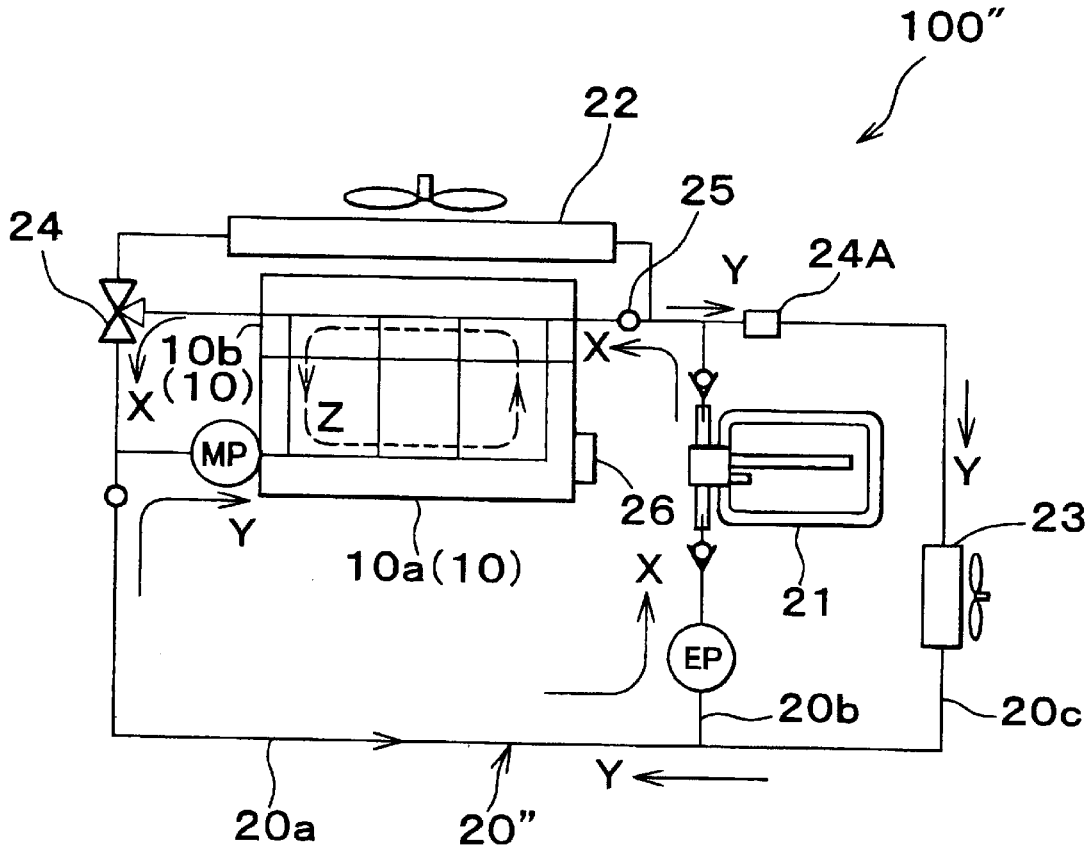
FIG. 33 is a schematic view schematically showing an engine system according to another embodiment.

Further, for example, the invention may be applied to an engine system 100" shown in FIG. 33.

In the engine system 100", as a part of a cooling system 20" thereof, a passage 20*b* and a passage 20*c* are arranged in parallel in the middle of a circulating passage 20*a* circulating the cooling water through the engine 10, and the heat accumulating device 21 and the heating heater core 23 are provided in the middle of each of the passages. Further, the structure is made such that a flow amount of the cooling water flowing through the passage 20*c* can be freely controlled by the flow amount control valve 24A. In the engine system 100" having the structure mentioned above, the cooling water within the cooling system 20" flows in opposite directions between the preheating time and the normal engine operating time.

That is, during the preheat, the cooling water flows in Direction X shown by an arrow at each of the portions as shown in FIG. 33 due to the operation of the electric pump EP, and at the normal operating time, the cooling water flows in Direction Y shown by an arrow at each of the portions due to the operation of the mechanical type pump MP in such a manner as to take the cooling water within the engine 10. Further, when the mechanical pump MP is driven in a fully closed state of the flow amount control valve 24, the cooling water circulates in a state of being substantially closed within the engine 10 (Direction Z shown by an arrow). It is possible to quickly warm up the cooling water temperature THW within the engine immediately after the engine is started according to the mode mentioned above. If the "preheat control" according to each of the embodiments mentioned above is commonly employed in the structure of the cooling system 20" mentioned above, it is possible to further increase the warming-up efficiency before and after the engine is started.

Further, in each of the embodiments mentioned above, the heat accumulating device according to the invention can be constituted by the cooling system 20, 20' or 20" integrally forming with the engine 10, and the ECU 30. On the contrary, as far as the device is structured such as to store the heat in any way and supply the heat to the engine prior to the start of the internal combustion engine, it is possible to achieve the function of the heat accumulating device according to the invention. In other words, it is possible to employ an device for storing the heat via an oil or the like as far as storing the heat and functioning as the heat source, and further, it is possible to employ an device for storing the heat as an electric power and an device for storing a chemical material potentially containing the heat and suitably generating heat due to a chemical reaction, for the heat accumulating device.

For example, as a method of supplying heat to the heat accumulating device, the structure may be made such that an electric heater is provided within the heat accumulating device, and the heat transfer medium within the heat accumulating device is heated by an electric power output from the battery mounted on the vehicle. In this case, the electric power stored in the battery may be obtained from an alternator provided in the engine or may be obtained at a regenerative braking time. Further, the structure may be made such that the supply passage for the engine oil is provided within the heat accumulating device so as to exchange heat between the heat transfer medium in the heat accumulating device and the engine oil at a time of normal traveling. Further, the structure may be made such that a temperature sensor is provided in the heat accumulating device so as to supply the heat to the heat transfer medium in the manner mentioned above when the temperature of the heat transfer medium within the heat accumulating device becomes equal to or lower than a predetermined temperature (for example, 80° C.). Further, as a method of supplying heat to the heat accumulating device, in the structure having the bypass passage A3 as mentioned in the embodiments 1 to 13 mentioned above, the structure may be made such as to operate the electric pump EP so as to increase the temperature of the heat transfer medium when the temperature of the heat transfer medium within the heat accumulating device becomes equal to or lower than a predetermined temperature (for example, 80 degrees).

Further, it is possible to employ the engine system structured such that the heat supply is executed by a radiant heat and a heat transmission from the heat accumulating device, or the other corresponding device constructions.

Further, a subject to which the internal combustion engine provided with the heat accumulating device so as to execute the preheat is applied is not limited to the vehicle.

Further, the internal combustion engine mentioned above may be a so-called hybrid engine in which another drive means (for example, an electric type motor) is further attached and a drive force is generated due to cooperation between the internal combustion engine and another drive means (a prime mover). In this case, for example, it is possible to perform control in such a manner that the driving operation is executed only by another drive means, for example, until the heat supply (the preheat) from the heat accumulating device is completed. Then, a period that the driving operation is executed only by another drive means, in other words, a period until the heat supply is completed (in accordance with the preheat time). The period may be determined by simply counting a preset time, or may be suitably determined on the basis of a distance along which the vehicle travels, for example, by another drive means.

Further, if the invention is applied to every heat supplied body such as the other drive means (for example, the prime mover such as the electric type motor) as a single unit, the battery or the fuel cell for supplying the electric power to the electric type motor, the fuel injection valve, the transmission and the like, that is, the engine, the mechanism, the device, the drive circuit and the like which requires a certain degree of warming-up, in other words, heat supply for securing a preferable operation state, it is possible to obtain the same effect as or the similar effect to that of each of the embodiments mentioned above in view executing the control for optimizing the operation state, particularly the operation state at a time of starting the operation.

Then, in the case of controlling the operation state of the heat supplied body such as the internal combustion engine, the electric type motor, the fuel injection valve, the transmission and the like, whatever type of heat supplied bodies the invention is applied to, it is possible to obtain the same effect as or the similar effect to that of each of the embodiments mentioned above by controlling (for example, inhibiting or allowing) various kinds of operation states such as the stop timing, the degree of the operation state (for example, an output state), the gear change ratio of the transmission and the like in addition to the start timing of each of the heat supplied bodies.

In the embodiments mentioned above, the structure is made such that the preheat condition is set in the step S2 or the like when the preheat requirement is generated, however, in place thereof, the structure may be made such that a predetermined preheat stored in the ECU or the like is executed (for example, operating the electric pump EP for 5 seconds) without setting the condition for the preheat when the preheat requirement is generated.

When the amount of heat stored in the heat accumulating device (the temperature of the heat transfer medium in the heat accumulating device) becomes lower than a predetermined value, according to the embodiment which stops the heat supply to the internal combustion engine, it is possible to prevent the heat transfer medium that became unable to increase the temperature of the internal combustion engine from being brought into contact with the internal combustion engine. In this case, since the warming-up process is continued as far as keeping the amount of heat capable of increasing the temperature of the internal combustion engine, the warming-up capability of the internal combustion engine obtained by the heat accumulating device can be made good use to the full.

Further, according to the embodiment in which the internal combustion engine is automatically started after the executing period of the warming-up process has passed, it is possible to automatically execute a series of operations executed from the start of the heat supply to the internal combustion engine to the start of the internal combustion engine without the manual operation of the driver. That is, a chance to utilize the warming-up effect by the heat generating device can be preferably and automatically secured. Accordingly, it is possible to start the operation of the internal combustion engine while intending to optimize the exhaust characteristics and the fuel economy performance at a time of starting the internal combustion engine, and without a troublesome operation for the driver.

According to the embodiment in which a start notifying means, which is provided within the engine room of the vehicle on which the internal combustion engine is mounted, for notifying the automatic start prior to the automatic start of the internal combustion engine, even in the case that the engine is opened, the notification is generated prior to the automatic start of the internal combustion engine, and for example, the maintenance worker, the driver and the like present in the periphery of the engine room can recognize that an automatic start of the internal combustion engine is expected. Accordingly, the maintenance worker, the driver and the like mentioned above are not surprised with the unexpected start of the internal combustion engine.

Further, according to the embodiment in which the internal combustion engine with the heat accumulating device is provided with the invalidating operation portion, which is provided within the engine room of the vehicle on which the internal combustion engine is mounted, for applying the operation of invalidating the automatic start of the internal combustion engine from outside of the internal combustion engine, the maintenance worker, the driver and the like of the internal combustion engine can optionally abandon the automatic start of the internal combustion engine as occasion demands. Accordingly, for example, it is possible to improve a convenience with respect to the maintenance operation or the like of the internal combustion engine.

According to the embodiment provided with the open state recognizing means for recognizing whether or not the engine room of the vehicle on which the internal combustion engine is mounted is in the open state, and the invalidating control means for controlling so as to invalidate the automatic start of the internal combustion engine in the case that it is recognized that the engine room is in the open state, in the case that the engine room is in the open state, the internal combustion engine is automatically started. Accordingly, the maintenance worker, the driver and the like present around the engine room is not surprised by the unexpected start of the internal combustion engine.

Further, according to the embodiment in which the inhibiting operation portion, which is provided within the engine room of the vehicle on which the internal combustion engine is mounted, for performing an operation of inhibiting the execution of the control applied by the invalidating control means from outside of the internal combustion engine, it is possible to effectively apply the automatic start of the internal combustion engine in accordance with an optional intention of the maintenance worker, the driver and the like of the internal combustion engine. Accordingly, it is possible to further improve the convenience for the maintenance worker, the driver and the like of the internal combustion engine.

Further, according to the embodiment provided with the starting means for starting the internal combustion engine in accordance with the predetermined operating signal during the execution of the warming-up process, it is possible to execute the engine start prior to the warming-up process, in accordance with the intention of the driver of the internal combustion engine.

Further, according to the embodiment in which the period setting means sets the executing period of the warming-up process at a time of starting the warming-up process, the executing period of the warming-up process is set at a time of starting the warming-up process. Accordingly, it is possible to accurately set the period for which the warming-up effect utilizing the heat accumulating device can be used to the full. Further, together with setting the predetermined period, it is easy to control so as to inform the driver and the like of the internal combustion engine of, for example, the set contents. Accordingly, during the period for which the warming-up process is executed, the driver and the like of the internal combustion engine does not feel any sense of discomfort or a physical stress.

Further, according to the embodiment in which the period setting means sets the executing period of the warming-up process on the basis of parameters with respect to the temperature of the internal combustion engine, since the temperature of the internal combustion engine has a high correlation with the amount of heat required for the internal combustion engine to complete the engine warming-up, it is possible to accurately set the period necessary and sufficient for completing the engine warming-up. That is, the driver of the internal combustion engine is not required to wait for a longer time than the predetermined period until the warming-up process is completed.

Further, it is preferable that the parameters with respect to the temperature of the internal combustion engine include a temperature of a wall portion in the intake port.

In the internal combustion engine, the state in which the warming-up process is completed corresponds to a state in which the engine is sufficiently warmed up and the supplied fuel is sufficiently atomized even when the engine drive is performed. The state mentioned above has a high correlation with, for example, the temperature of the wall portion in the intake port having a substantially definite relation to the atomization of the supplied fuel. According to this embodiment, the parameter having a high reliability is added in view of judging the period until the warming-up is completed. Accordingly, the engine start takes place after the engine is reliably got out the cold state, so that it is possible to reliably cancel the deterioration of the exhaust characteristics and the fuel economy performance that are peculiar to the cold start time.

Further, according to the embodiment in which the period setting means sets the executing period for the warming-up process on the basis of the temperature of the heat transfer medium, at a time of executing the warming-up process, the temperature of the heat transfer medium constituting the heat source for increasing the temperature of the internal combustion engine has a high correlation with the time required for the internal combustion engine to complete the engine warming-up. Accordingly, according to this embodiment, it is also possible to accurately set a necessary and sufficient period for completing the engine warming-up. That is, the driver of the internal combustion engine is not required to wait for a longer time than the predetermined period until the warming-up process is completed.

In this case, the temperature of the internal combustion engine and the temperature of the heat transfer medium determine the period required for completing the engine warming-up, as the mutually independent parameters. Accordingly, if the executing period of the warming-up process is set by referring to both of the parameters, it is possible to further accurately set the period necessary and sufficient for completing the engine warming-up.

Further, according to the embodiment in which the pump for transferring the heat transfer medium from the heat accumulating device to the internal combustion engine is provided and the period setting means sets the executing period of the warming-up process on the basis of the transfer speed of the heat transfer medium, since the transfer speed of the heat transfer medium is associated with the heat transfer speed from the heat accumulating device to the internal combustion engine, according to this embodiment, it is also possible to further accurately set the period necessary and sufficient for completing the engine warming-up. In this case, the means for changing the transfer speed of the heat transfer medium may be added to the embodiment mentioned above, and the period necessary for completing the engine warming-up may be controlled to the desired length.

Further, according to the embodiment in which the electric pump for transferring the heat transfer medium from the heat accumulating device to the internal combustion engine is provided and the period setting means sets the executing period of the warming-up process on the basis of the drive voltage applied to the electric pump, in the case that the electric pump is employed for the means for transferring the heat transfer medium, the drive voltage applied to the electric pump determines at least one of the transfer speed and the flow amount of the heat transfer medium. Since the transfer speed of the heat transfer medium is associated with the heat transfer speed from the heat accumulating device to the internal combustion engine, according to this embodiment, it is also possible to further accurately set the period necessary and sufficient for completing the engine warming-up.

Further, according to the embodiment provided with the finish timing setting means for setting the finish timing of the executing period of the warming-up process after the warming-up process takes place, the proper finish timing of the warming-up process can be determined in accordance with the actual warming-up state. Accordingly, with respect to the warming-up process of the internal combustion engine performed by the heat accumulating device, a reliability can be improved.

Further, according to the embodiment in which the finish timing setting means sets the finish timing of the executing period of the warming-up process on the basis of the parameter with respect to the temperature of the internal combustion engine, since the proper finish timing of the warming-up process is determined on the basis of the parameter accurately reflecting the degree of progress of the warming-up, in accordance with the actual warming-up state, a reliability can be further improved in connection to the warming-up process of the internal combustion engine performed by the heat accumulating device.

Further, it is preferable that there is provided with the discharge portion for discharging the supplied heat transfer medium, and the parameters with respect to the temperature of the internal combustion engine include the temperature of the heat transfer medium discharged from the internal combustion engine through the discharge portion.

At a time of executing the warming-up process, if an efficient heat exchange is executed between the internal combustion engine and the heat transfer medium, the heat transfer medium is supplied to the internal combustion engine from the heat accumulating device. Then, the temperature of the heat transfer medium is simply reduced during a series of processes that the heat transfer medium is discharged from the internal combustion engine after exchanging heat with the internal combustion engine. Further, since the more the temperature of the internal combustion engine is increased so as to be closer to the temperature of the heat transfer medium, the less the amount of heat exchanged between the internal combustion engine and the heat transfer medium, the temperature of the heat transfer medium discharged from the internal combustion engine becomes increased. As a result, the temperature of the heat transfer medium discharged from the internal combustion engine is the lowest temperature observed in the transfer path of the heat transfer medium from the heat accumulating device to the internal combustion engine, and corresponds to the parameter accurately reflecting the temperature of the internal combustion engine at that time. Accordingly, for example, in the case that the temperature of the heat transfer medium at a time of being discharged from the internal combustion engine exceeds the predetermined temperature, it is supposed that the temperature of the internal combustion engine main body is also sufficiently increased. According to this embodiment, an accurate information with respect to the timing of the warming-up finish can be reflected to the control of the warming-up process by setting the finish timing of the executing period of the warming-up process with reference to the temperature of the heat transfer medium observed at a portion having the lowest temperature of the heat transfer medium among the transfer path of the heat transfer medium from the heat accumulating device to the internal combustion engine.

Further, according to the embodiment in which the warming-up process communicating means is provided with execution notifying means for giving at least one of a visual and auditory notification as a guide that the warming-up process is executed, within the passenger compartment of the vehicle on which the internal combustion engine is mounted, for example, the driver and the like of the internal combustion engine can easily and reliably recognize (conform) that the warming-up process is executed.

Further, according to the embodiment provided with the judging means for judging whether or not the warming-up process should be executed, and the inexecution notifying means for notifying in at least one of a visual and auditory manner that the warming-up process is not executed in the case that the judging means judges that the warming-up process should not be executed, in the case that the warming-up process is not executed under the positive judgement by the judging means, the driver and the like of the internal combustion engine does not erroneously recognize, for example, that the heat accumulating device is out of order or the like by recognizing the judged result.

Further, according to the embodiment in which the execution of the warming-up process is started in accordance with the communication signal from outside of the vehicle on which the internal combustion engine is mounted, since the driver of the internal combustion engine can freely execute the warming-up process according to the remote operation or the like, the convenience is improved at a time of executing the warming-up process.

Further, it is preferable that the execution of the warming-up process takes place in accordance with the predetermined operation applied to the vehicle on which the engine is mounted, prior to the start of the internal combustion engine.

In this case, according to the embodiment in which the predetermined operation selects the necessary operation prior to the engine start or the operation sufficiently and reliably reproduced at the period from the timing of the operation to the timing of the engine start, at a time of executing the warming-up process, a quantitatively stable executing period can be secured even before the engine start takes place. Accordingly, an efficiency of the warming-up process can be achieved.

In this case, the embodiment mentioned above can be combined as much as possible.

In this case, the heat transfer medium according to the present embodiment may employ the other medium such as an oil than the water. Further, the engine start of the invention means every related operations including an incidental motion executed together with the initial motion of the engine itself mentioned above such as the ignition key operation, the pedal operation, the stirring wheel operation and the like on the basis of the intention of the driver, or the combination of the various kinds of related motions, in addition to the initial motion which the engine itself executes at a time of starting the operation, for example, the fuel supply starting motion, the ignition starting motion, the output shaft rotation starting motion and the like. Further, executing the warming-up process according to the invention means the embodiment that at least the warming-up process is started.

What is claimed is:

1. An internal combustion engine comprising:

a combustion chamber;

a heat accumulating device that stores a heat;

a heat transferring device that transfers the heat stored in the heat accumulating device to raise the temperature of the combustion chamber through a predetermined heat transfer medium;

a controller that determines a warming-up process executing period during which the heat transferring device transfers heat stored in the heat accumulating device to the combustion chamber through the predetermined heat transfer medium, said warming-up process taking place before the internal combustion engine is started;

said controller monitoring and communicating information concerning the warming-up process; and a start operation invalidating device that prohibits the start operation of the internal combustion engine based on said information received from the controller.

2. An internal combustion engine with a heat accumulating device according to claim 1, wherein the controller determines that the heat is supplied to the internal combustion engine through the predetermined heat transfer medium, even after the executing period for the warming-up process.

3. An internal combustion engine with a heat accumulating device according to claim 2, wherein the controller determines that the heat supply to the internal combustion engine through the predetermined heat transfer medium is stopped in synchronization with a starting timing of the internal combustion engine.

4. An internal combustion engine with a heat accumulating device according to claim 1, wherein the heat supply is stopped when an amount of heat stored in the heat accumulating device becomes lower than a predetermined value.

5. An internal combustion engine with a heat accumulating device according to claim 1, further comprising a start control device that automatically starts the internal combustion engine after the executing period of the warming-up process has passed.

6. An internal combustion engine with a heat accumulating device according to claim 5, further comprising a start notifying device that notifies the start of the internal combustion engine prior to the automatic start of the internal combustion engine, wherein the start notifying device is provided within an engine room of the vehicle to which the internal combustion engine is mounted.

7. An internal combustion engine with a heat accumulating device according to claim 5, further comprising an invalidating operation portion that applies an operation of invalidating the automatic start of the internal combustion engine, even when the start operation invalidating device allows the start operation of the internal combustion engine.

8. An internal combustion engine with a heat accumulating device according to claim 5, further comprising:

an open state recognizing device that recognizes whether or not the engine room of the vehicle on which the internal combustion engine is mounted is in an open state; and an invalidating control device that controls so as to cancel the automatic start of the internal combustion engine in the case that it is recognized that the engine room is in the open state.

9. An internal combustion engine with a heat accumulating device according to claim 8, further comprising an inhibiting operation portion that performs an operation of inhibiting the execution of the control applied by the invalidating control device, even when the start operation invalidating device allows the start operation of the internal combustion engine wherein the inhibiting operation portion is provided within the engine room of the vehicle on which the internal combustion engine is mounted.

10. An internal combustion engine with a heat accumulating device according to claim 1, further comprising a starting device that starts the internal combustion engine in accordance with a predetermined operating signal during the execution of the warming-up process.

11. An internal combustion engine with a heat accumulating device according to claim 1, wherein the period setting device sets the executing period of the warming-up process at a time of starting the warming-up process.

12. An internal combustion engine with a heat accumulating device according to claim 11, wherein the period setting device sets the executing period of the warming-up process on the basis of a parameter with respect to a temperature of the internal combustion engine.

13. An internal combustion engine with a heat accumulating device according to claim 12, wherein the parameter with respect to the temperature of the internal combustion engine includes a temperature of a wall portion in the intake port.

14. An internal combustion engine with a heat accumulating device according to claim 11, wherein the period setting device sets the executing period for the warming-up process on the basis of the temperature of the heat transfer medium.

15. An internal combustion engine with a heat accumulating device according to claim 11, further comprising a pump that transfers the heat transfer medium from the heat accumulating device to the internal combustion engine is further provided, wherein the period setting device sets the executing period of the warming-up process on the basis of a transfer speed of the heat transfer medium.

16. An internal combustion engine with a heat accumulating device according to claim 11, further comprising an electric pump that transfers the heat transfer medium from the heat accumulating device to the internal combustion engine is further provided, wherein the period setting device sets the executing period of the warming-up process on the basis of a drive voltage applied to the electric pump.

17. An internal combustion engine with a heat accumulating device according to claim 1, further comprising a finish timing setting device that sets a finish timing of the executing period of the warming-up process after the warming-up process takes place.

18. An internal combustion engine with a heat accumulating device according to claim 17, wherein the finish timing setting device sets the finish timing of the executing period of the warming-up process on the basis of the parameter with respect to the temperature of the internal combustion engine.

19. An internal combustion engine with a heat accumulating device according to claim 18, further comprising a discharge portion that discharges the supplied heat transfer medium, wherein the parameter with respect to the temperature of the internal combustion engine include a temperature of the heat transfer medium discharged from the internal combustion engine through the discharge portion.

20. An internal combustion engine with a heat accumulating device according to claim 1, wherein the warming-up process communicating device further comprises an execution notifying device that gives at least one of a visual and auditory notification as a guide that the warming-up process is executed, wherein the execution notifying device is provided within a passenger compartment of the vehicle on which the internal combustion engine is mounted.

21. An internal combustion engine with a heat accumulating device according to claim 1, further comprising:

a judging device that judges whether or not the warming-up process should be executed; and an inexecution notifying device that notifies in at least one of a visual and auditory manner that the warming-up process is not executed in the case that the judging device judges that the warming-up process should not be executed.

22. An internal combustion engine with a heat accumulating device according to claim 1, wherein the execution of the warming-up process is started in accordance with a communication signal from outside of the vehicle on which the internal combustion engine is mounted.

23. An internal combustion engine with a heat accumulating device according to claim 1, wherein the execution of the warming-up process takes place in accordance with the predetermined operation applied to the vehicle on which the engine is mounted, prior to the start of the internal combustion engine.

24. An internal combustion engine comprising:

a combustion chamber;

a heat accumulating device that stores a heat;

a heat transferring device that transfers the heat stored in the heat accumulating device to raise the temperature of the combustion chamber through a predetermined heat transfer medium;

a controller that determines a warming-up process executing period during which the heat transferring device transfers heat stored in the heat accumulating device to the combustion chamber through the predetermined heat transfer medium, said warming-up process taking place before the internal combustion engine is started;

said controller monitoring and communicating information concerning the warming-up process; and a start operation invalidating device that invalidates the start operation of the internal combustion engine based on said information received from the controller.

* * * * *